US009180671B2

(12) United States Patent
Suzuki et al.

(10) Patent No.: US 9,180,671 B2
(45) Date of Patent: Nov. 10, 2015

(54) LIQUID EJECTING APPARATUS INCLUDING A GAP FORMING MEMBER HAVING A LOCKING MEMBER

(71) Applicant: SEIKO EPSON CORPORATION, Tokyo (JP)

(72) Inventors: Yuto Suzuki, Shiojiri (JP); Satoshi Shimizu, Shiojiri (JP); Masaki Shimomura, Matsumoto (JP); Nobutaka Suzuki, Shiojiri (JP); Seiji Tezuka, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/961,049

(22) Filed: Aug. 7, 2013

(65) Prior Publication Data

US 2014/0098166 A1 Apr. 10, 2014

(30) Foreign Application Priority Data

Aug. 10, 2012 (JP) ..... 2012-178150
Aug. 10, 2012 (JP) ..... 2012-178153

(51) Int. Cl.
*B41J 2/17* (2006.01)
*B41J 2/175* (2006.01)
*B41J 29/02* (2006.01)

(52) U.S. Cl.
CPC ..... *B41J 2/175* (2013.01); *B41J 2/17509* (2013.01); *B41J 29/02* (2013.01)

(58) Field of Classification Search
USPC ..... 347/84–86
See application file for complete search history.

(56) References Cited

U.S. PATENT DOCUMENTS 5,718,526 A * 2/1998 Yokota ..... 400/605
2004/0125182 A1* 7/2004 Akermalm ..... 347/85
2005/0006835 A1* 1/2005 Teo et al. ..... 271/9.01
2005/0219281 A1* 10/2005 Seino et al. ..... 347/6

(Continued)

FOREIGN PATENT DOCUMENTS

CN 2825289 10/2006
JP 2009-072947 4/2009

(Continued)

OTHER PUBLICATIONS

August Miller, Flickr: Discussing How-To// Continuous Ink Supply System on an Epson 1400 in Kate's 210 Illustration Class, [online], Mar. 17, 2010, [retrieval date Sep. 5, 2013], internet.

(Continued)

*Primary Examiner* — Stephen Meier
*Assistant Examiner* — Sharon A Polk
(74) *Attorney, Agent, or Firm* — Workman Nydegger

(57) ABSTRACT

A liquid ejecting apparatus includes a main body in which an opening portion exposing at least a portion of a carriage moving area, a cover section displaceable with the main body, an ink tank that is located outside the main body, an ink supply tube for supplying ink from the ink tank to a head, and a spacer that forms a gap between the main body and the cover. An accommodation section is configured by a casing portion formed to protrude in a discharge direction of paper. An operation panel section is configured by a casing portion exhibiting an inclined surface. The spacer forms a gap having a size that does not shut off at least an ink flow path of the ink supply tube and passes the ink supply tube through the formed gap.

10 Claims, 35 Drawing Sheets

(56) References Cited

U.S. PATENT DOCUMENTS

| | | | | |
|---|---|---|---|---|
| 2006/0222435 | A1* | 10/2006 | Ha et al. | 400/691 |
| 2008/0309738 | A1* | 12/2008 | Yan | 347/85 |
| 2010/0319507 | A1* | 12/2010 | Tse et al. | 83/56 |
| 2011/0018947 | A1* | 1/2011 | Kobayashi | 347/85 |
| 2013/0250013 | A1* | 9/2013 | Koichi | 347/86 |

FOREIGN PATENT DOCUMENTS

| | | |
|---|---|---|
| JP | 2010-264607 | 11/2010 |
| JP | 2011-143725 | 7/2011 |
| JP | 2011-156685 | 8/2011 |
| TW | 538909 | 6/2003 |
| WO | 2009-119084 | 10/2009 |

OTHER PUBLICATIONS

International Search Report dated Sep. 17, 2013 for PCT/JP2013/004407.

* cited by examiner

LIQUID EJECTING APPARATUS INCLUDING A GAP FORMING MEMBER HAVING A LOCKING MEMBER

BACKGROUND

1. Technical Field

The present invention relates to a liquid ejecting apparatus that ejects liquid onto a target.

2. Related Art

In the past, as one type of a liquid ejecting apparatus, an ink jet type printer has been known which performs printing (recording) by ejecting ink from a liquid ejecting head onto a target such as paper. Then, in such a printer, in order to continuously and stably supply ink to the liquid ejecting head in a case of performing a relatively large amount of printing, a configuration to supply ink from an ink tank having relatively large ink accommodation capacity through an ink supply tube to an ink cartridge has been proposed (refer to Taiwan Patent No. 538909, for example).

In the printer having such a configuration, the liquid ejecting head is mounted on a carriage provided so as to be able to reciprocate in a main scanning direction with respect to paper in a casing section (a main body housing) of a main body. Then, the ink supply tube extending from a liquid accommodation section (the ink tank) provided outside the casing section is inserted into a carriage moving area through an opening portion on the upper side of the casing section and connected to the ink cartridge mounted on the carriage.

At this time, a cover member (a cover) displaceable in a direction to open and close the opening portion is provided in the main body housing and also a state is created where the ink supply tube is sandwiched between the cover member displaced in a direction to close the opening portion and the casing section. For this reason, a spacer through which the ink supply tube passes is provided between the cover member and a peripheral site of the opening portion. The spacer has a substantially annular shape that allows the ink supply tube to be inserted by moving the ink supply tube in a length direction thereof, and the outer surface of the ink supply tube inserted into the inside of the spacer comes into contact with the inner surface of the spacer, whereby the movement of the ink supply tube in a direction crossing the length direction thereof is restricted.

Therefore, in the printer having the configuration described above, in a case of mounting the ink supply tube in the spacer or a case of dismounting the ink supply tube from the spacer, it is necessary to dismount an end portion of the ink supply tube on the side connected to the ink tank or the ink cartridge from the ink tank or the ink cartridge that is a connection partner thereof. That is, it is necessary to first turn the end portion of the ink supply tube on the side connected to the ink tank or the ink cartridge into a free end through dismounting work and then insert the ink supply tube into the inside of the spacer or take the ink supply tube out of the inside of the spacer while moving the ink supply tube in the length direction thereof. As a result, there is a problem that requires complicated work when leading around the ink supply tube while restricting the movement of the ink supply tube in a direction crossing the length direction thereof.

SUMMARY

An advantage of some aspects of the invention is that it provides a liquid ejecting apparatus in which it is possible to easily perform the work of leading around a liquid supply tube.

According to an aspect of the invention, there is provided a liquid ejecting apparatus including: a liquid ejecting head that ejects liquid onto a target; a casing section in which a carriage provided with the liquid ejecting head is movably disposed and an opening portion that exposes at least a portion of a moving area for the carriage disposed therein is formed; a cover member that is displaceable with respect to the casing section; a liquid accommodation section that is located outside the casing section in a state of accommodating the liquid that the liquid ejecting head ejects; a liquid supply tube that connects the liquid accommodation section and the liquid ejecting head such that the liquid can flow; and a gap forming member that forms a gap between the casing section and the cover member when the cover member has been displaced toward the opening portion, wherein in the casing section, a tray accommodation section in which a discharge tray that receives the target which is discharged from the inside of the casing section is accommodated so as to be able to be drawn out is configured by a casing portion formed to protrude in a discharge direction of the target, and an operation panel section that is operated at the time of use is configured by a casing portion exhibiting an inclined surface in which the lower side protrudes further to the discharge direction side than the upper side at a position above the tray accommodation section, and the gap forming member forms a gap having a size that does not shut off at least a flow path for the liquid of the liquid supply tube and passes the liquid supply tube through the formed gap.

According to this configuration, the gap forming member is provided between the casing section and the cover member, whereby it is possible to easily perform leading-around work by the liquid supply tube in which a liquid flow path is not shut off, in a state of being able to supply the liquid to the liquid ejecting head side, even without dismounting an end portion.

In the liquid ejecting apparatus according to the above aspect, it is preferable that the liquid ejecting apparatus further include a feed cassette section that detachably accommodates a feed cassette capable of accommodating the target in the casing portion formed to protrude in the discharge direction of the target, thereby being provided in a state of protruding in the discharge direction along with the casing portion formed to protrude in the discharge direction of the target.

According to this configuration, an increase in the size of the liquid ejecting apparatus can be suppressed.

In the liquid ejecting apparatus according to the above aspect, it is preferable that the cover member be a lid member capable of covering the opening portion and have a placement stand accommodation section in which a placement stand on which the target is placed can be folded and accommodated on the upper side.

According to this configuration, an increase in the size of the liquid ejecting apparatus can be suppressed.

In the liquid ejecting apparatus according to the above aspect, it is preferable that the gap forming member have a contact portion that comes into contact with the outer surface of the liquid supply tube, thereby restricting the movement of the liquid supply tube in a direction crossing a length direction thereof.

According to this configuration, even if an end portion of the liquid supply tube is dismounted, since the liquid supply tube passes through a gap formed by the gap forming member, thereby passing through the gap forming member such that the outer surface of the liquid supply tube comes into contact with the contact portion of the gap forming member, a state can be created where the movement of the liquid supply tube in a direction crossing the length direction is restricted. For this reason, it is possible to easily perform leading-around work while restricting the movement of the liquid supply tube in a direction crossing the length direction thereof.

In the liquid ejecting apparatus according to the above aspect, it is preferable that a recess portion in which the liquid supply tube can be inserted be formed in the gap forming member.

According to this configuration, by bringing the liquid supply tube into contact with the inner surface of the recess portion by inserting the liquid supply tube into the recess portion through an opening of the recess portion, it is possible to restrict the movement of the liquid supply tube without dismounting an end portion of the liquid supply tube.

In the liquid ejecting apparatus according to the above aspect, it is preferable that a slit for the passage of the liquid supply tube be formed in the gap forming member.

According to this configuration, by moving the liquid supply tube between a state of being inserted into the gap forming member and a non-insertion state through the slit formed in a portion of the gap forming member, it is possible to easily perform the work of leading around the liquid supply tube without dismounting an end portion of the liquid supply tube.

In the liquid ejecting apparatus according to the above aspect, it is preferable that a threaded hole be formed in at least one of the casing section and the cover member and the gap forming member be configured to include a fixing screw that is disposed to have a shaft portion which is partially screwed into the threaded hole.

According to this configuration, since the portion which is not screwed into the casing section in the shaft portion of the fixing screw protrudes from the surface of the casing section, it is possible to form a gap between the casing section and the cover member. Further, for example, by making the fixing screws be adjacent to each other and bringing the liquid supply tube into contact with the shaft portions by inserting the liquid supply tube between the shaft portions through the gap between the fixing screws adjacent to each other, it is possible to restrict the movement of the liquid supply tube without dismounting an end portion of the liquid supply tube.

In the liquid ejecting apparatus according to the above aspect, it is preferable that the gap forming member be provided at the cover member and the liquid supply tube be disengaged from the gap forming member in a case where the cover member is displaced in a direction to open the opening portion.

According to this configuration, it is possible to dismount the liquid supply tube from the gap forming member that is displaced together with the cover member according to the displacement of the cover member in a direction to open the opening portion, without dismounting an end portion of the liquid supply tube.

In the liquid ejecting apparatus according to the above aspect, it is preferable that the liquid supply tube include a plurality of tubes connected through a joint that connects the tubes.

According to this configuration, by connecting a plurality of tubes, it is possible to regulate the liquid supply tube to an optimal length for leading around.

In the liquid ejecting apparatus according to the above aspect, it is preferable that the liquid supply tube be provided one pieces or in plural pieces.

According to this configuration, it is possible to supply liquid from the respective liquid accommodation sections to the liquid ejecting head by the liquid supply tubes provided in the number corresponding to the number of liquid accommodation sections.

In the liquid ejecting apparatus according to the above aspect, it is preferable that the liquid accommodation section that is located outside the casing section in a state of accommodating the liquid to be ejected from the liquid ejecting head accommodate black liquid.

According to this configuration, since the consumption of black liquid is large, capacity to accommodate the black liquid increases.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as a first embodiment of a liquid ejecting apparatus, an ink jet type printer that is provided with a liquid ejecting head which ejects ink as an example of liquid and prints an image which includes characters, figures, or the like by ejecting ink onto paper as an example of a target will be described with reference to the drawings.

First Embodiment

Figure 1:
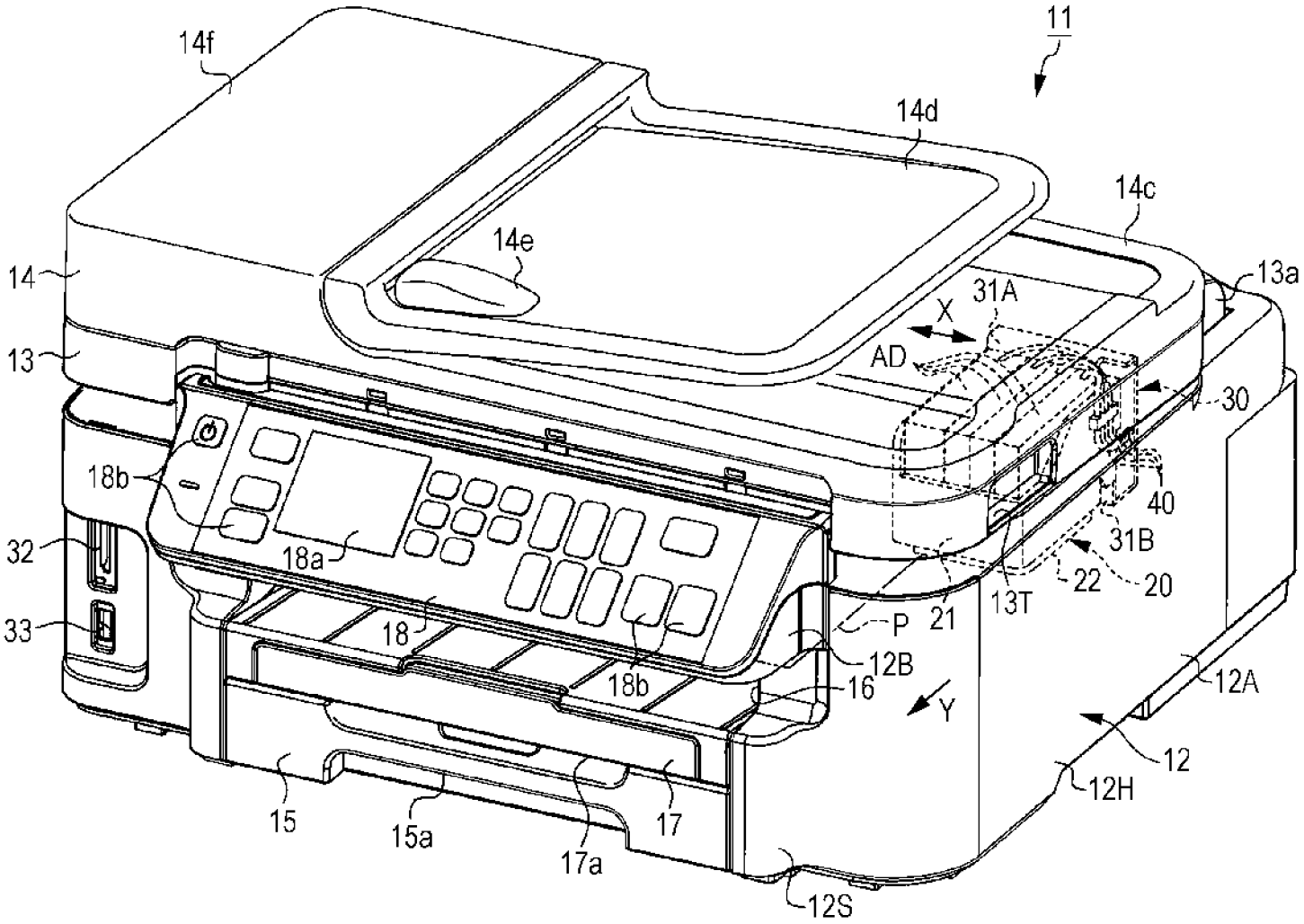
FIG. 1 is a perspective view showing a first printer in a first embodiment.

As shown in FIG. 1, a printer 11 of this embodiment is a so-called multifunction machine which includes a print function section 12A (a printer unit) that includes an apparatus main body 12 having a print function, and an image reading section 13 (a scanner unit) having a scan function which is provided above the apparatus main body 12. In the following description, the printer that is a multifunction machine shall be referred to as a first printer 11.

The first printer 11 receives the supply of ink from an ink tank 19T (refer to FIG. 3) as an example of a liquid accommodation section having a substantially rectangular parallelepiped shape, which is a separate body, through an ink supply tube 40 (refer to FIG. 3) which is disposed by a fixing section.

In the first printer 11, on the lower portion side in the gravity direction thereof, the print function section 12A as an example of a casing section having a printing section 20 built-in is disposed, and on the other hand, on the upper portion side that is the anti-gravity direction side thereof, the image reading section 13 having an image reading mechanism, such as a scanner reading a document (an image), built-in is disposed as an example of a cover member. The image reading section 13 has a configuration in which the image reading section 13 is turned (displaced) around a hinge 13*a* provided at one side end (the rear side) of the apparatus main body 12, whereby the front side on the opposite side to the hinge 13*a* is lifted. That is, hand hooking portions 13T are recessed in the casing side surfaces (both the left and right side surfaces) of the image reading section 13, and thus it is possible for a user of the first printer 11 to lift the image reading section 13 with the hands put in the hand hooking portions 13T at the time of maintenance, for example. Due to the lifting, an opening portion 12K (refer to FIG. 3) is exposed which exposes at least a portion of a moving area for a carriage 21 disposed so as to be able to reciprocate in the print function section 12A (that is, the apparatus main body 12).

In addition, an automatic document feeder 14 which automatically feeds a document to be read to the image reading section 13 is disposed above the image reading section 13. The automatic document feeder 14 is turned around a hinge 14*a* (refer to FIG. 2) provided at one side end (the rear side) of the apparatus main body 12, whereby the front side on the opposite side to the hinge 14*a* is lifted. Due to the lifting of the automatic document feeder 14, a platen 13*b* (refer to FIG. 2) which forms the upper surface of the image reading section 13 is exposed, and thus a user can manually feed a document to be read to the image reading section 13.

Here, the automatic document feeder 14 is provided with a document tray 14*d* for setting a document on the upper side of a rectangular plate-shaped main body 14*c*, and a guide member 14*e* for positioning a document in a width direction is provided on the document tray 14*d*. Documents set on the document tray 14*d* are fed one by one onto the platen 13*b* of the image reading section 13 by an operation of a feed mechanism section 14*f* disposed on the left side in FIG. 1, and after an image of the document is read, the document is discharged onto the main body 14*c*.

Further, a paper cassette 15 which can accommodate plural sheets of paper P in a stacked manner is detachably provided at a lower portion of the apparatus main body 12. The sheets of paper P accommodated in the paper cassette 15 are fed one by one toward the front from the back to the printing section 20 provided in the print function section 12A, and the printing section 20 performs printing on the paper P fed. That is, the paper P fed from the paper cassette 15 is transported to the printing section 20 by a transport mechanism which includes rollers 24 and 25 (described later) and the like. In the printing section 20, ink is ejected from a liquid ejecting head 22 which reciprocates along a direction (this is referred to as a main scanning direction X) crossing a transport direction (this is referred to as a sub-scanning direction Y) of the paper P by a movement mechanism to the paper P, whereby an image or the like is printed on the paper P. The printed paper P in which printing by the printing section 20 is finished is discharged (output) from a paper discharge port 16 provided in the front surface of the apparatus main body (the print function section 12A).

A stacker 17 as an example of a discharge tray taking the paper P which is discharged from the paper discharge port 16 is accommodated at a position which is on the upper side of the paper cassette 15 and the lower side of the paper discharge port 16 in the apparatus main body 12 (the print function section 12A). The stacker 17 is used to be drawn out from the apparatus main body 12 by a length corresponding to the size of the paper P which is discharged.

An accommodation section 12S having an accommodating recess portion in which the paper cassette 15 and the stacker 17 are accommodated, at a central portion in a width direction, is configured by a casing portion formed to protrude in a discharge direction of the paper P (here, the sub-scanning direction Y). The reason of making the accommodation section 12S protrude in this manner is because the required length in the sub-scanning direction Y of the paper cassette 15 is longer than the length in the sub-scanning direction Y of a casing 12H required for the printing section 20. For this reason, the paper cassette 15 and the stacker 17 are accommodated in the accommodation section 12S such that the front end faces are aligned in a state where the paper cassette 15 and the stacker 17 protrude in the sub-scanning direction Y (forward) from the apparatus main body 12. For details, if the length in the sub-scanning direction Y of the apparatus main body 12 is determined in accordance with the length in the sub-scanning direction Y of the paper cassette 15 required to accommodate the paper P having a predetermined size (as an example, an A4 size), since the apparatus main body 12 increases in size (the area of the bottom increases), in order to avoid this even a little, only an accommodation portion for the paper cassette 15 is made to protrude. In other words, portions of the paper cassette 15 and the accommodation section 12S are made to protrude forward by gouging both sides of the accommodation section 12S which accommodates the paper cassette 15. Further, since the front surface position of the stacker 17 at the time of accommodation is determined in accordance with the protruding front surface position of the paper cassette 15, a protruding length of the stacker 17 at the time of drawing-out is secured relatively long. In addition, due to the protrusion, the stacker 17 can be easily drawn out from the apparatus main body 12 by using a gripping portion 17*a*. In this manner, in spite of a configuration in which the paper cassette 15 is detachably provided in the front surface of the apparatus main body 12, thereby enabling paper feed from the front surface side of the apparatus main body 12, an increase in the size of the first printer 11 (in particular, an increase in the area of the bottom of the printer) is suppressed relatively.

On the other hand, as shown in FIG. 1, an operation panel section 18 for performing various operations such as making the printing section 20 carrying out a printing operation is disposed at a position further on the upper side than the paper discharge port 16 in the apparatus main body 12 (the print function section 12A). A base portion 12B of the operation panel section 18 is configured by a casing portion exhibiting an inclined surface in which the lower side thereof protrudes further to the discharge direction side of the paper P (that is, the sub-scanning direction Y side) than the upper side. Then, a display section (for example, a liquid crystal display) 18*a* for displaying a menu screen or the like and manual operation buttons 18*b* are mounted on the inclined surface of the base portion 12B. As the manual operation buttons 18*b*, for example, there are a power button, a selection button for selecting a desired item from the menu screen, a print start button for the instructions of the start of printing execution, and the like. The operation panel section 18 protrudes to the front of the apparatus main body 12 and a display surface and an operation surface thereof are made of an inclined surface descending forward, whereby the visibility of the display section 18*a* and the operability of the manual operation buttons 18*b* for a user are favorably secured.

Incidentally, the printing section 20 provided in the first printer 11 of this embodiment has the carriage 21 as an example of a moving body which reciprocates in the main scanning direction X, and the carriage 21 is provided with the liquid ejecting head 22 that ejects ink. The carriage 21 is disposed so as to be able to move (reciprocate) in the main scanning direction X while being guided by a guide frame 30 that is a plate member extending along the main scanning direction X. The guide frame 30 has an upper rail 31A and a lower rail 31B formed by bending a plate member into a substantial U-shape at both upper and lower end portions of the plate member perpendicular to the main scanning direction X. The carriage 21 reciprocates in the main scanning direction X in a state where the rear end side thereof is supported by the upper rail 31A and the lower rail 31B. Then, ink supplied from the ink tank 19T (refer to FIG. 3) through the ink supply tube 40 is ejected from the liquid ejecting head 22 provided in the carriage 21 which reciprocates, whereby printing is performed on the paper P.

The carriage 21 has the form of a substantially rectangular box with the upper side opened, and on a concave mounted portion of an upper portion thereof, an adaptor AD which relays ink that is supplied through the ink supply tube 40 to the liquid ejecting head 22 is mounted. Ink is supplied from the adaptor AD mounted on the carriage 21 to the liquid ejecting head 22. Therefore, the ink supply tube 40 connected to the adaptor AD forms a portion of an ink flow path in which ink can flow between the ink tank 19T and the liquid ejecting head 22.

The first printer 11 of this example can cope with color printing, and in the example of FIG. 1, a plurality of (for example, four) adaptors AD which is the same number as the number of ink colors (for example, four colors) required for color printing is mounted. Of course, the first printer 11 can also be used as a printer for black-and-white printing by mounting only the adaptor AD for black. Further, it is possible to use the carriage 21 with an ink cartridge mounted thereon, and the adaptor AD has a rectangular plate shape matching the shape and the size of an ink cartridge corresponding to the first printer 11. However, since ink volume may be small compared to the ink cartridge, the shape and the size of the adaptor AD may be appropriately changed as far as the adaptor AD can be mounted on the mounted portion of the carriage 21.

Further, as shown in FIG. 1, a slot 32 for inserting a card such as a memory card or a communication card and a communication port 33 (a connector) corresponding to a predetermined communication system such as USB communication, for example, are provided at a front left end portion of the apparatus main body 12. In the first printer 11, printing based on data received from a host apparatus through USB communication or the like, photographic printing which is performed by reading image data such as a photograph from a memory card, and the like are possible.

Figure 2:
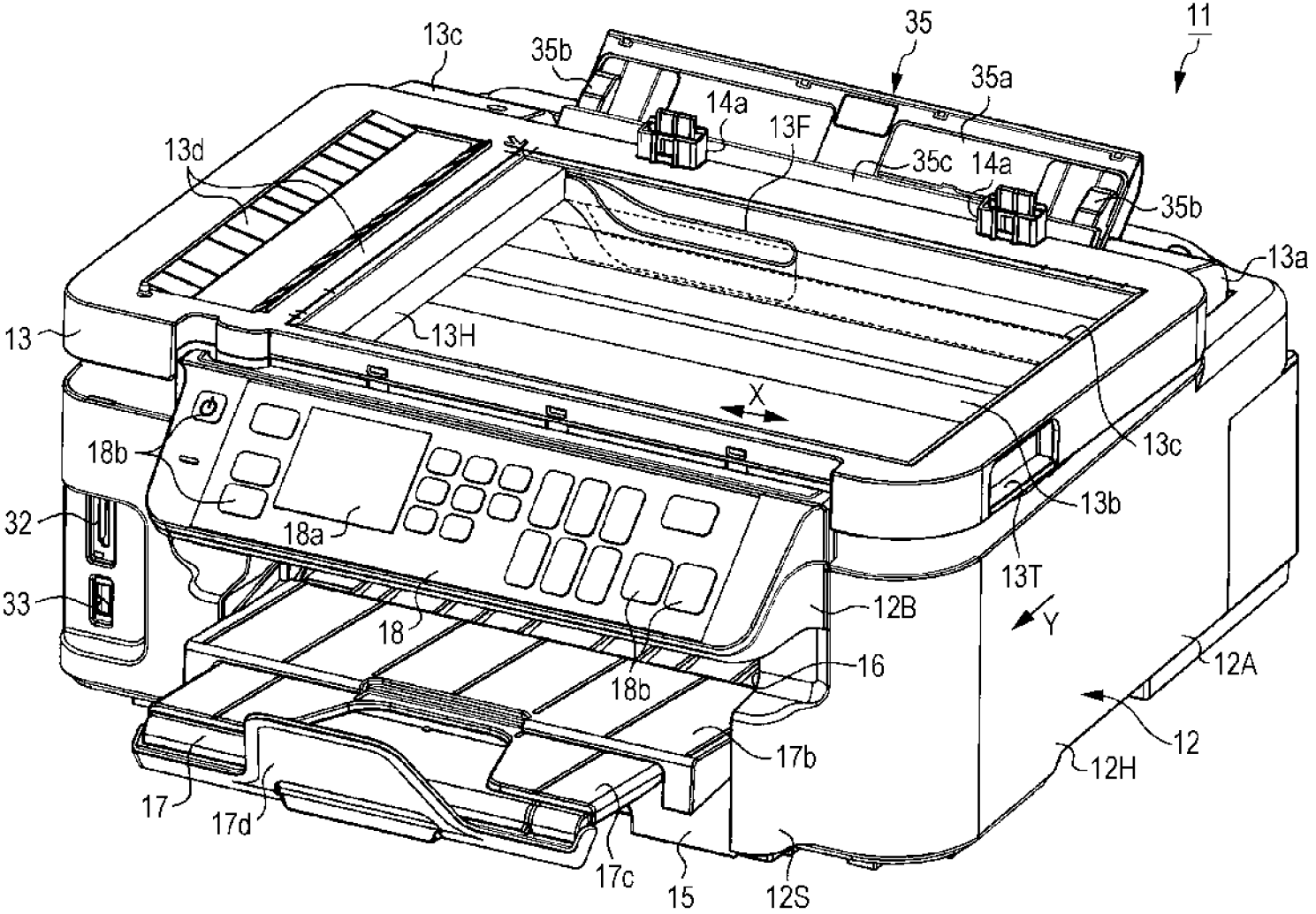
FIG. 2 is a perspective view showing the first printer in a state where a stacker and a manual paper feed mechanism are opened.

FIG. 2 shows the first printer 11 in a state where the automatic document feeder 14 is removed. In a state where the automatic document feeder 14 is opened, the platen 13*b* of the image reading section 13 shown in FIG. 2 is exposed, and at a position below a reading surface (a glass surface) thereof, a long reading head 13H that is long in the sub-scanning direction Y is provided in a state of being movable in the main scanning direction X. At a bottom portion in the image reading section 13, a concave groove 13*c* in which a flexible flat cable 13F (hereinafter referred to as an "FFC 13F") connected to one end portion of the reading head 13H is accommodated is formed so as to extend in the main scanning direction X. When the reading head 13H moves in the main scanning direction X, the FFC 13F moves in the concave groove 13*c* so as to follow the reading head 13H, whereby the reading head 13H can transmit a document read signal to a controller (not shown) in the first printer 11 through the FFC 13F in the entire area of a moving pathway thereof. In addition, a transport surface 13*d* for a document fed from the automatic document feeder 14 is formed at a position adjacent to the platen 13*b* in the upper surface of the image reading section 13.

Further, as shown in FIG. 2, a manual paper feed mechanism 35 is mounted on the back side of the apparatus main body 12 (the print function section 12A). The manual paper feed mechanism 35 is a mechanism to feed a single sheet of paper P manually set by a user. The manual paper feed mechanism 35 has a substantially rectangular plate-shaped paper feed tray 35*a*, a pair of paper guides 35*b* which is operated when positioning the paper P in a width direction on the paper feed tray 35*a*, and a protective plate 35*c* provided in order to prevent falling of foreign matter or the like into a feed port (not shown) in an opened state of the manual paper feed mechanism 35. The paper feed tray 35*a* is provided so as to be able to be turned around a base end portion (in FIG. 2, a lower end portion) thereof in a predetermined angle range, and disposed at an opened position shown in FIG. 2 where the paper feed tray 35*a* takes an inclined position in which the paper P can be set, and a closed position where the paper feed tray 35*a* is turned from the opened position to the front side of FIG. 2 and then accommodated in the apparatus main body 12. The protective plate 35*c* is biased in a direction to approach the paper feed tray 35*a* side by the elastic force of a torsion coil spring (not shown), and if the paper feed tray 35*a* is opened, the protective plate 35*c* is disposed at a protective position shown in FIG. 2 where the protective plate 35*c* is disposed in a position in which it is separated from a lower area of the paper feed tray 35*a* by a predetermined distance (for example, in a range of 3 mm to 10 mm), thereby preventing entry of foreign matter into the feed port.

Further, the stacker 17 is of a three-stage type as an example and includes a first tray 17*b*, a second tray 17*c*, and a third tray 17*d*. The first tray 17*b* is connected so as to be able to slide with respect to the apparatus main body 12, and the second tray 17*c* is connected so as to be able to slide with respect to the first tray 17*b*. Then, the third tray 17*d* is connected to a leading end portion of the second tray 17*c* so as to be able to be turned, and disposed at a closed position where the third tray 17*d* is accommodated in a state of overlapping the second tray 17*c* and an opened position where the third tray 17*d* stands in a posture rising forward at a predetermined angle, thereby also functioning as a paper stopper, as shown in FIG. 2.

Figure 3:
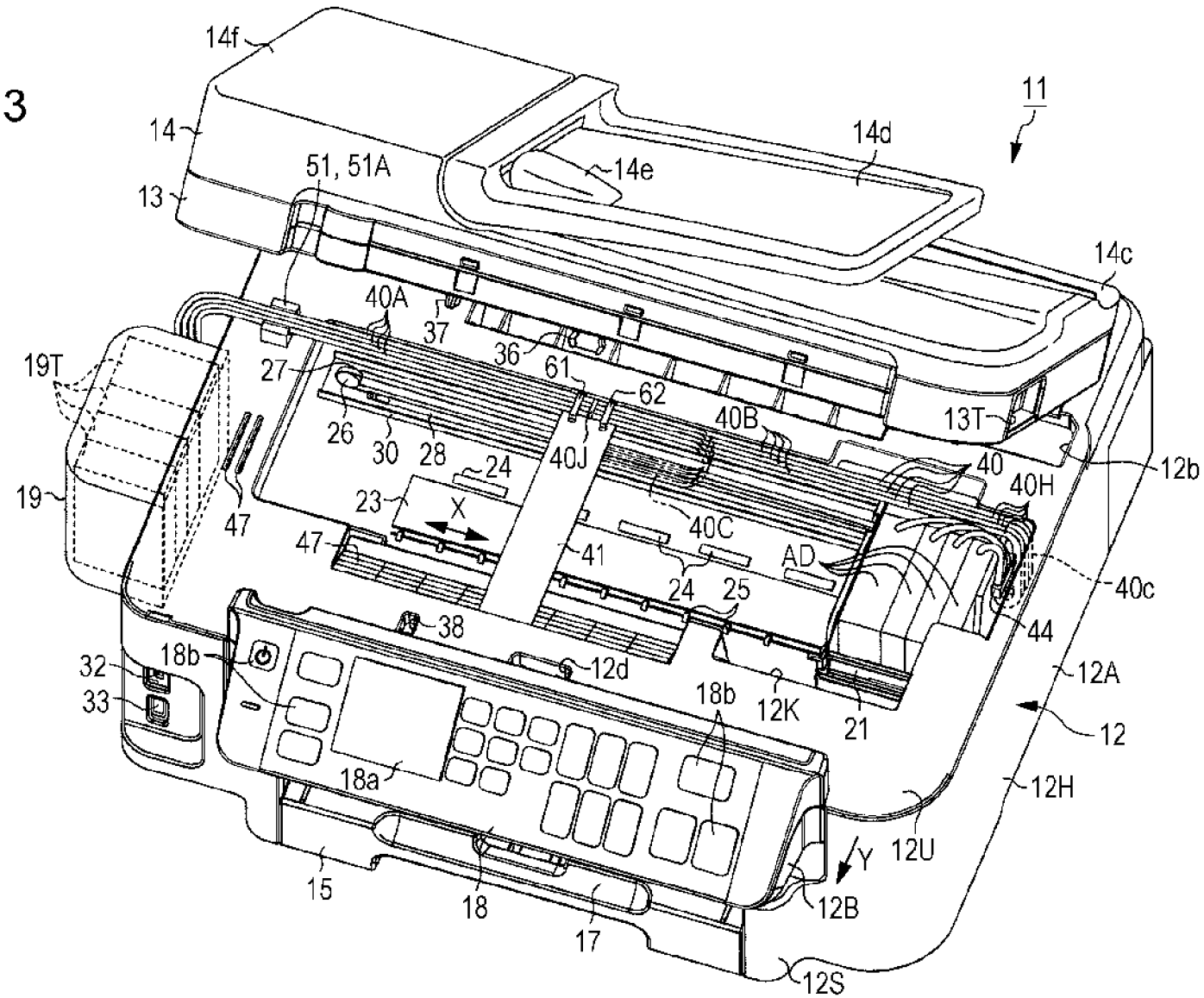
FIG. 3 is a perspective view showing the first printer in a state where an image reading section is opened.

Next, the configuration of the printing section 20 will be described briefly using FIG. 3. As shown in FIG. 3, a long support base 23 extending along the main scanning direction X is disposed at a position facing the lower surface (a nozzle formation surface) of the liquid ejecting head 22 (refer to FIG. 1) provided in a lower portion of the carriage 21 in the casing 12H. A transport roller 24 and a paper discharge roller 25 are disposed at the respective positions on the upstream side and the downstream side with the support base 23 interposed therebetween in the sub-scanning direction Y. The paper P accommodated in the paper cassette 15 is in a state where a pickup roller (not shown) comes into contact with the upper surface thereof. Due to the rotation of the pickup roller, the topmost sheet of the sheets of paper P is sent out in a pathway going through the rear end side, and a pathway of the paper P sent out is reversed in the sub-scanning direction Y along the outer peripheral surface of a feed roller (not shown), and thereafter, if the paper P reaches the transport roller 24, the paper P is fed onto the support base 23 by the rotation of the transport roller 24.

Further, in the casing 12H, an endless timing belt 27 wound around a pair of pulleys 26 is disposed so as to follow the guide frame 30 which is located on the back surface side of the carriage 21, and a back surface portion of the carriage 21 is fixed to a portion of the timing belt 27. A linear encoder 28 extending parallel to the timing belt 27 is provided to extend on the lower side of the timing belt 27, and the position of the carriage 21 is detected based on the detection signal of the linear encoder 28.

If a carriage motor (not shown) with an output shaft connected to the pulley 26 on one side is driven in normal rotation and reverse rotation, the timing belt 27 rotates in a normal direction and a reverse direction, and thus the carriage 21 reciprocates in the main scanning direction X along the rails 31A and 31B. Then, a document, an image, or the like is printed on the paper P by alternately performing a recording operation to perform recording corresponding to one line (one pass) on the paper P by ejecting ink from the liquid ejecting head 22 during the movement of the carriage 21 and a transport operation to transport the paper P to the next recording position. At this time, ejection and non-ejection of ink for each nozzle of the liquid ejecting head 22 is controlled according to the carriage position detected based on the detection signal of the linear encoder 28. In addition, in an upper surface portion 12U of the casing 12H, at a position corresponding to a locking projection 36 provided in a protruding state at a substantially central position in the width direction of a front end portion of the rear surface of the image reading section 13, a locking recess portion 12*d* is recessed which is locked to the locking projection 36 in a state where the image reading section 13 is closed. Further, a detected recess portion 38 in which a projection 37 provided on the rear surface of the image reading section 13 is inserted when the image reading section 13 is closed is formed at a position slightly separated to the immediate left of the locking recess portion 12*d* in the upper surface portion 12U of the apparatus main body 12. Further, vent holes 47 are formed around the opening portion 12K in the upper surface portion 12U of the casing 12H.

Ink that the liquid ejecting head 22 uses in the printing is supplied from each ink tank 19T in an external tank unit 19 through each ink supply tube 40 and each adaptor AD to the liquid ejecting head 22. In the tank unit 19 of this example, four ink tanks 19T which respectively accommodate ink of four different colors as an example are accommodated. As the four colors, for example, black (K), cyan (C), magenta (M), and yellow (Y) can be given. In the example of FIG. 3, among the four ink tanks 19T, one ink tank which accommodates black ink in which ink consumption is relatively large is a large-sized tank having a wide width, and three ink tanks which respectively accommodate ink of three colors for color printing are small-sized tanks having a slightly narrow width.

According to this configuration, since the consumption of black ink which is used when printing text characters is large, capacity to accommodate the black ink increases.

Further, with respect to the adaptors AD which can be mounted on the carriage 21, in accordance with the shape and the size of the ink cartridge for a corresponding ink color, the adaptor for black ink is made thick and the adaptors for color are made to have a thickness thinner than that. The carriage 21 has a plurality of (four) ink cartridge mounting recess portions, and if the adaptors AD are mounted on the mounting recess portions, terminals of the back surfaces thereof come into contact with terminals on the carriage 21 side.

Next, a first embodiment relating to the disposition of the ink supply tube 40 will be described with reference to FIGS. 3 to 5B. In the first embodiment, a spacer 51 as an example of the gap forming member in which a recess portion in which the ink supply tube 40 can be inserted from a direction crossing the length direction thereof is formed as a contact portion is provided between the print function section 12A and the image reading section 13.

As shown in FIG. 3, the ink tanks 19T which accommodate ink to be supplied to the carriage 21 (the adaptor AD) side are disposed outside the casing on the left side when viewed from the fore side in the sub-scanning direction Y with respect to the apparatus main body 12. That is, the ink tanks 19T are disposed outside the moving area for the carriage 21 and at a position close to the position on the opposite side to a home position in the main scanning direction X. Then, the one end side of the ink supply tube 40 functioning as a flow path for ink accommodated in the ink tank 19T is connected to the ink tank 19T. Further, the other end side of the ink supply tube 40 is inserted from a position close to the opposite side of the home position in the main scanning direction X of the carriage 21 into the moving area for the carriage 21 which is exposed through the opening portion 12K provided in the print function section 12A, and connected to the adaptor AD mounted on the carriage 21.

For details, one end portion of the ink supply tube 40 is connected to a discharge tube (not shown) provided at a lower portion of the tank unit 19 in a state of communicating with the ink tank 19T, and the other end portion is connected to a supply tube (not shown) of the upper surface of the adaptor AD mounted on the carriage 21. Each ink supply tube 40 connected between the tank unit 19 and the adaptor AD on the carriage 21 is installed in a state of extending substantially straight in the main scanning direction X above a back-side portion of the opening portion 12K in a case where a side of the hinge 13*a* which pivotally supports the image reading section 13 so as to be able to be turned is set to be the back side.

As shown in FIG. 3, on the upper surface of the casing 12H, an elongated plate-shaped support plate 41 as an example of a support member is laterally installed so as to traverse the opening portion 12K in the sub-scanning direction Y. The length in the longitudinal direction of the support plate 41 is made slightly longer than the width in the sub-scanning direction Y of the opening portion 12K. One end portion of the support plate 41 is fixed to the upper surface portion 12U by a fixture (not shown) or an adhesive.

Then, the other end portion of the support plate 41 is fixed to the upper surface portion 12U of the casing 12H by a fixture (not shown) or an adhesive in a state where the support plate 41 is disposed at a position to fix a portion of the ink supply tube 40 in the main scanning direction X. As an example of the fixture, an adhesive tape is used. Of course, the fixture may also be a screw, an adhesive, or the like.

Further, at a position further on the back side than the opening portion 12K in the upper surface portion 12U of the casing 12H, a recess portion 12*b* in which a protruding portion that protrudes at a place on the rear surface side corresponding to the concave groove 13*c* of the image reading section 13 is accommodated and disposed is formed at a position corresponding to the protruding portion. As in this embodiment, in a case of making a configuration to route the ink supply tube 40 on the upper surface portion 12U of the casing 12H, it is desirable to route the ink supply tube 40 to avoid the recess portion 12*b* in which the protruding portion is accommodated.

Further, the spacer 51 as an example of the gap forming member is fixed to the upper surface portion 12U of the casing 12H in a state of protruding upward at a predetermined length. That is, the spacer 51 is provided in order to secure a gap through which the ink supply tube 40 passes, between the image reading section 13 and the print function section 12A by being sandwiched between the print function section 12A and the image reading section 13 in a case where the image reading section 13 is turned in a closing direction to close the opening portion 12K. The spacer 51 of this example is a boss 51A in which a shape as viewed from an axial direction is a substantial U-shape.

Incidentally, a portion which is a midway portion in the longitudinal direction of the ink supply tube 40 passing through the gap formed by the spacer 51 in this manner and is supported on the support plate 41 is fixed to the support plate 41 by fixtures 61 and 62.

Specifically, the ink supply tube 40 first extends from the tank unit 19 in which a plurality of ink tanks 19T is accommodated in a tank case, extends in the main scanning direction X from the slightly back side of the left side surface in FIG. 3 of the apparatus main body 12, and is retained by the spacer 51 having a U-shaped cross section and fixed to the upper surface portion 12U, at a portion disposed at the upper surface portion 12U. In this state, the movement of the ink supply tube 40 in a direction crossing the longitudinal direction is restricted.

Figure 4A:
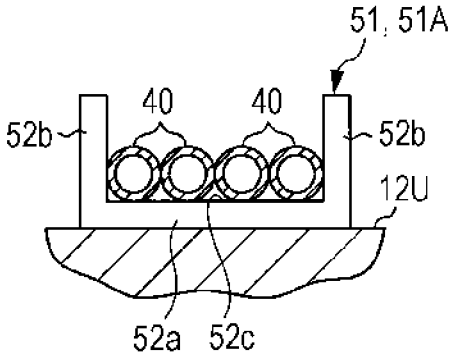
FIGS. 4A and 4B are schematic front views of spacers.

Here, the spacer 51 has a U-shaped cross section and includes a bottom wall portion 52*a* which is fixed to the upper surface portion 12U, and a pair of contact portions 52*b* which is upright in the same direction (upward) from both end portions of the bottom wall portion 52*a*, as shown in FIG. 4A. Then, by the pair of contact portions 52*b*, a recess portion 52*c* is formed between the pair of contact portions 52*b*. The recess portion 52*c* has a width enough for four ink supply tubes 40 to be disposed adjacent to each other in parallel. Further, the height of the contact portion 52*b* is greater than or equal to the outer diameter of the ink supply tube 40 and is set to be a value which allows a required gap to be secured between the apparatus main body 12 and the image reading section 13 when the image reading section 13 is closed at a place on the upper surface portion 12U to which the spacer 51 is fixed, whereby the rear surface of the image reading section 13 touches the spacer 51.

Subsequently, midway portions on the downstream side that is the connection side to the adaptor AD in the ink supply tubes 40 are fixed to the upper surface of the support plate 41 by the first fixture 61 and the second fixture 62.

Further, as shown in FIG. 3, the portions close to the adaptors AD in the ink supply tubes 40 are retained in a state of being bundled by a retaining member 44 fixed to the right side surface in FIG. 3 of the carriage 21, and the end portions further on the downstream side that a position where the ink supply tubes 40 are bundled by the retaining member 44 are respectively connected to the supply tubes (not shown) of the upper surfaces of the adaptors AD.

The movement of the midway portions fixed by the fixtures 61 and 62 in the ink supply tubes 40 in the length direction of the ink supply tube 40 and a direction crossing the length direction is restricted. Therefore, the fixtures 61 and 62 which fix the midway portions of the ink supply tubes 40 function as an example of a fixing section.

Then, in this embodiment, among a plurality of fixtures 61 and 62, the first fixture 61 (for example, an adhesive tape) which fixes the midway portion on the most downstream side of the ink supply tube 40 to the casing 12H becomes a fixing section which fixes a portion in the length direction in the ink supply tube 40 in a state where relative movement with respect to the opening portion 12K is not possible. As a result, the portion between the first fixture 61 and the adaptor AD in the length direction of the ink supply tube 40, more precisely, the portion between the second fixture 62 and the retaining member 44 becomes a deformation and movable portion 40H which is deformed to follow the movement of the carriage 21, as shown in FIG. 3. In other words, a tube length of the deformation and movable portion 40H is defined by a fixing position of the second fixture 62.

Here, the deformation and movable portion 40H will be described briefly. The ink supply tubes 40 shown by a solid line in FIG. 3 are those when the carriage 21 is located at the home position, and curved portions 40C of the ink supply tubes 40 when the carriage 21 is located at the position on the opposite side to the home position are shown by two-dot chain lines in the same drawing. In the example of FIG. 3, a plurality of ink supply tubes 40 is disposed in a planar shape by being arranged substantially in a row in a radial direction such that the respective center lines are located substantially on the same plane. Then, the plurality of ink supply tubes 40 is curved into an arc planar shape on the way and disposed such that the portions (tube planes) on both sides with the curved portions interposed therebetween face each other in a vertical direction and extend substantially in parallel.

When the carriage 21 moves, the curved portions 40C of the ink supply tubes 40 moves by a movement distance (in other words, movement rate) of about half of a movement distance (that is, movement rate) of the carriage 21 in the moving direction of the carriage 21. At this time, in the process in which the carriage 21 moves from the home position to the position on the opposite side to the home position, the ink supply tubes 40 follow the movement of the carriage 21 while moving the curved portions 40C to the left side in FIG. 3. In this manner, the ink supply tubes 40 are deformed while changing the positions of the curved portions 40C in the main scanning direction X in the movement process of the carriage 21. For this reason, in the movement process of the carriage 21, bending or violent action of the ink supply tubes 40 does not occur. Accordingly, also during the movement of the carriage 21, ink can be smoothly supplied to the adaptors AD on the carriage 21 through the ink supply tubes 40. Further, it is easy to avoid a situation where the ink supply tubes 40 act violently, thereby coming into contact with, for example, the paper P, the roller 24 of a transport system, the timing belt 27, or the like, and this causes poor printing.

As shown in FIG. 3, the carriage 21 moves from a position (in FIG. 3, the home position) where the curved portions 40C and the carriage 21 have approached each other the most to a position (the position on the opposite side to the home position) where the curved portions 40C and the carriage 21 have been separated the most from each other. In the process in which the carriage 21 moves over the entire area of the moving area, the portion contributing to the formation of the curved portion 40C in the ink supply tube 40 becomes the deformation and movable portion 40H. Then, the portion further on the upstream side in an ink supply direction than the curved portion 40C at the position of the curved portion 40C (in FIG. 3, the position of the curved portion 40C shown by a two-dot chain line) becomes a non-movable portion which does not contribute to the formation of the curved portion. Here, the boundary portion between the deformation and movable portion 40H and the non-movable portion may be fixed by the fixing section. However, in this embodiment, in order to impart some margin, a portion of the ink supply tube 40 is fixed at a position further on the upstream side by a predetermined distance than the boundary portion. It is preferable that the predetermined distance be set to be a value less than or equal to a longer distance of a distance equivalent to 30% of the tube length of the deformation and movable portion 40H and a distance of 5 cm, as an example. This is for avoiding a situation as much as possible where if the ink supply tube 40 is fixed at a position considerably exceeding a predetermined distance from the boundary portion to the upstream side, a portion which is not fixed, of the portion that does not contribute to the formation of the curved portion, becomes long, and thus form retention of the deformation and movable portion 40H becomes unstable, whereby the tube portion forming the deformation and movable portion 40H acts violently. Of course, a portion in which the ink supply tube 40 is fixed by the second fixture 62 (for example, an adhesive tape) may be the boundary portion and may also be a portion exceeding a predetermined distance from the boundary portion to the upstream side.

Then, in this embodiment, the second fixture 62 fixes a portion slightly further on the upstream side of the ink supply tube 40 than a substantially central portion in the moving area for the carriage 21 in the main scanning direction X. For this reason, the portion on the left side in FIG. 3 of the ink supply tube 40 becomes slightly shorter than the portion on the right side. However, the portions on both sides in a moving range of the carriage 21 centered on the fixing section have substantially the same length. In addition, in this embodiment, the portion between the boundary portion with the non-movable portion in the ink supply tube 40 and the retaining member 44 becomes the deformation and movable portion 40H.

Incidentally, as shown in FIG. 3, in this embodiment, it is preferable that the ink supply tube 40 have a configuration in which a plurality of tubes 40A and 40B is connected through a joint 40J in the length direction thereof. The joint 40J is provided at a plurality of places according to the number of tubes which are connected between the ink tank 19T and the carriage 21 and allows ink to flow between the connected tubes. In the example shown in FIG. 3, the joint 40J connects the two tubes 40A and 40B on the support plate 41 for the ink supply tube 40. Since the respective tubes 40A and 40B connected to both sides of the joint 40J are fixed by the fixtures 61 and 62, it becomes difficult for the tubes 40A and 40B to be disengaged from the joint 40J.

Figure 5A:
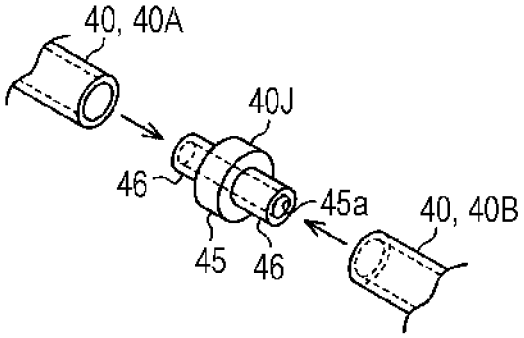
FIGS. 5A and 5B are perspective views showing joints.
Figure 5B:
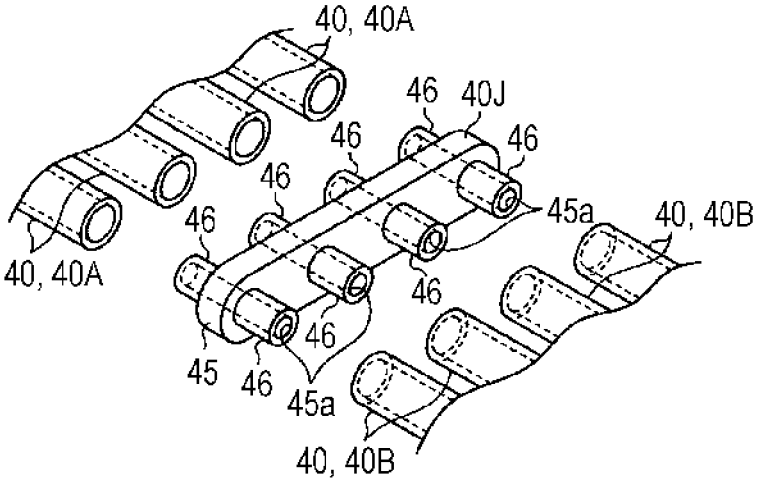

The joint 40*j* which is used in this embodiment has a cylindrical joint main body 45 and a pair of tube portions 46 which protrudes from both end faces in the axial direction of the joint main body 45, as shown in FIG. 5A, and the pair of tube portions 46 communicates with each other in the axial direction. Further, the joint 40J has a rectangular plate-shaped joint main body 45 and four pairs of tube portions 46 which protrude by four from each of both end faces in the axial direction of the joint main body 45, as shown in FIG. 5B, and the paired tube portions of the four pairs of tube portions 46 communicate with each other in the axial direction.

A seam between the tubes 40A and 40B connected through the joint 40J is located at a portion other than the deformation and movable portion 40H of the ink supply tube 40, as shown in FIG. 3. For this reason, since the place connected by the joint 40J of the ink supply tube 40 is not present in the curved portion 40C, it becomes difficult for the tubes to be disengaged from the joint 40J.

Figure 6:
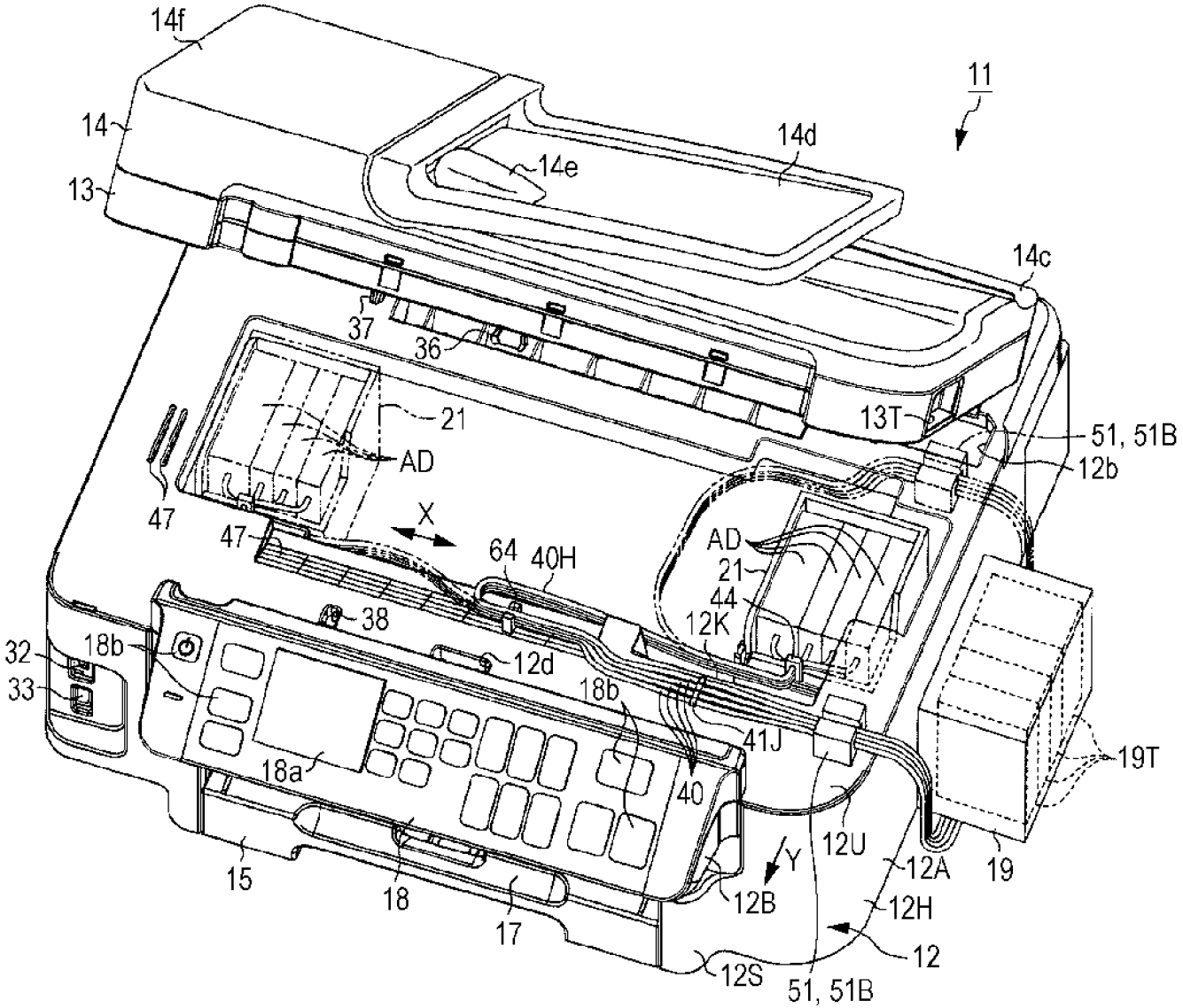
FIG. 6 is a perspective view showing the first printer having another leading-around structure of an ink supply tube in a second embodiment.

Next, as shown in FIG. 6, in this embodiment, the ink supply tube 40 may be routed such that a position where the curved portion 40C of the deformation and movable portion 40H is formed is on the opposite side to that in FIG. 3 with respect to the carriage 21. In addition, in FIG. 6, some constituent members such as the transport mechanism for the paper P and the movement mechanism for the carriage 21 which should be seen from the opening portion 12K are omitted.

Next, the action of the first printer 11 of the first embodiment will be described.

In the first printer 11, in a case of dismounting the ink supply tube 40 from the spacer 51 in order to perform the maintenance of the ink supply tube 40, the following work is performed. That is, in a state where the spacer 51 is mounted on the upper surface portion 12U (the apparatus main body 12), the ink supply tube 40 is taken out of the internal space of the spacer 51 by moving the midway portion in the length direction of the ink supply tube 40 in a direction crossing the length direction. At that time, it is not necessary to dismount an end portion on the side connected to the ink tank 19T in the ink supply tube 40 from the ink tank 19T or dismount an end portion on the side connected to the adaptor AD in the ink supply tube 40 from the adaptor AD in order to dismount the ink supply tube 40 from the spacer 51. Therefore, the ink supply tube 40 is dismounted from the spacer 51 without requiring complicated work.

On the other hand, in a case of mounting the ink supply tube 40 on the spacer 51, the following work is performed. That is, in a state where the spacer 51 is mounted on the apparatus main body 12, the ink supply tube 40 is inserted into the recess portion 52*c* of the spacer 51 by moving the midway portion in the length direction of the ink supply tube 40 in a direction crossing the length direction.

In addition, also in a case of mounting the ink supply tube 40 on the spacer 51 in this manner, it is not necessary to dismount an end portion on the side connected to the ink tank 19T in the ink supply tube 40 from the ink tank 19T or dismount an end portion on the side connected to the adaptor AD in the ink supply tube 40 from the adaptor AD. Therefore, the ink supply tube 40 is mounted on the spacer 51 without requiring complicated work.

Further, the plurality of ink supply tubes 40 is horizontally retained in a parallel state in the recess portion 52*c* of the spacer 51. For this reason, the spacer 51 also has a function as a guide to guide the plurality of ink supply tubes 40 such that the tube planes facing each other on the both sides of the curved portions 40C face each other in the vertical direction. Accordingly, when the deformation and movable portions 40H are deformed to follow the movement of the carriage 21 while changing the positions of the curved portions 40C, an appropriate form can be retained.

According to the first embodiment described above, the following effects can be obtained.

(1) The spacer 51 is provided between the apparatus main body 12 and the image reading section 13, whereby it is possible to easily perform leading-around work by the ink supply tubes 40 in which the ink flow paths are not shut off, in a state where ink can be supplied to the liquid ejecting head 22 side, even without dismounting the end portions of the ink supply tubes 40 from the ink tanks 19T or the adaptors AD.

(2) A state where the movement of the ink supply tubes 40 in a direction crossing the length direction is restricted can be created by passing the ink supply tubes 40 such that the outer surfaces thereof come into contact with the recess portion 52*c* of the spacer 51, even without dismounting the end portions of the ink supply tubes 40 from the ink tanks 19T or the adaptors AD. For this reason, it is possible to easily perform the work of leading around the ink supply tubes 40 while restricting the movement of the ink supply tubes 40 in a direction crossing the length direction thereof.

(3) Since a single ink supply tube 40 is configured by connecting a plurality of tubes through the joint 40J which connects the tubes, by connecting the plurality of tubes by the joint 40J, it is possible to adjust the ink supply tube 40 to an optimal length for leading around. Further, since it is acceptable if a plurality of tubes having a length that is relatively easy to handle is routed, the work of leading around the ink supply tube 40 becomes relatively simple.

(4) The seam between the tubes 40A and 40B connected through the joint 40J is located at a portion other than the deformation and movable portion 40H of the ink supply tube 40. For this reason, since the portion connected by the joint 40J of the ink supply tube 40 is not present in the curved portion 40C, it becomes difficult for the tubes to be disengaged from the joint 40J.

(5) Since the ink supply tube can be provided one piece or in plural pieces, it is possible to supply ink from the respective ink tanks 19T to the liquid ejecting head 22 by the ink supply tubes 40 which are provided in the number corresponding to the number of ink tanks 19T.

(6) Since a plurality of ink tanks 19T is provided and the ink supply tubes 40 which are provided in the number corresponding to the number of ink tanks 19T are routed, it is possible to cope with color printing by supplying ink of plural colors to the liquid ejecting head 22 through the plurality of ink supply tubes 40 and the respective adaptors AD.

(7) Since the plurality of ink supply tubes 40 is provided on the side (the back side) on which the image reading section 13 is pivotally supported with respect to the opening portion 12K, when the image reading section 13 has opened the opening portion 12K of the casing 12H, a field of view in the opening portion 12K is not easily hindered by the ink supply tubes 40. For this reason, it is relatively easy to confirm a state in the apparatus main body 12 through the opening portion 12K. For example, in the case of paper jam error, it is easy to confirm the state of jam of the paper P, and thus it is possible to relatively smoothly perform disposal of paper jam.

(8) Since the ink tank 19T is located outside the apparatus main body 12 (the print function section 12A), a restriction on ink capacity is relaxed. Therefore, the ink tank 19T capable of accommodating a large amount of ink can be provided.

(9) In spite of a configuration in which the paper cassette 15 is accommodated in the accommodation section 12S which is formed by the casing portion formed to protrude at a front surface portion of the casing 12H, such that the accommodation section 12S and the front surface are aligned with each other, and paper feed from the front surface side of the apparatus main body 12 is possible, an increase in the size of the first printer 11 (in particular, an increase in the area of the bottom of the printer) can be suppressed relatively. Further, the base portion 12B of the operation panel section 18 is configured by the casing portion exhibiting an inclined surface in which the lower side protrudes further to the discharge direction side of the paper P (that is, the sub-scanning direction Y side) than the upper side. Then, the display section 18*a* (for example, a liquid crystal display) and the manual operation buttons 18*b* are mounted on the inclined surface of the base portion 12B. For this reason, the visibility of the display section 18*a* becomes good and the operability of the manual operation buttons 18*b* is also secured favorably.

Second Embodiment

Next, a second embodiment relating to the disposition of the ink supply tube 40 will be described with reference to FIGS. 4B and 6. In the second embodiment, the gap forming member between the print function section 12A and the image reading section 13 is the spacer 51 which is fixed to the upper surface portion 12U. The spacer 51 is a tubular body 51B having a substantially cylindrical shape when viewed from the axial direction. In addition, in the description of this embodiment, the same constituent members as those in the first embodiment described above are denoted by the same reference numerals as those in the first embodiment and the description thereof is omitted.

As shown in FIG. 6, the tank unit 19 which accommodates a plurality of ink tanks 19T is located on the home position side with respect to the casing 12H. The ink supply tube 40 with one end portion connected to each ink tank 19T is fixed to the upper surface portion 12U on the opposite side to the support shaft side of the image reading section 13 with respect to the opening portion 12K.

Figure 4B:
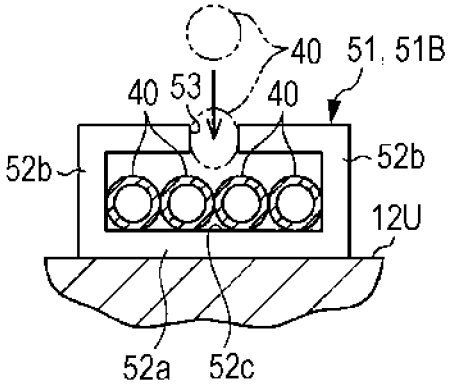

The spacer 51 has a substantially cylindrical shape when viewed from the axial direction and includes the bottom wall portion 52*a* which is fixed to the upper surface portion 12U, and the pair of contact portions 52*b* which is upright in the same direction (upward) from both end portions of the bottom wall portion 52*a*, as shown in FIG. 4B. The pair of contact portions 52*b* horizontally extends in a direction to approach each other from the respective upper end portions, and a slit 53 having a width slightly smaller than the outer diameter of the ink supply tube 40 is formed between the respective extension leading ends. By the pair of contact portions 52*b*, the recess portion 52*c* is formed between the pair of contact portions 52*b*. The recess portion 52*c* has a width enough for four ink supply tubes 40 to be disposed adjacent to each other in parallel. Further, the height of the contact portion 52*b* is greater than or equal to the outer diameter of the ink supply tube 40 and is set to be a value which allows a required gap to be secured between the apparatus main body 12 and the image reading section 13 when the image reading section 13 is closed at a place on the upper surface portion 12U to which the spacer 51 is fixed, whereby the rear surface of the image reading section 13 touches the spacer 51.

Subsequently, the midway portions on the downstream side that is the connection side to the adaptor AD in the ink supply tubes 40 are pinched in a parallel state where a plurality of tubes is arranged in the vertical direction, by a slit member 64 fixed at the substantially central position in the main scanning direction X of the opening portion 12K in the upper surface portion 12U.

Further, as shown in FIG. 6, the portions close to the adaptors AD in the ink supply tubes 40 are retained in a state of being bundled by the retaining member 44 fixed to the front surface in FIG. 6 of the carriage 21, and the end portions further on the downstream side that a position where the ink supply tubes 40 are bundled by the retaining member 44 are respectively connected to the supply tubes (not shown) on the front surfaces of the adaptors AD.

If the carriage 21 moves from the hone position shown by a solid line in FIG. 6 to the position on the opposite side to the home position shown by a two-dot chain line in the same drawing, the portions further on the downstream side than the places supported by the slit member 64 in the ink supply tubes 40 move to follow the movement of the carriage 21. Further, a configuration may also be made such that the ink supply tubes 40 shown by two-dot chain lines, which extend from the back side in FIG. 6 of the tank unit 19, are retained by the spacer 51 (the tubular body 51B) fixed to a right portion on the back side of the upper surface portion 12U and the portions further on the adaptor AD side than the retained places are bundled by the retaining member 44 and connected to the supply tubes (not shown) on the front surfaces of the adaptors AD.

Next, the action of the first printer 11 in the second embodiment will be described.

In the first printer 11, in a case of dismounting the ink supply tube 40 from the spacer 51 in order to perform the maintenance of the ink supply tube 40, the following work is performed. That is, in a state where the spacer 51 is mounted on the upper surface portion 12U, the ink supply tube 40 is taken out of the internal space of the spacer 51 by moving the midway portion in the length direction of the ink supply tube 40 in a direction crossing the length direction to pass through the slit 53 while being accompanied by elastic deformation. At that time, it is not necessary to dismount an end portion on the side connected to the ink tank 19T in the ink supply tube 40 from the ink tank 19T or dismount an end portion on the side connected to the adaptor AD in the ink supply tube 40 from the adaptor AD in order to dismount the ink supply tube 40 from the spacer 51. Therefore, the ink supply tube 40 is dismounted from the spacer 51 without requiring complicated work.

On the other hand, in a case of mounting the ink supply tube 40 on the spacer 51, the following work is performed. That is, in a state where the spacer 51 is mounted on the apparatus main body 12, the ink supply tube 40 is inserted into the internal space of the spacer 51 by moving the midway portion in the length direction of the ink supply tube 40 in a direction crossing the length direction to pass through the slit 53 while being accompanied by elastic deformation (refer to FIG. 4B).

In addition, also in a case of mounting the ink supply tube 40 on the spacer 51 in this manner, it is not necessary to dismount an end portion on the side connected to the ink tank 19T in the ink supply tube 40 from the ink tank 19T or dismount an end portion on the side connected to the adaptor AD in the ink supply tube 40 from the adaptor AD. Therefore, the ink supply tube 40 is mounted on the spacer 51 without requiring complicated work.

According to the second embodiment described above, the following effects can be obtained.

(10) By bringing the ink supply tubes 40 into contact with the inner surface of the recess portion 52*c* by inserting the ink supply tubes 40 into the recess portion 52*c* through an opening (the slit 53) of the recess portion 52*c*, it is possible to restrict the movement of the ink supply tubes 40 without dismounting the end portions of the ink supply tubes 40 from the ink tanks 19T or the adaptors AD.

(11) By moving the ink supply tubes 40 between a state of being inserted into the tubular body 51B and a non-insertion state through the slit 53 formed in a portion of a peripheral wall of the tubular body 51B, which becomes the contact portion 52*b*, it is not necessary to dismount the end portions of the ink supply tubes 40 from the ink tanks 19T or the adaptors AD. Accordingly, it is possible to easily perform the work of leading around the ink supply tubes 40.

Third Embodiment

Next, a third embodiment relating to the disposition of the ink supply tube 40 will be described with reference to FIGS. 7, 8A, and 8B. In the third embodiment, the gap forming member between the print function section 12A and the image reading section 13 is an inclined block 54 that can obliquely retain the plurality of ink supply tubes 40. In addition, in the description of this embodiment, the same constituent members as those in the first embodiment described above are denoted by the same reference numerals as those in the first embodiment and the description thereof is omitted.

Figure 7:
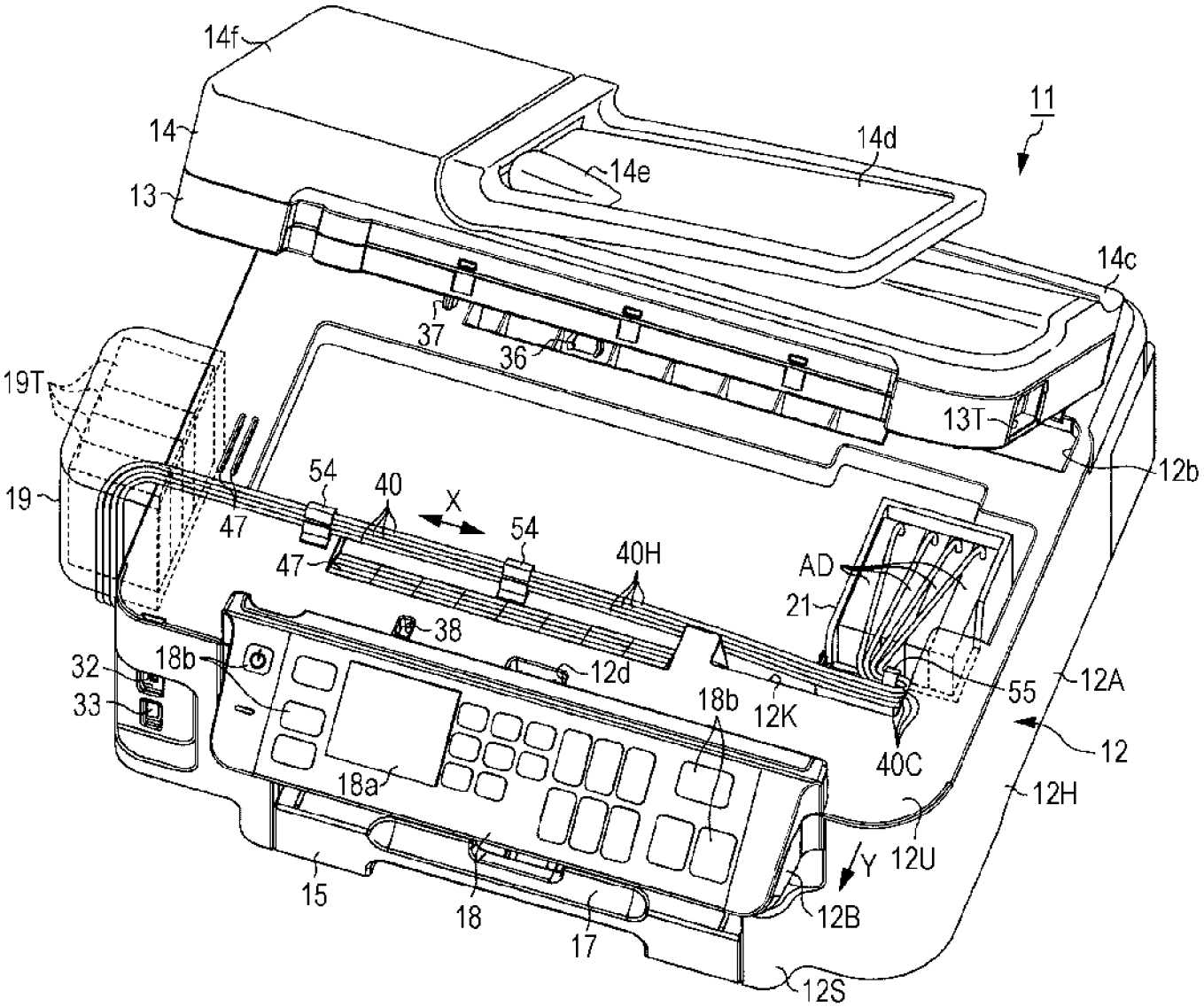
FIG. 7 is a perspective view showing the first printer having a leading-around structure of the ink supply tube in a third embodiment.
Figure 8A:
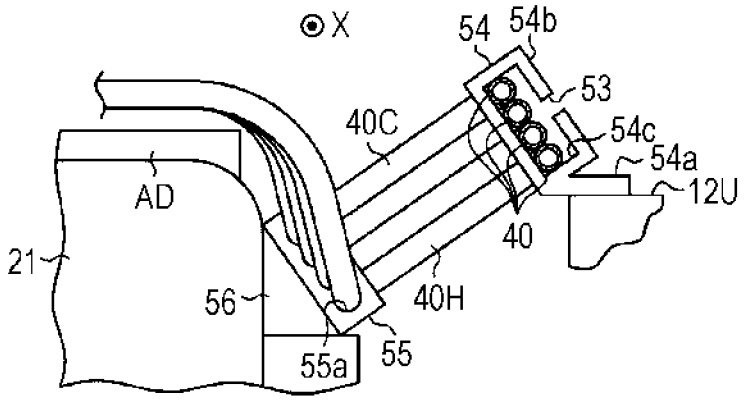
FIGS. 8A and 8B are schematic perspective views showing a leading-around structure of the ink supply tube.
Figure 8B:
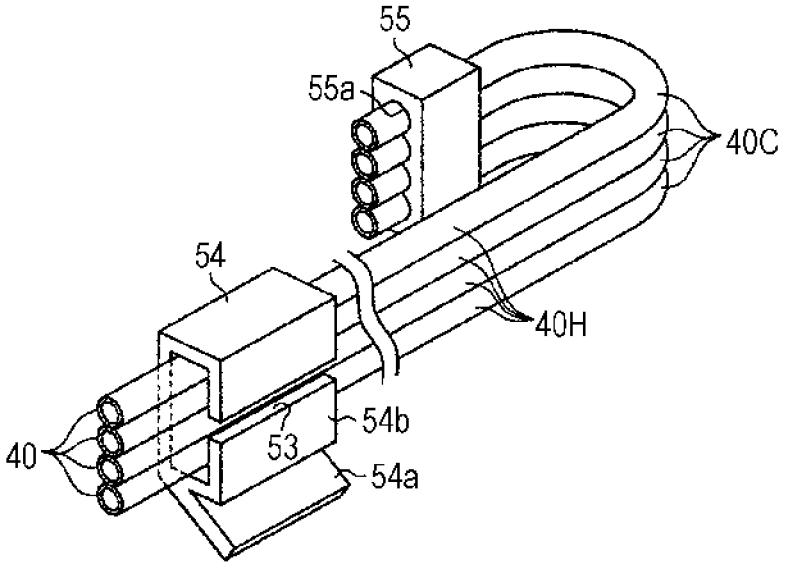

As shown in FIG. 7, the inclined block 54 that is an example of the spacer is fixed to a portion of a peripheral portion on the front side of the opening portion 12K in the upper surface portion 12U of the casing 12H. The inclined block 54 retains the plurality of ink supply tubes 40 with respect to an opening plane of the opening portion 12K in a state where a plane (the tube plane) passing through the respective center lines of the ink supply tubes 40 is inclined at a predetermined angle. A retaining member 55 fixed to the front surface of the carriage 21 in a state of bundling the portions on the adaptor AD side of the ink supply tubes 40 retains the portions of the ink supply tubes which extend along the main scanning direction X from the retaining member 55 to the upstream side, so as to have inclination in the same direction as inclination by the inclined block 54.

A detailed structure will be described using FIGS. 8A and 8B. FIGS. 8A and 8B show a schematic cross section cut at a place of the retaining member 55 fixed to the side surface of the carriage 21 in the main scanning direction X in FIG. 7 and when viewing the curved portion 40C side. As shown in FIGS. 8A and 8B, the inclined block 54 has a support portion 54*a* fixed to the upper surface portion 12U, and a tubular portion 54*b* having a rectangular tubular shape, and extending from the support portion 54*a* in an inclined state, and the slit 53 having a width slightly smaller than the outer diameter of the ink supply tube 40 is formed in the tubular portion 54*b*. A plane (the tube plane) connecting the respective axes of the plurality of ink supply tubes 40 in a recess portion 54*c* of the tubular portion 54*b* is inclined at an angle in a range of about 30 degrees to 60 degrees with respect to the opening plane of the opening portion 12K.

The retaining member 55 fixed to the carriage 21 side is mounted to have an angle of inclination such that the tube plane connecting the respective axes of the plurality of ink supply tubes 40 faces the tube plane on the inclined block 54 side in a parallel fashion. Accordingly, as shown in FIGS. 8A and 8B, the deformation and movable portions 40H are formed between the places retained by the inclined block 54 of the plurality of ink supply tubes 40 and the places retained by the retaining member 55 of the plurality of ink supply tubes 40. Further, the height of the inclined block 54 from the upper surface portion 12U is set to be a value that can form a required gap between the apparatus main body 12 and the image reading section 13.

Next, the action of the first printer 11 in the third embodiment will be described.

In the first printer 11, in a case of dismounting the ink supply tube 40 from the inclined block 54 in order to perform the maintenance of the ink supply tube 40, in a state where the inclined block 54 is mounted on the upper surface portion 12U, the ink supply tube 40 is taken out of the internal space of the inclined block 54 by moving the midway portion in the length direction of the ink supply tube 40 in a direction crossing the length direction to pass through the slit 53 while being accompanied by elastic deformation of the ink supply tube 40. At that time, it is not necessary to dismount an end portion on the side connected to the ink tank 19T in the ink supply tube 40 from the ink tank 19T or dismount an end portion on the side connected to the adaptor AD in the ink supply tube 40 from the adaptor AD in order to dismount the ink supply tube 40 from the inclined block 54. Therefore, the ink supply tube 40 is dismounted from the inclined block 54 without requiring complicated work.

On the other hand, in a case of mounting the ink supply tube 40 on the inclined block 54, in a state where the inclined block 54 is mounted on the apparatus main body 12, the ink supply tube 40 is inserted into the internal space of the inclined block 54 by moving the midway portion in the length direction of the ink supply tube 40 in a direction crossing the length direction to pass through the slit 53 while being accompanied by elastic deformation. In addition, also in a case of mounting the ink supply tube 40 on the inclined block 54, it is not necessary to dismount an end portion on the side connected to the ink tank 19T in the ink supply tube 40 from the ink tank 19T or dismount an end portion on the side connected to the adaptor AD in the ink supply tube 40 from the adaptor AD. Therefore, the ink supply tube 40 is mounted on the inclined block 54 without requiring complicated work.

Therefore, according to the third embodiment, in addition to the same effects (1) to (11) as those in each embodiment described above, the following effect can be obtained.

(12) Since the inclined block 54 also serves as the spacer with the slit 53 and can support the plurality of ink supply tubes 40 with them inclined at a predetermined angle, even if a spacer for leading around the plurality of ink supply tubes 40 is not present in the opening portion 12K, by disposing the portions of the ink supply tubes 40 outside the opening portion 12K, it is possible to route the plurality of ink supply tubes 40 while forming the deformation and movable portions 40H.

Fourth Embodiment

Figure 9A:
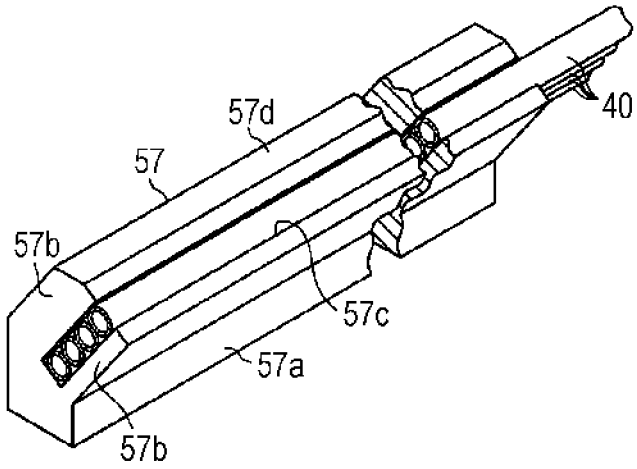
FIGS. 9A and 9B are schematic perspective views showing a leading-around structure of the ink supply tube in a fourth embodiment.
Figure 9B:
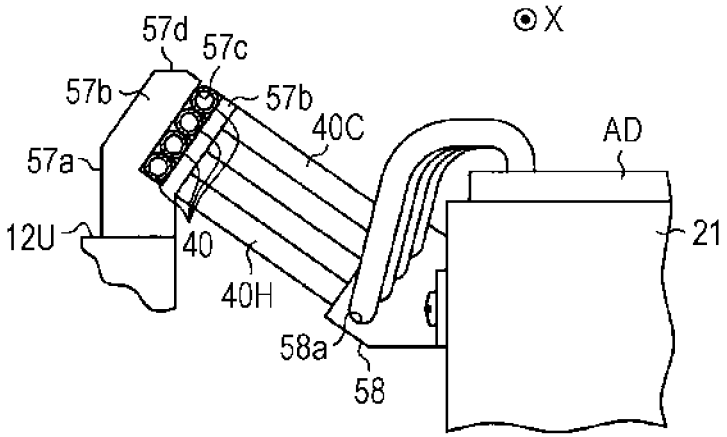

Next, a fourth embodiment relating to the disposition of the ink supply tube 40 will be described with reference to FIGS. 9A, 9B, and 10. In the fourth embodiment, the gap forming member between the print function section 12A and the image reading section 13 is a long inclined block 57 that can obliquely retain the plurality of ink supply tubes 40. In addition, in the description of this embodiment, the same constituent members as those in the first embodiment described above are denoted by the same reference numerals as those in the first embodiment and the description thereof is omitted.

Figure 10:
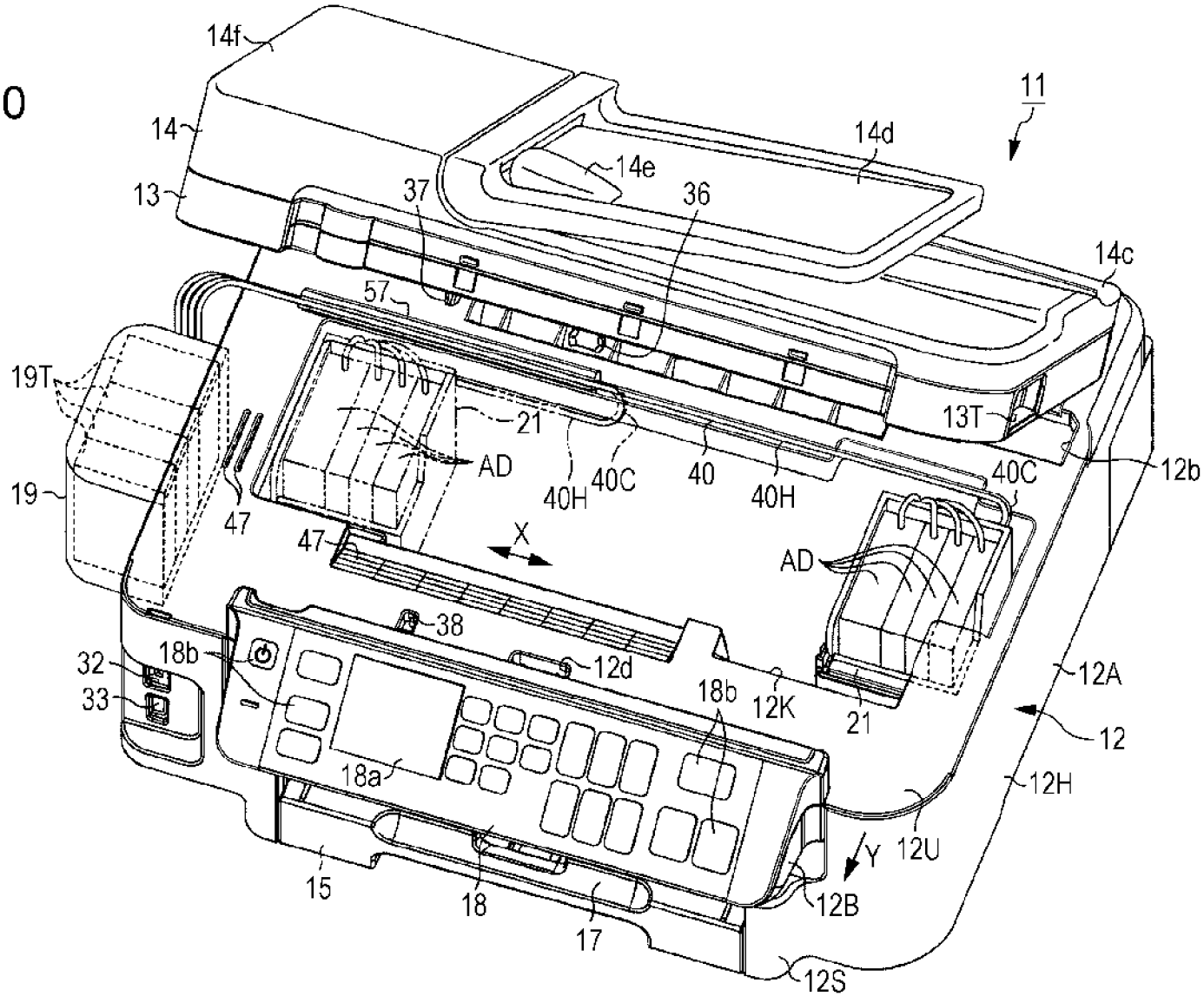
FIG. 10 is a perspective view showing the first printer having a leading-around structure of the ink supply tube.

As shown in FIG. 10, the inclined block 57 that is an example of the spacer has a long shape and is fixed to a portion of the peripheral portion on the back side of the opening portion 12K in the upper surface portion 12U of the casing 12H. The inclined block 57 retains the plurality of ink supply tubes 40 with respect to the opening plane of the opening portion 12K in a state where the plane (the tube plane) passing through the respective center lines of the ink supply tubes 40 is inclined at a predetermined angle. A retaining member 58 fixed to the front surface of the carriage 21 in a state of bundling the portions on the adaptor AD side of the ink supply tubes retains the portions of the ink supply tubes which extend along the main scanning direction X from the retaining member 58 to the upstream side, so as to have inclination in the same direction as inclination by the inclined block 57.

A detailed structure will be described using FIGS. 9A and 9B. FIGS. 9A and 9B show a schematic cross section when the curved portion 40C side is viewed from the vicinity of the left end face in FIG. 10 of the inclined block 57 when the carriage 21 is at a position shown by a two-dot chain line in the main scanning direction X in FIG. 10. As shown in FIGS. 9A and 9B, the inclined block 57 has a leg portion 57*a* fixed to the upper surface portion 12U, and a pinch portion 57*b* which extends from the leg portion 57*a* in an inclined state, and a slit 57*c* having almost the same width as the outer diameter of the ink supply tube 40 is formed in the pinch portion 57*b*. A depth direction of the slit 57*c* is inclined at an angle in a range of about 30 degrees to 60 degrees with respect to the opening plane of the opening portion 12K. For this reason, the plurality of ink supply tubes 40 is retained in a state where the plane connecting the respective axes is inclined.

The retaining member 58 fixed to the carriage 21 side is mounted to have an angle of inclination such that the tube plane connecting the respective axes of the plurality of ink supply tubes 40 faces the tube plane on the inclined block 57 side in a parallel fashion. Accordingly, as shown in FIGS. 9A and 9B, the deformation and movable portions 40H are formed between the places retained by the inclined block 57 of the plurality of ink supply tubes 40 and the places retained by the retaining member 58 of the plurality of ink supply tubes 40. For this reason, in the plurality of ink supply tubes 40, the deformation and movable portions 40H are formed in a state where the tube planes on both sides with the curved portions 40C interposed therebetween face each other in a substantially parallel fashion in a state of being obliquely inclined. Further, the height of the inclined block 57 from the upper surface portion 12U to an upper wall surface 57*d* is set to be a value that can form a required gap between the apparatus main body 12 and the image reading section 13. For this reason, when the image reading section 13 is closed, a required gap is secured.

For this reason, even in a configuration in which a space for leading around the ink supply tubes 40 cannot be secured in the opening portion 12K of the casing 12H, it is possible to form the deformation and movable portions 40H so as to form the tube planes that face each other in a substantially parallel fashion in a position inclined with respect to the opening plane of the opening portion 12K.

According to the fourth embodiment described above, the effects (1) to (12) in each embodiment described above can be likewise obtained.

Fifth Embodiment

Next, a fifth embodiment relating to the disposition of the ink supply tube 40 will be described with reference to FIGS. 11 to 13. In the fifth embodiment, the gap forming member between the print function section 12A and the image reading section 13 is a fixing screw provided in the upper surface portion. In addition, in the description of this embodiment, the same constituent members as those in the first embodiment described above are denoted by the same reference numerals as those in the first embodiment and the description thereof is omitted.

Figure 11:
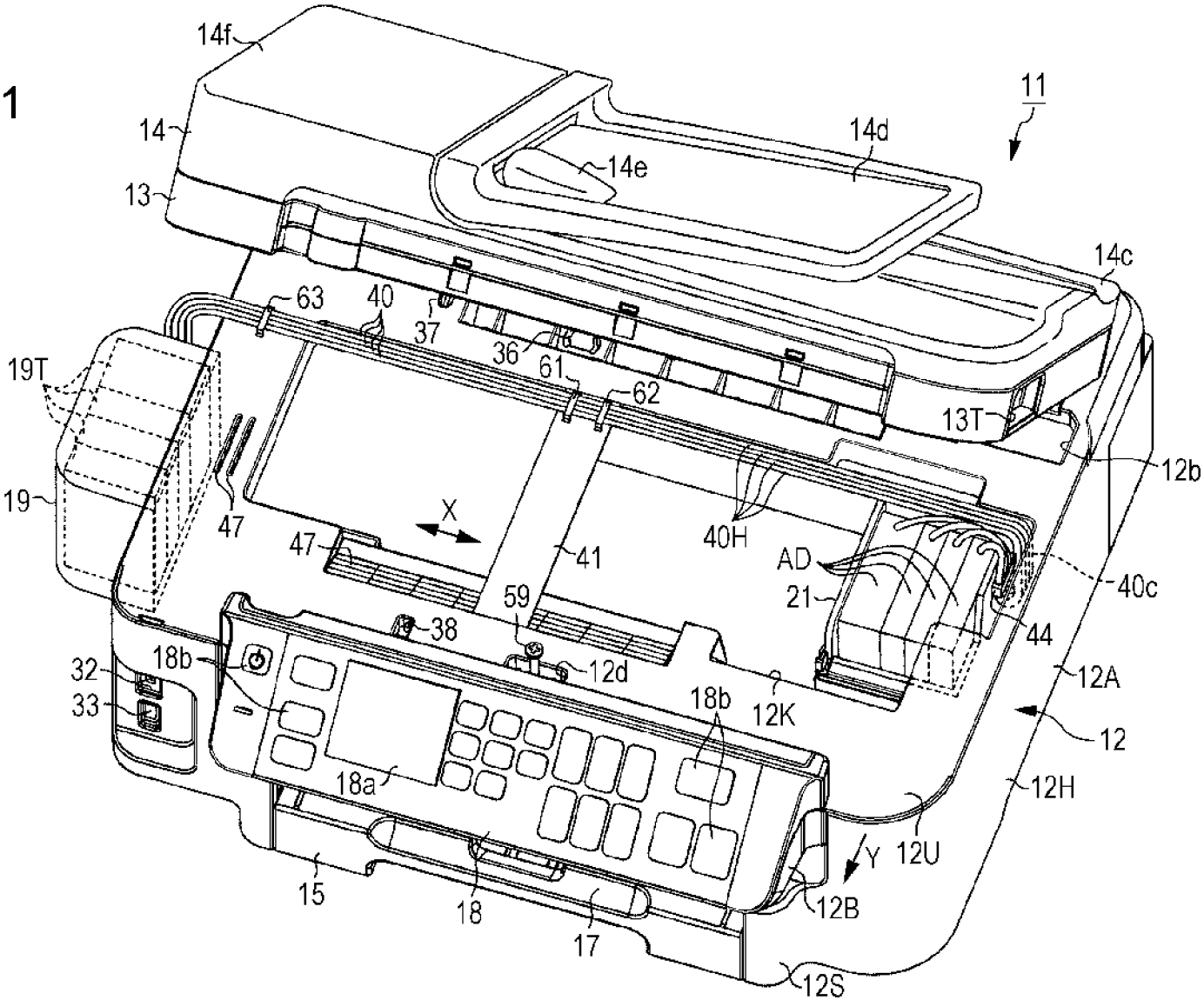
FIG. 11 is a perspective view showing the first printer having a leading-around structure of the ink supply tube in a fifth embodiment.

As shown in FIG. 11, the support plate 41 that is the same as that in the first embodiment is installed so as to traverse the opening portion 12K and the plurality of ink supply tubes 40 is fixed by a fixture 63 (for example, an adhesive tape) instead of the spacer 51 in the first embodiment.

Figure 12:
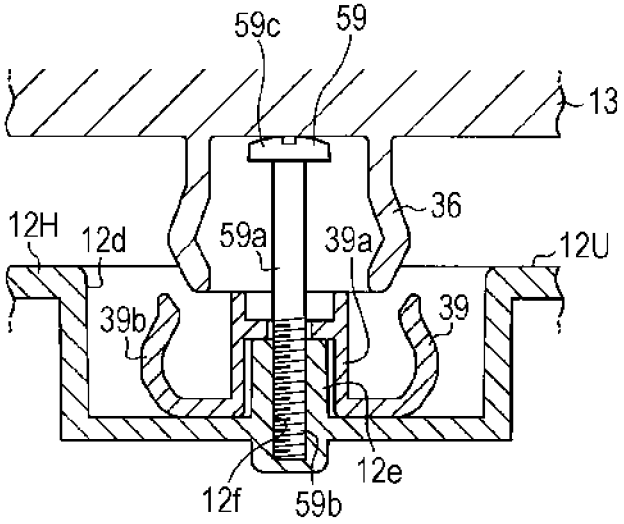
FIG. 12 is a cross-sectional front view showing a fixing screw in a locking section.

As shown in FIG. 12, a tubular portion 12*e* having a threaded hole 12*f* is formed on the bottom surface of the locking recess portion 12*d* formed in the upper surface portion 12U of the casing 12H. A locking member 39 has a tubular portion 39*a* and a locking portion 39*b* extending outwardly upward from a lower end portion of the tubular portion 39*a*. The tubular portion 39*a* of the locking member 39 is assembled to the tubular portion 12*e* in a state of being externally fitted thereto, and in this state, a screw is screwed into the threaded hole 12*f*, whereby the locking member 39 is fixed to a bottom surface portion of the locking recess portion 12*d*. In this example, the threaded hole 12*f* is used, a fixing screw 59 having a long shaft portion 59*a* is used, and the fixing screw 59 is screwed in a state of protruding by a predetermined length required for gap formation from the upper surface of the casing 12H. A head portion of the fixing screw 59 comes into contact with the rear surface of the image reading section 13, whereby a gap for passing the ink supply tubes 40 is formed between the apparatus main body 12 and the image reading section 13. In addition, at this time, a configuration is also acceptable in which a head portion 59*c* of the fixing screw 59 comes into contact with the locking projection 36.

Next, the action of the first printer 11 in the fifth embodiment will be described.

Figure 13:
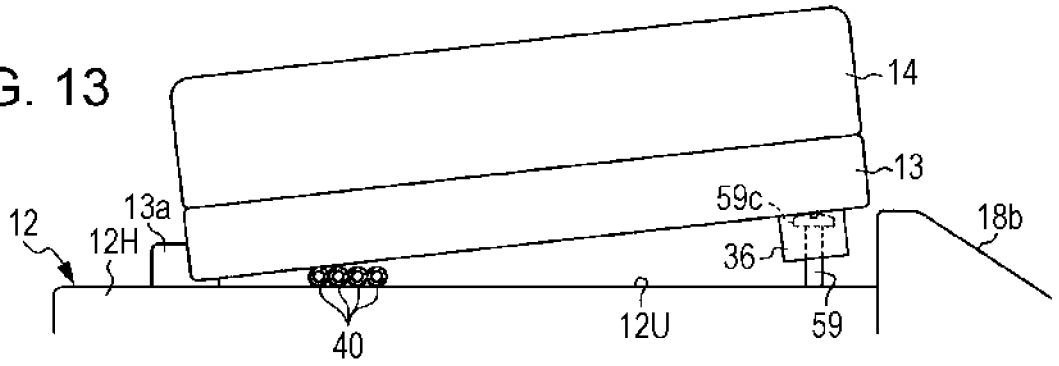
FIG. 13 is a partial side view showing the first printer.

As shown in FIG. 13, in a state where the image reading section 13 is closed, the rear surface of the image reading section 13 comes into contact with the head portion 59*c* of the fixing screw 59, whereby a gap greater than or equal to the extent not to crush the ink supply tube 40 is formed in a passage for the plurality of ink supply tubes 40.

In the first printer 11, in a case of dismounting the ink supply tube 40 from the print function section 12A in order to perform the maintenance of the ink supply tube 40, a user lifts the image reading section 13, whereby it is possible to easily dismount the ink supply tube 40 from the print function section 12A. That is, since the image reading section 13 is in a contact state with respect to the head portion of the fixing screw 59 by the force of gravity, the gap between the image reading section 13 and the print function section 12A, through which the ink supply tubes 40 passes, can be widened according to the amount of lifting of the image reading section 13.

According to the fifth embodiment described above, in addition to the effects (1), (3), (4), and (5) to (9) in each embodiment described above, the following effect can be obtained.

(13) Since a portion that is not screwed into a casing portion of the print function section 12A in the shaft portion 56 of the fixing screw 59 protrudes from the upper surface portion 12U, it is possible to easily form the gap between the apparatus main body 12 and the image reading section 13.

Sixth Embodiment

Next, a sixth embodiment relating to the disposition of the ink supply tube 40 will be described with reference to FIGS. 14 and 15. In the sixth embodiment, the gap forming member between the print function section 12A and the image reading section 13 is fixed to the image reading section 13 side. In addition, in the description of this embodiment, the same constituent members as those in the first embodiment described above are denoted by the same reference numerals as those in the first embodiment and the description thereof is omitted.

Figure 15:
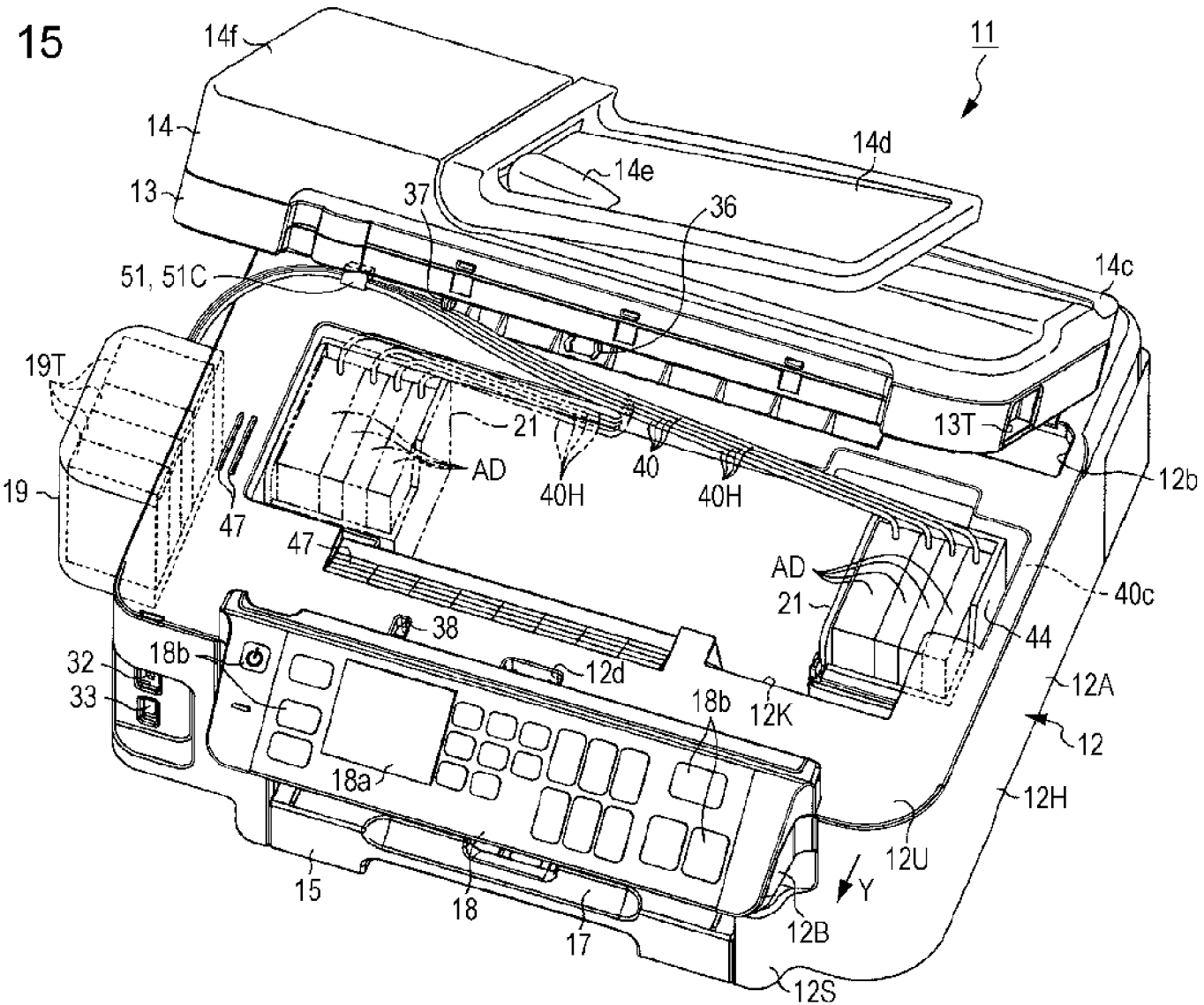
FIG. 15 is a perspective view showing the first printer having a leading-around structure of the ink supply tube.

As shown in FIG. 15, on the lower surface of the image reading section 13, the spacer 51 is provided at a position corresponding to the upper surface portion 12U of the apparatus main body 12 in the fore side (the front side) in the sub-scanning direction Y on the opposite side to the hinge 13*a* side. In this embodiment, the spacer 51 is mounted on the image reading section 13 by fixation by adhesion of a screw in the left side when viewed from the fore side in the sub-scanning direction Y. Of course, the spacer 51 may also be mounted on the right side when viewed from the fore side in the sub-scanning direction Y in the image reading section 13.

Figure 14:
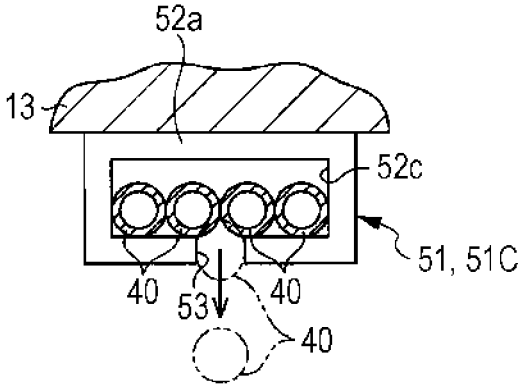
FIG. 14 is a schematic front view showing a spacer in a sixth embodiment.

As shown in FIG. 14, the spacer 51 is a tubular body 51C that is the same as the tubular body 51B in the second embodiment. The slit 53 thereof is provided so as to face the apparatus main body 12 side that is the gravity direction side. Therefore, the ink supply tube 40 is in a state of being inserted into the internal space of the spacer 51 by being pushed into the slit 53 from the lower side. In addition, the width dimension of the slit 53 of the spacer 51 is set to a dimension in which the ink supply tube 40 can be elastically deformed and then pass through the slit 53 by its own weight, as shown by a two-dot chain line in FIG. 14, while the image reading section 13 moves (swings) to a position to expose the opening portion 12K of the print function section 12A.

Next, the action of the first printer 11 in the sixth embodiment will be described.

In the sixth embodiment, in a case of dismounting the ink supply tube 40 from the image reading section 13 in order to perform the maintenance of the ink supply tube 40, the image reading section 13 is lifted first. Then, the ink supply tube 40 inserted into the internal space of the spacer 51 rises along with the image reading section 13 lifted, whereby the tube's own weight which is generated with the rise acts in a downward direction crossing the length direction of the tube. As a result, the ink supply tube 40 is taken out of the internal space of the spacer 51 through the slit 53, thereby being dismounted from the image reading section 13, as shown in FIG. 14.

Further, although illustration and description are omitted here, in this embodiment, a configuration is also acceptable in which in a case where the image reading section 13 is displaced in a direction to open the opening portion 12K of the print function section 12A, the ink supply tube 40 is disengaged from the image reading section 13 along with the spacer 51.

According to the sixth embodiment described above, in addition to the effects (1) to (4) in the first embodiment described above, the following effect can be obtained.

(14) It is possible to dismount the ink supply tube 40 from the spacer 51 which is displaced together with the image reading section 13 according to the displacement of the image reading section 13 in a direction to open the opening portion 12K, without dismounting an end portion of the ink supply tube 40.

Seventh Embodiment

Next, the configuration of a second printer 11A having no image reading function will be described with reference to FIGS. 16 to 18. The first printer 11 in the first to sixth embodiments described above is a so-called multifunction machine. However, the second printer 11A in the seventh embodiment is provided with the print function section (the printer unit), but has no image reading section (the scanner unit). In addition, in the description of FIGS. 16 to 18, the same constituent members as those in FIGS. 1 to 3 are denoted by the same reference numerals as those in FIGS. 1 to 3 and the description thereof is omitted. A configuration relating to the fixing section that fixes the ink supply tubes 40 is equivalent to that of the first embodiment applied to the single-function second printer 11A having only a print function.

Figure 16:
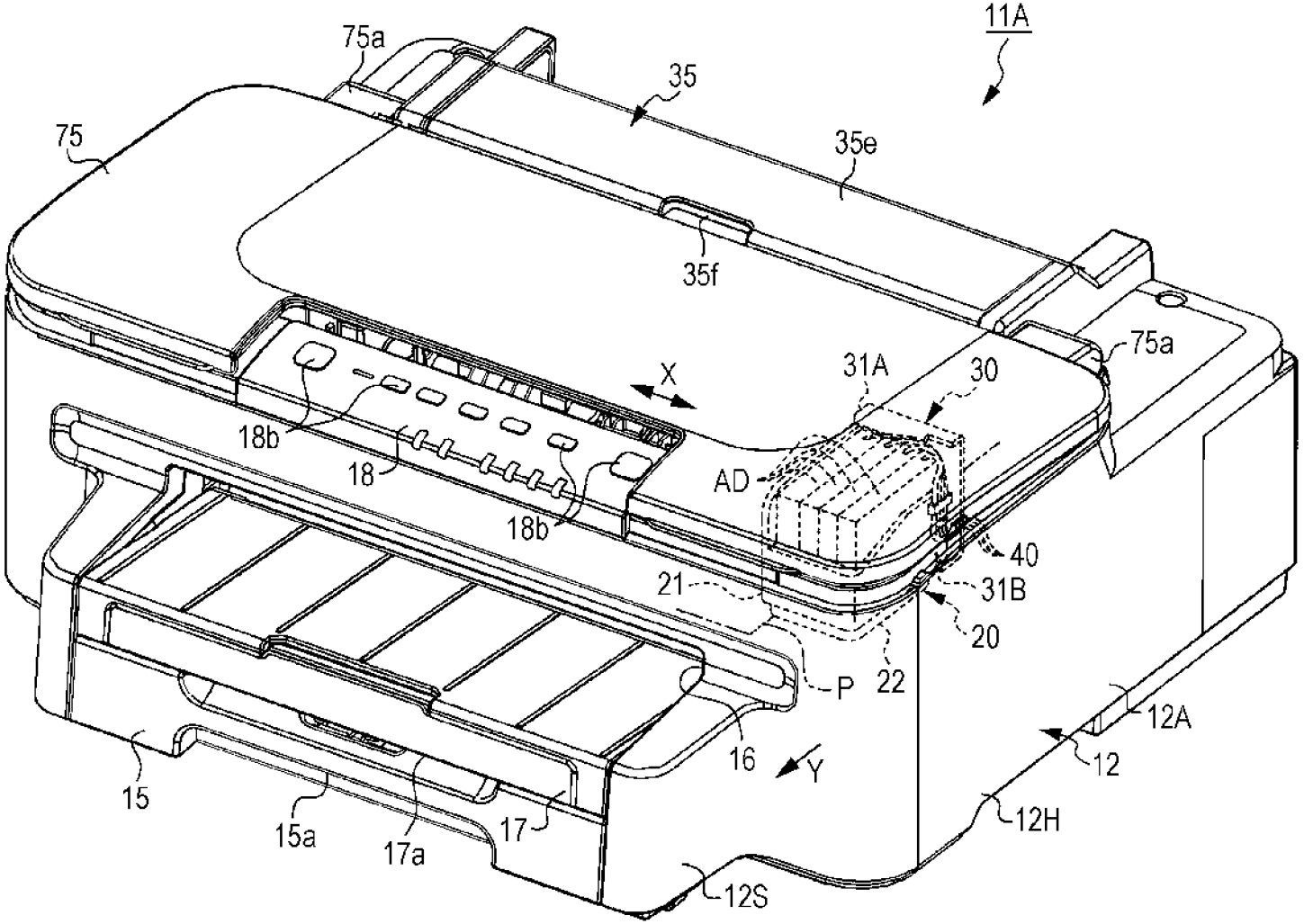
FIG. 16 is a perspective view showing a second printer in a seventh embodiment.

As shown in FIG. 16, the second printer 11A of this embodiment is provided with the print function section 12A that includes the apparatus main body 12 having a print function. The second printer 11A receives supply of ink from the ink tank 19T (refer to FIG. 18) as an example of the liquid accommodation section having a substantially rectangular parallelepiped shape, which is a separate body from the apparatus main body 12. Then, in the second printer 11A, ink accommodated in the ink tank 19T is supplied from a side of the ink tank 19T which is located outside the apparatus main body 12 through the ink supply tube 40 (refer to FIG. 18) to the apparatus main body 12 side.

The apparatus main body 12 of the second printer 11A has the casing 12H having the printing section 20 built-in. A cover section 75 as an example of the cover member has a configuration in which the cover section 75 is turned (displaced) around a hinge 75*a* provided at one side end (the rear side) of the apparatus main body 12, whereby the front end portion side (in FIG. 18, the near-side end portion side) on the opposite side to the hinge 75*a* is lifted. It is possible for a user of the second printer 11A to lift the cover section 75 at the time of maintenance, for example. Due to the lifting, the opening portion 12K (refer to FIG. 18) is exposed which is provided on the upper side of the printing section 20 and exposes at least a portion of the moving area for the carriage 21 disposed so as to be able to reciprocate in the print function section 12A.

Figure 17:
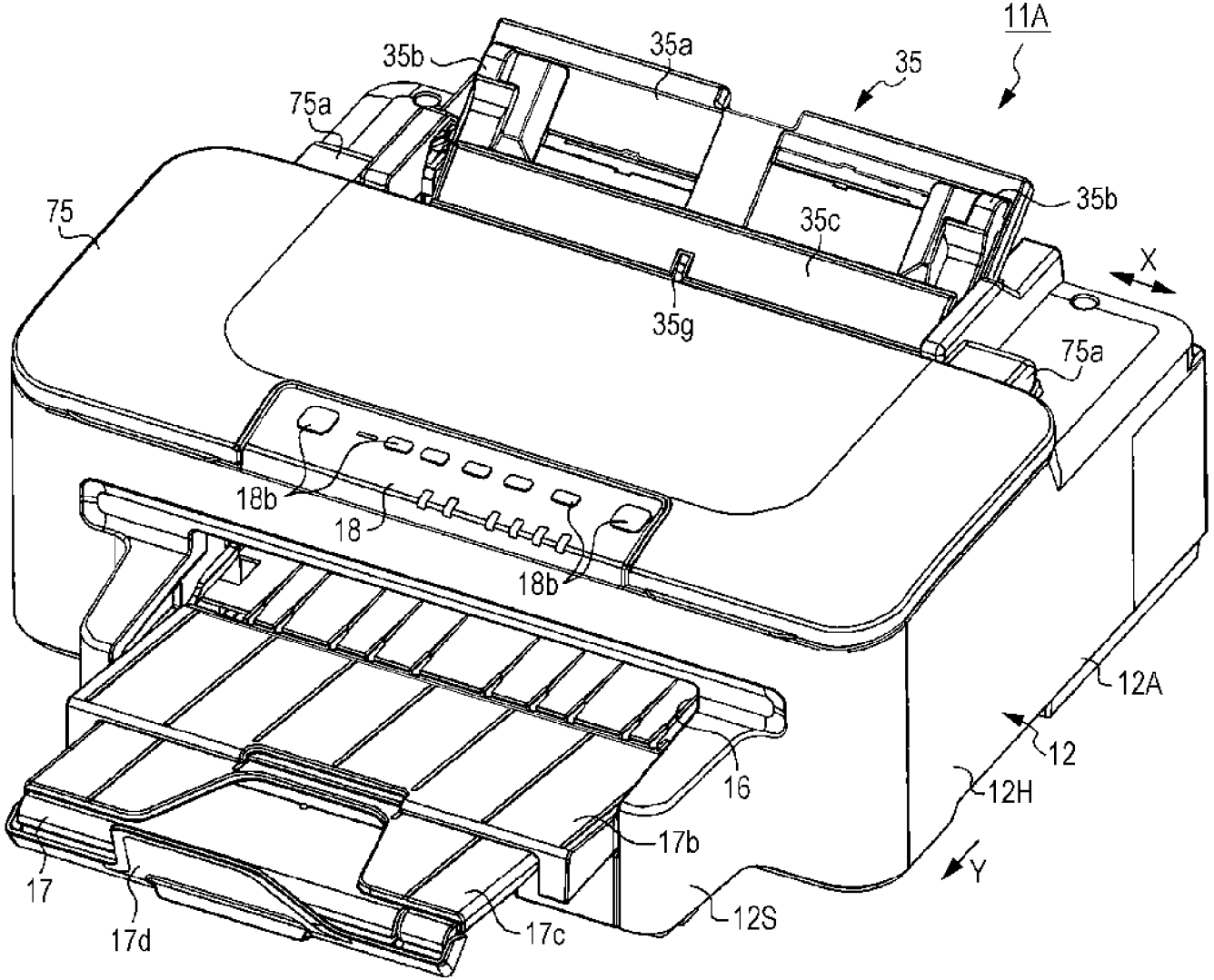
FIG. 17 is a perspective view showing the second printer in a state where a stacker and a manual paper feed mechanism are opened.

In addition, as shown in FIGS. 16 and 17, the manual paper feed mechanism 35 is mounted on the back side of the cover section 75 in the apparatus main body 12. The manual paper feed mechanism 35 is of an opening and closing type in which a cover 35*e* which doubles as the paper feed tray 35*a* (refer to FIG. 17) can be turned around a rear end portion, and at the time of non-use, the cover 35*e* is retained in a closed state, as shown in FIG. 16. A concave gripping portion 35*f* is formed in a front end portion of the cover 35*e* in the closed state, and a user grips the gripping portion 35*f* and turns backward the cover 35*e*, whereby an opened state at the time of use is created in which the paper feed tray 35*a* takes an obliquely standing posture (refer to FIG. 17). The configuration in the opened state of the manual paper feed mechanism 35 will be described later.

Further, the paper cassette 15 which can accommodate plural sheets of paper P in a stacked manner is detachably provided at a lower portion of the apparatus main body 12. The sheets of paper P accommodated in the paper cassette 15 are fed one by one toward the front from the back to the printing section 20 provided in the print function section 12A, and printing is performed on the fed paper P by the printing section 20. The configuration of the printing section 20 is basically the same as that of the first printer 11 in the first embodiment. Then, the printed paper P in which printing by the printing section 20 is finished is discharged (output) from the paper discharge port 16 provided in the front surface of the apparatus main body 12 (the print function section 12A).

The stacker 17 as an example of the discharge tray is accommodated at a position which is on the upper side of the paper cassette 15 and the lower side of the paper discharge port 16 in the apparatus main body 12 (the print function section 12A). The stacker 17 is used to be drawn out in the discharge direction (the transport direction) of the paper P by a length corresponding to the size of the paper P from the apparatus main body 12.

As shown in FIG. 16, the accommodation section 12S having an accommodating recess portion in which the paper cassette 15 and the stacker 17 are accommodated, at a central portion in the width direction, is configured by a casing portion formed to protrude in the discharge direction of the paper P (here, the sub-scanning direction Y). The reason of making the accommodation section 12S protrude in this manner is because the required length in the sub-scanning direction Y of the paper cassette 15 is longer than the length in the sub-scanning direction of the casing 12H required for the printing section 20. For this reason, the paper cassette 15 and the stacker 17 are accommodated in the accommodation section 12S such that the front end faces are aligned with each other, in a state of protruding in the sub-scanning direction Y (forward) from the apparatus main body 12. For details, if the length in the sub-scanning direction Y of the apparatus main body 12 is determined in accordance with the length in the sub-scanning direction Y of the paper cassette 15 required to accommodate the paper P having a predetermined size (as an example, an A4 size), since the apparatus main body 12 increases in size (the area of the bottom increases), in order to avoid this even a little, only an accommodation portion for the paper cassette 15 is made to protrude. In other words, an increase in the area of the bottom of the second printer 11A can be suppressed by providing a shape in which the outer sides in the width direction of the accommodation section 12S are gouged. Further, since the front surface position of the stacker 17 at the time of accommodation is determined in accordance with the protruding front surface position of the paper cassette 15, a protruding length of the stacker 17 at the time of drawing-out is secured relatively long. In addition, due to the protrusion, the stacker 17 can be easily drawn out from the apparatus main body 12 by using the gripping portion 17*a*. In this manner, in spite of a configuration in which the paper cassette 15 is detachably provided on the front surface of the apparatus main body 12, thereby enabling paper feed from the front surface side of the apparatus main body 12, an increase in the size of the second printer 11A (in particular, an increase in the area of the bottom of the printer) is suppressed relatively.

On the other hand, as shown in FIG. 16, the operation panel section 18 for performing various operations such as making the printing section 20 carrying out a printing operation is disposed at an upper portion of the apparatus main body 12 (the print function section 12A). The operation panel section 18 is configured by a casing portion exhibiting an inclined surface in which the lower side thereof protrudes further to the discharge direction side of the paper P (that is, the sub-scanning direction Y side) than the upper side. Then, the manual operation buttons 18*b* are provided on the inclined surface of the operation panel section 18. As the manual operation buttons 18*b*, for example, there are a power button, a print start button, and the like. The operation surface of the operation panel section 18 is made of an inclined surface descending forward, whereby the operability of the manual operation buttons 18*b* for a user is secured favorably.

Further, as shown in FIG. 17, the manual paper feed mechanism 35 is mounted on the back side of the apparatus main body 12 (the print function section 12A). The manual paper feed mechanism 35 is a mechanism for feeding a single sheet of paper P manually set by a user. The manual paper feed mechanism 35 has the substantially rectangular plate-shaped paper feed tray 35*a*, the pair of paper guides 35*b* for positioning the paper P in the width direction on the paper feed tray 35*a*, and the protective plate 35*c* provided in order to prevent falling of foreign matter or the like into a feed port (not shown) in an opened state of the manual paper feed mechanism 35. The paper feed tray 35*a* is provided so as to be able to be turned around a base end portion (in FIG. 17, a lower end portion) thereof in a predetermined angle range, and disposed in an opened state shown in FIG. 17 where the paper feed tray 35*a* takes an inclined position in which the paper P can be set, and a closed state where the paper feed tray 35*a* is turned from the opened state to the front side of FIG. 17 and then accommodated in the apparatus main body 12. The protective plate 35*c* is biased in a direction to approach the paper feed tray 35*a* side by the elastic force of a torsion coil spring (not shown), and if the paper feed tray 35*a* is opened, the protective plate 35*c* is disposed at a protective position shown in FIG. 17 where the protective plate 35*c* prevents foreign matter fallen to the opened place from entering the feed port.

Further, as shown in FIG. 17, the stacker 17 is of a three-stage type as an example and includes the first tray 17*b*, the second tray 17*c*, and the third tray 17*d*. The first tray 17*b* is connected so as to be able to slide with respect to the apparatus main body 12, and the second tray 17*c* is connected so as to be able to slide with respect to the first tray 17*b*. Then, the third tray 17*d* is connected to a leading end portion of the second tray 17*c* so as to be able to be turned, and disposed at a closed position where the third tray 17*d* is accommodated in a state of overlapping the second tray 17*c* and an opened position where the third tray 17*d* stands in a posture rising forward at a predetermined angle, thereby also functioning as a paper stopper, as shown in FIG. 17.

Figure 18:
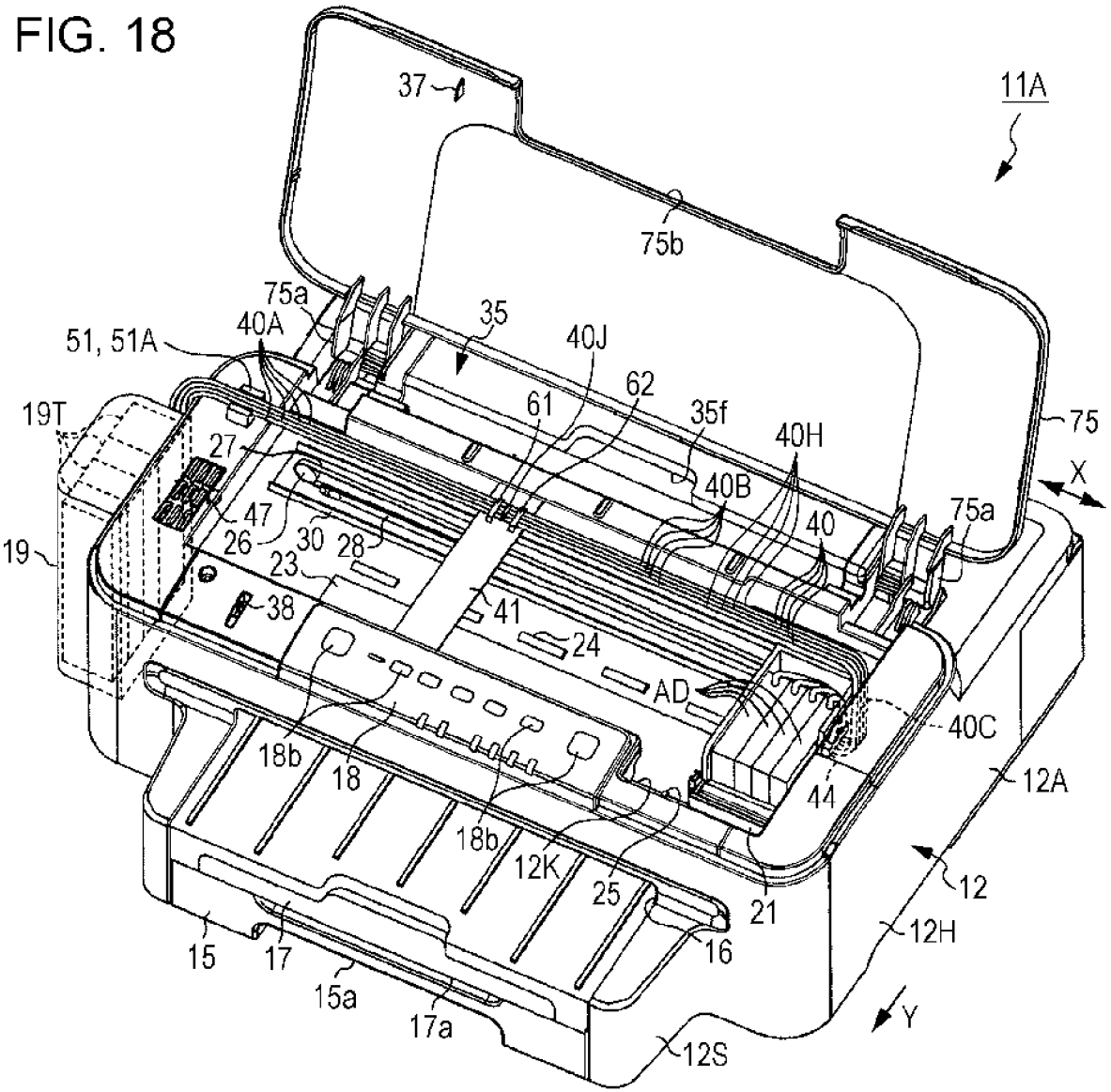
FIG. 18 is a perspective view showing the second printer having a leading-around structure of an ink supply tube.

As shown in FIG. 18, on the rear surface of the cover section 75, a projection 37 to be detected is formed to protrude at a position close to the left side in the width direction of the turning leading end side of the cover section 75. The projection 37 is inserted into a recess portion 38 for detection recessed in the upper surface of the apparatus main body 12 when the cover section 75 is closed. In the apparatus main body 12, a sensor (not shown) which detects the projection 37 inserted into the recess portion 38 is provided at a position corresponding to the recess portion 38. A controller in the second printer 11A is made such that when the sensor detects the closed state of the cover section 75, instructed printing is performed and when the sensor does not detect the closed state of the cover section 75, even if printing is instructed, the printing is not started.

Then, as shown in FIG. 18, the plurality of ink supply tubes 40 extending from the ink tanks 19T is retained in a state of being inserted into the recess portion 52*c* of the spacer 51 by the same tube leading-around structure as that in the first embodiment. The plurality of ink supply tubes 40 is fixed by the fixtures 61 and 62 at portions supported on the support plate 41 and connected through the joint 40J between the fixtures 61 and 62. Then, the deformation and movable portions 40H are formed further on the downstream side than a fixing place of the fixture 62 in the plurality of ink supply tubes 40.

Therefore, according to the second printer 11A, the same effects (1) to (9) as those in the first embodiment described above can be obtained.

In addition, each embodiment in the first printer 11 and the second printer 11A described above may also be changed to other embodiments as described below.

Figure 19A:
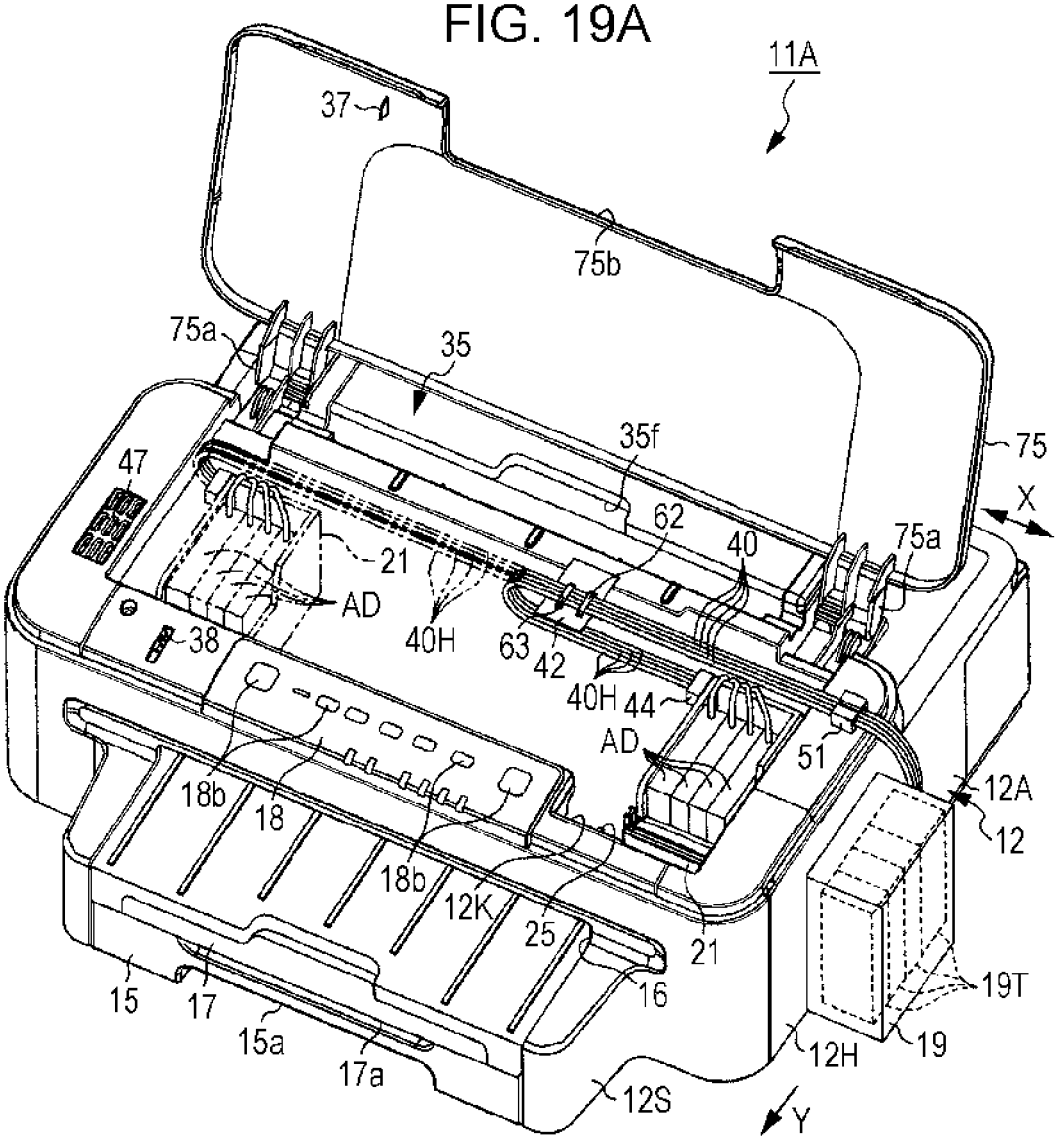
FIG. 19A is a perspective view showing the second printer having a leading-around structure of the ink supply tube in another embodiment.
Figure 19B:
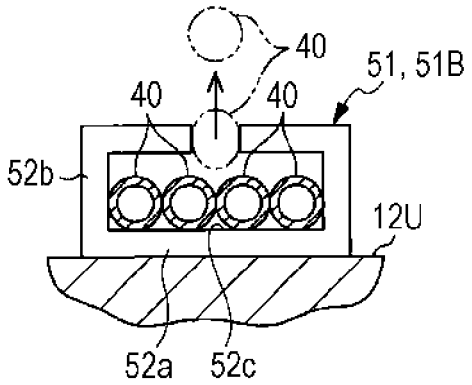
FIG. 19B is a front view of a spacer.

As shown in FIGS. 19A and 19B, in the second printer 11A, the spacer 51 in the second embodiment may also be used. In the example shown in FIGS. 19A and 19B, a support plate 42 has a configuration of a cantilever type and the portions supported on the support plate 42 of the plurality of ink supply tubes 40 are fixed by the fixtures 61 and 62. In addition, in FIGS. 19A and 19B, the joint 40J between the fixtures 61 and 62 is omitted. According to this configuration, the same effects as those in the second embodiment are obtained.

Figure 20A:
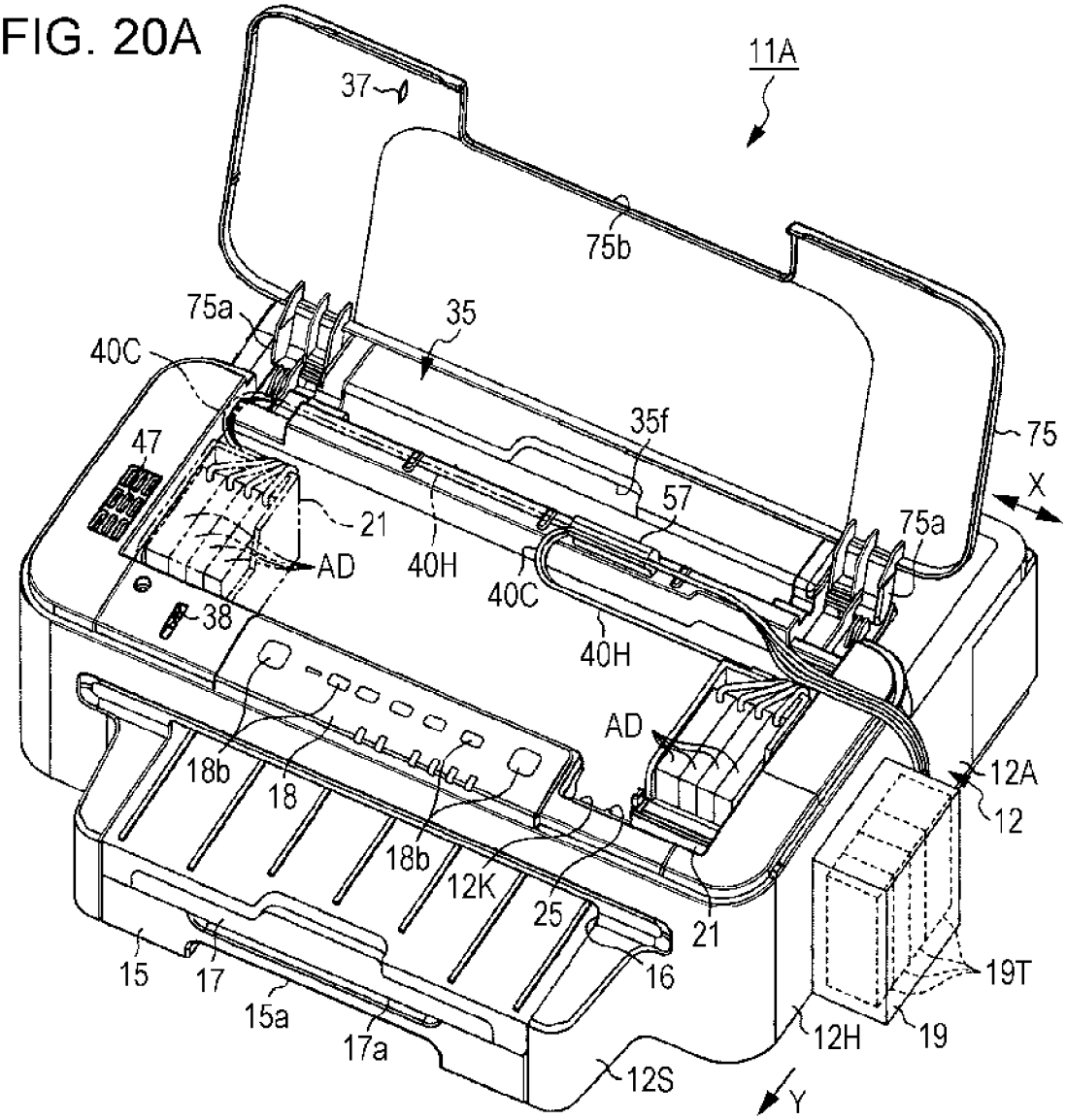
FIG. 20A is a perspective view showing the second printer having a leading-around structure of the ink supply tube in another embodiment.
Figure 20B:
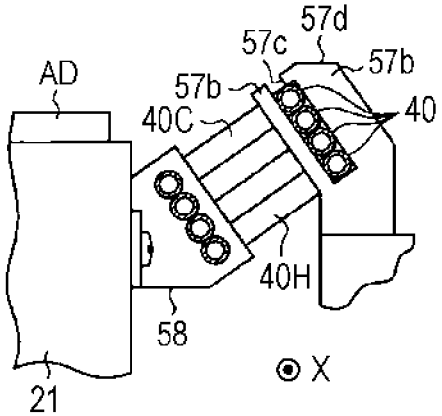
FIG. 20B is a front view of a spacer.

As shown in FIGS. 20A and 20B, in the second printer 11A, a configuration to route the plurality of ink supply tubes 40 by using the inclined block 57 and the retaining member 58 in the fourth embodiment is also acceptable.

Figure 21A:
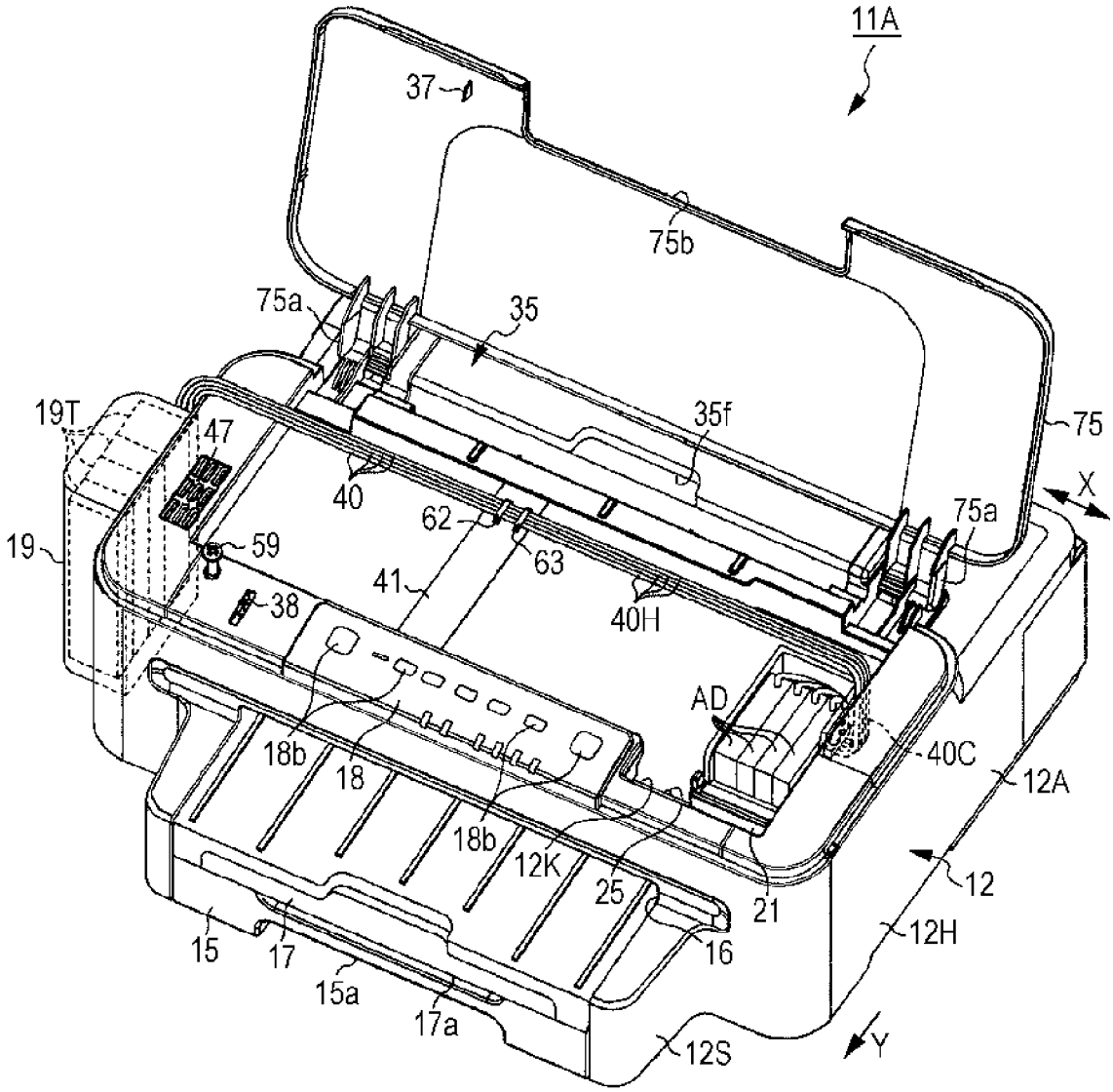
FIG. 21A is a perspective view showing the second printer having a leading-around structure of the ink supply tube in another embodiment.
Figure 21B:
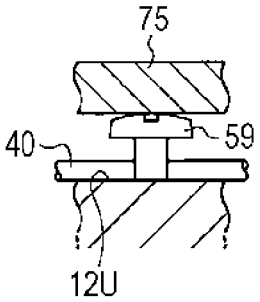
FIG. 21B is a front view of a spacer.

As shown in FIGS. 21A and 21B, in the second printer 11A, the gap may also be formed by using the fixing screw 59 in the fifth embodiment.

Figure 22A:
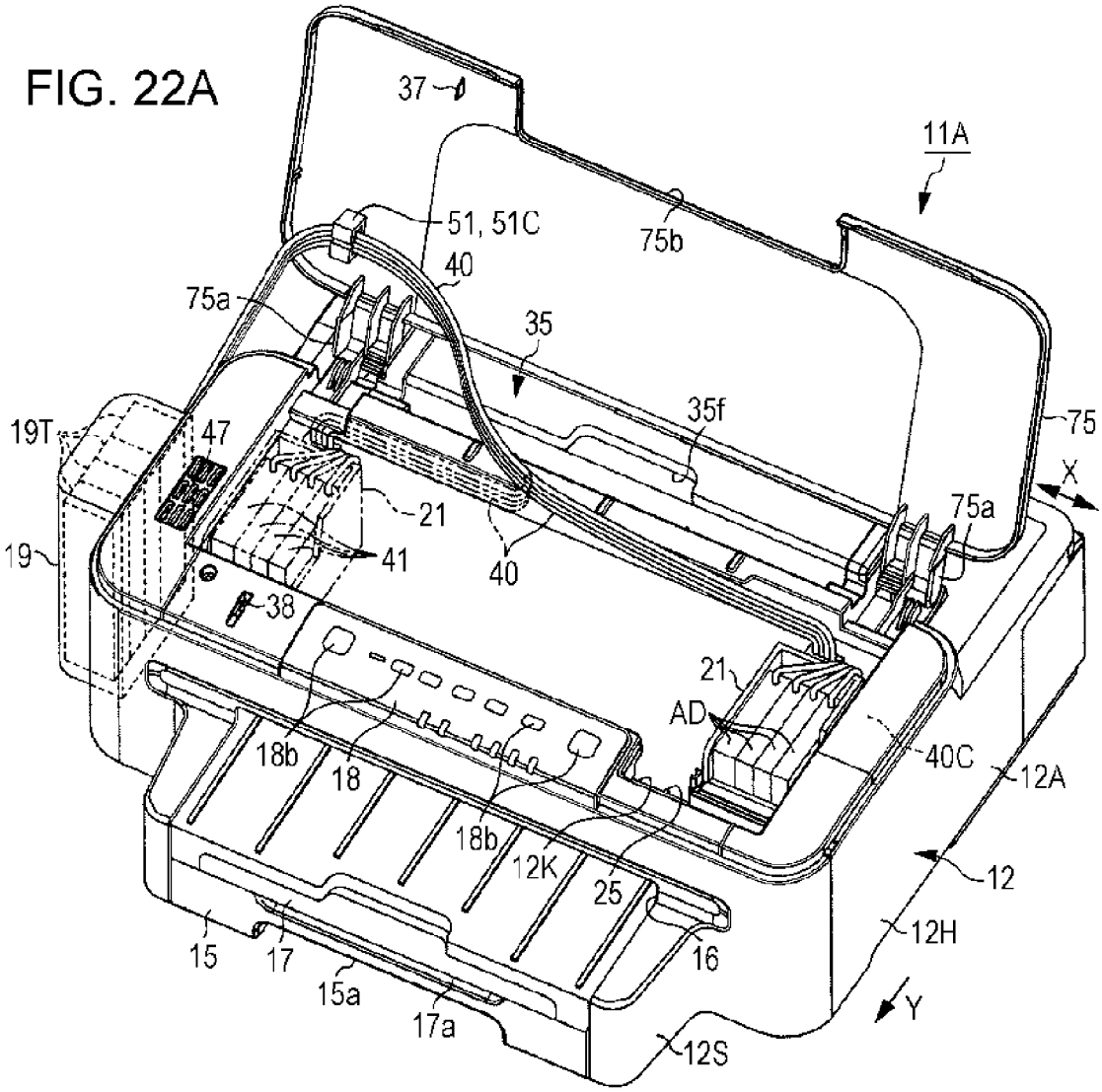
FIG. 22A is a perspective view showing the second printer having a leading-around structure of the ink supply tube in another embodiment.
Figure 22B:
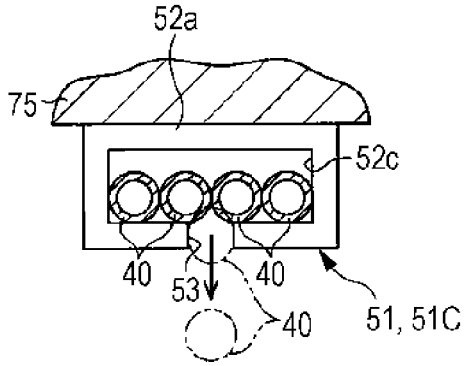
FIG. 22B is a front view of a spacer.

As shown in FIGS. 22A and 22B, in the second printer 11A, the spacer 51 (51C) in the sixth embodiment may also be mounted on the rear surface of the cover section 75 that is an example of the cover member, so as to form the gap forming member.

Figure 23:
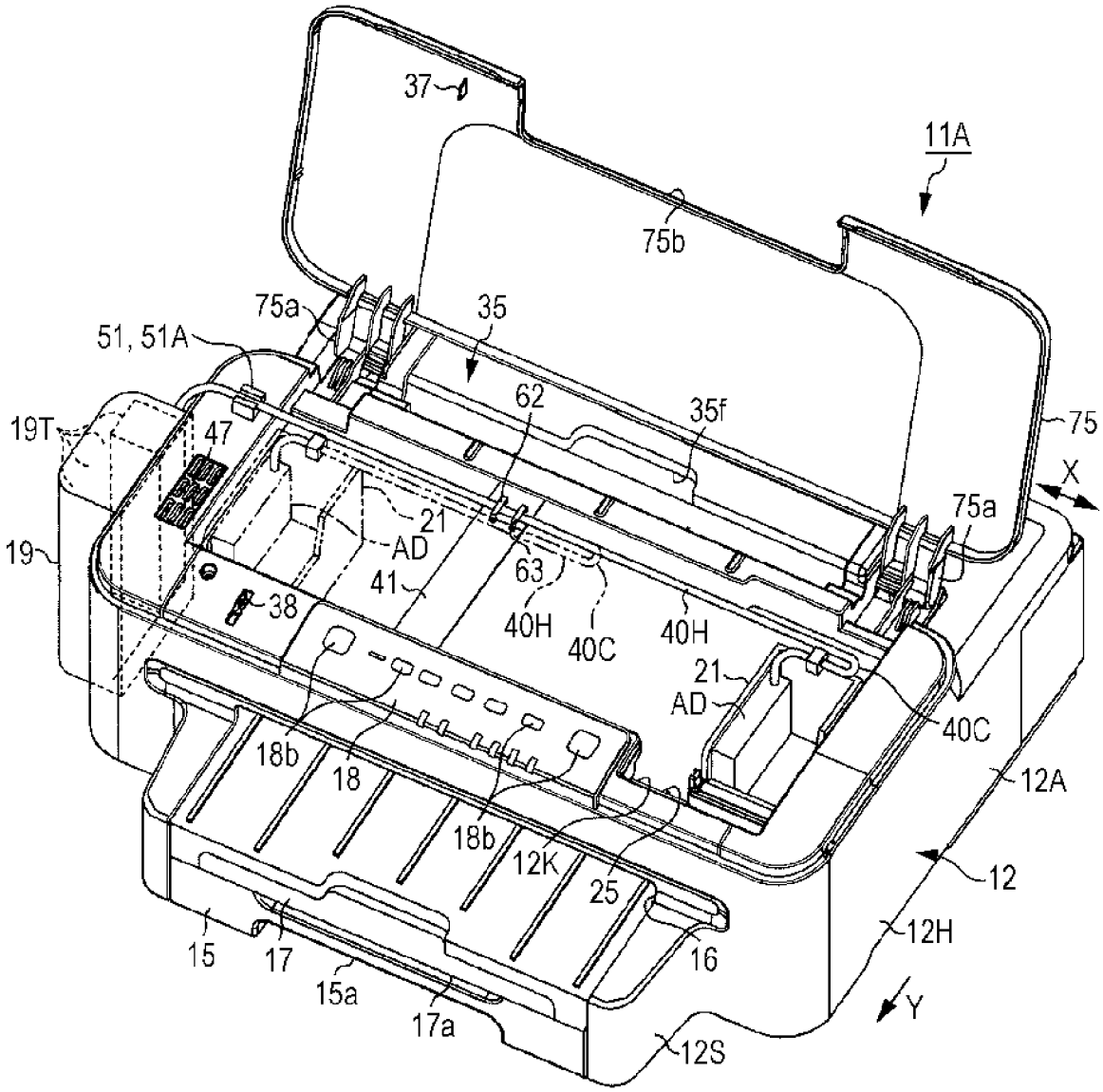
FIG. 23 is a perspective view showing the second printer having a leading-around structure of the ink supply tube in another embodiment.

As shown in FIG. 23, in the second printer 11A, a configuration to route a single ink supply tube 40 by using the spacer 51 (51A) in the first embodiment is also acceptable. In this case, in each embodiment in the first printer 11, a single ink supply tube 40 may also be routed. In addition, in the second printer 11A, a single ink supply tube 40 may also be routed in a structure to route the ink supply tubes 40 of each embodiment other than the first embodiment.

As shown in FIG. 22A, in the second printer 11A, the spacer 51 (51C) in the sixth embodiment may also be mounted on the rear surface of the cover section 75 that is an example of the cover member, so as to form the gap forming member.

Figure 24A:
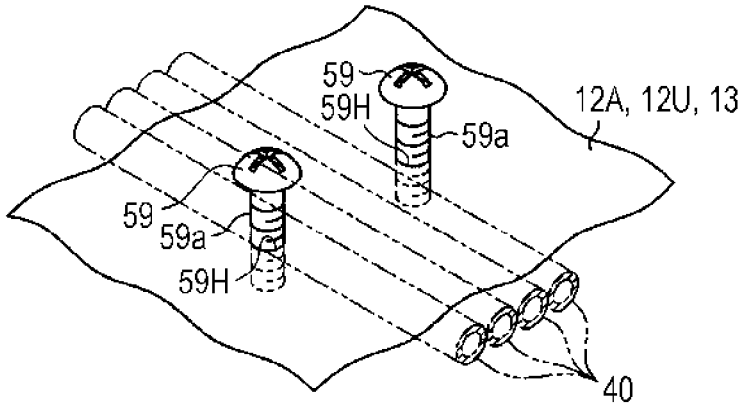
FIGS. 24A to 24D are perspective views showing other examples of a spacer.

As shown in FIG. 24A, the gap forming member may also have a configuration in which the shaft portions 59*a* of a pair of fixing screws 59 as an example of a regulating member are partially screwed into threaded holes 59H formed in at least one of the print function section 12A and the image reading section 13, at a distance in a horizontal direction perpendicular to the axial direction of the shaft portion 59*a*. Of course, the distance between the pair of fixing screws 59 is set according to the number of ink supply tubes 40 which are inserted between the fixing screws 59. Incidentally, in FIG. 24A, a case where four ink supply tubes 40 are inserted in a parallel state is shown as an example. According to this configuration, by inserting the ink supply tubes 40 between the shaft portions 59*a* through the gap between the pair of adjacent fixing screws 59, thereby bringing the ink supply tubes 40 into contact with the shaft portions 59*a*, it is possible to restrict the movement of the ink supply tubes 40 without dismounting the end portions of the ink supply tubes 40. Alternatively, the gap forming member may also be the spacer 51 having a configuration in which the ink supply tube 40 can be inserted into an internal space area by passing the midway portion in the length direction of the ink supply tube 40 through the slit 53 without being accompanied by elastic deformation.

Figure 24B:
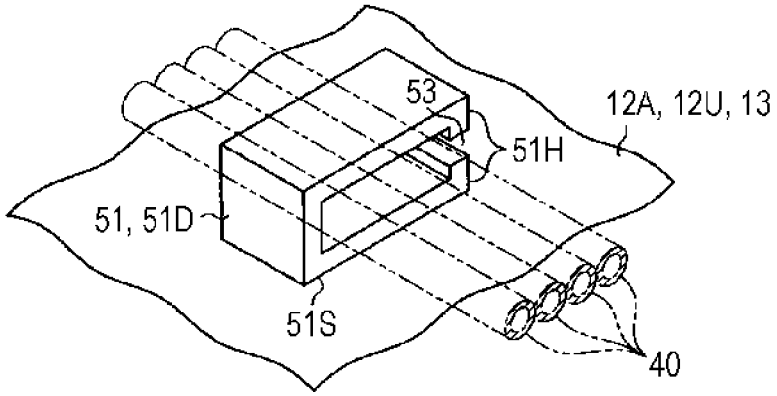

As shown in FIG. 24B, the gap forming member may also have a configuration in which the slit 53 is formed in a side wall portion 51H that is a surface adjacent to a contact surface 51S with a member on which a tubular body 51A constituting the spacer 51 is mounted, of a peripheral wall of the tubular body 51D. According to this configuration, it is possible to restrict the movement of the ink supply tubes 40 inserted into the spacer 51 along the gravity direction in a use state of the first printer 11. Therefore, for example, by using the spacer 51 in the sixth embodiment described above, it is possible to prevent the ink supply tubes 40 from carelessly slipping out in the gravity direction from a state where the ink supply tubes 40 are mounted on the image reading section 13 side, in a state where the image reading section 13 is turned (displaced) so as to expose the opening portion 12K.

Figure 24C:
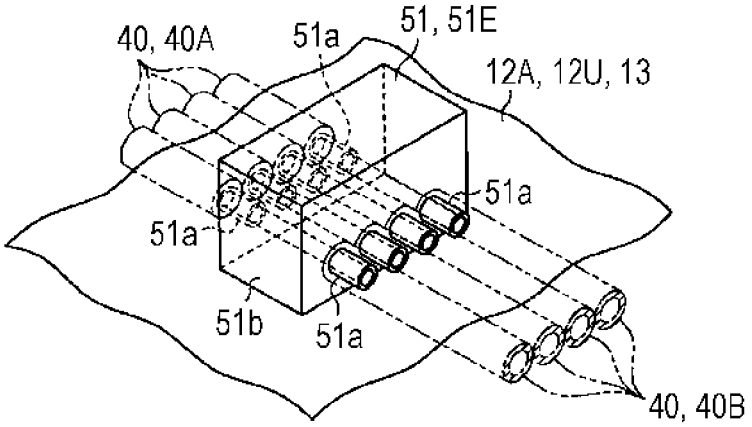
Figure 24D:
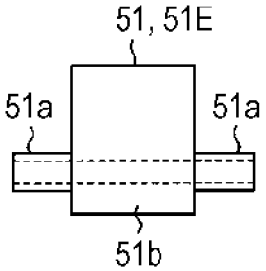

As shown in FIGS. 24C and 24D, a joint 51E may also double as the spacer 51 as an example of the gap forming member. As shown in these drawings, the joint 51E doubling as the spacer 51 has a main body 51*b* having a rectangular parallelepiped shape and four pairs of tube portions 51*a* protruding by four from each of both end faces in the axial direction of the main body 51*b*, and in the four pairs of tube portions 51*a*, the paired tube portions communicate with each other in the axial direction. According to this configuration, since the joint and the spacer are provided by a single component, it contributes to a reduction in the number of components.

In the first embodiment described above, a gap forming member may also be provided in which a member that restricts the movement of the ink supply tube 40 by coming into contact with the outer surface of the ink supply tube 40 is configured by a separate member from the spacer 51 which forms a gap between the print function section 12A and the image reading section 13.

In the seventh embodiment described above, a gap forming member may also be provided in which a member that restricts the movement of the ink supply tube 40 by coming into contact with the outer surface of the ink supply tube 40 is configured by a separate member from the spacer 51 for forming a gap between the print function section 12A and the cover section 75.

In the third and sixth embodiments described above, the ink supply tube 40 need not have a configuration in which the ink supply tube 40 is necessarily disengaged from the spacer 51 in a case where the image reading section 13 and the cover section 75 are displaced in a direction to open the opening portion 12K. A configuration is also acceptable in which a user takes the ink supply tube 40 out of the spacer 51 after the image reading section 13 and the cover section 75 are displaced in a direction to open the opening portion 12K.

In the first to seventh embodiments described above, a configuration is also acceptable in which the adaptor AD is not mounted on the carriage 21. That is, a configuration may also be made such that ink which is supplied from the ink tank 19T provided outside the print function section 12A through the ink supply tube 40 is supplied to the liquid ejecting head 22 side without going through the adaptor AD.

In the first to seventh embodiments described above, the ink tank 19T may also have a configuration in which the ink tank 19T is mounted on the apparatus main body 12 (the print function section 12A) or the image reading section 13 by using a fixing member (for example, a screw, an adhesive, or the like). Of course, a mounting position can be set to be left and right side wall portions or a back surface when viewed from the fore side (the front side) in the sub-scanning direction Y. Alternatively, the upper surface of the automatic document feeder 14 is also possible.

Eighth Embodiment

Figure 25:
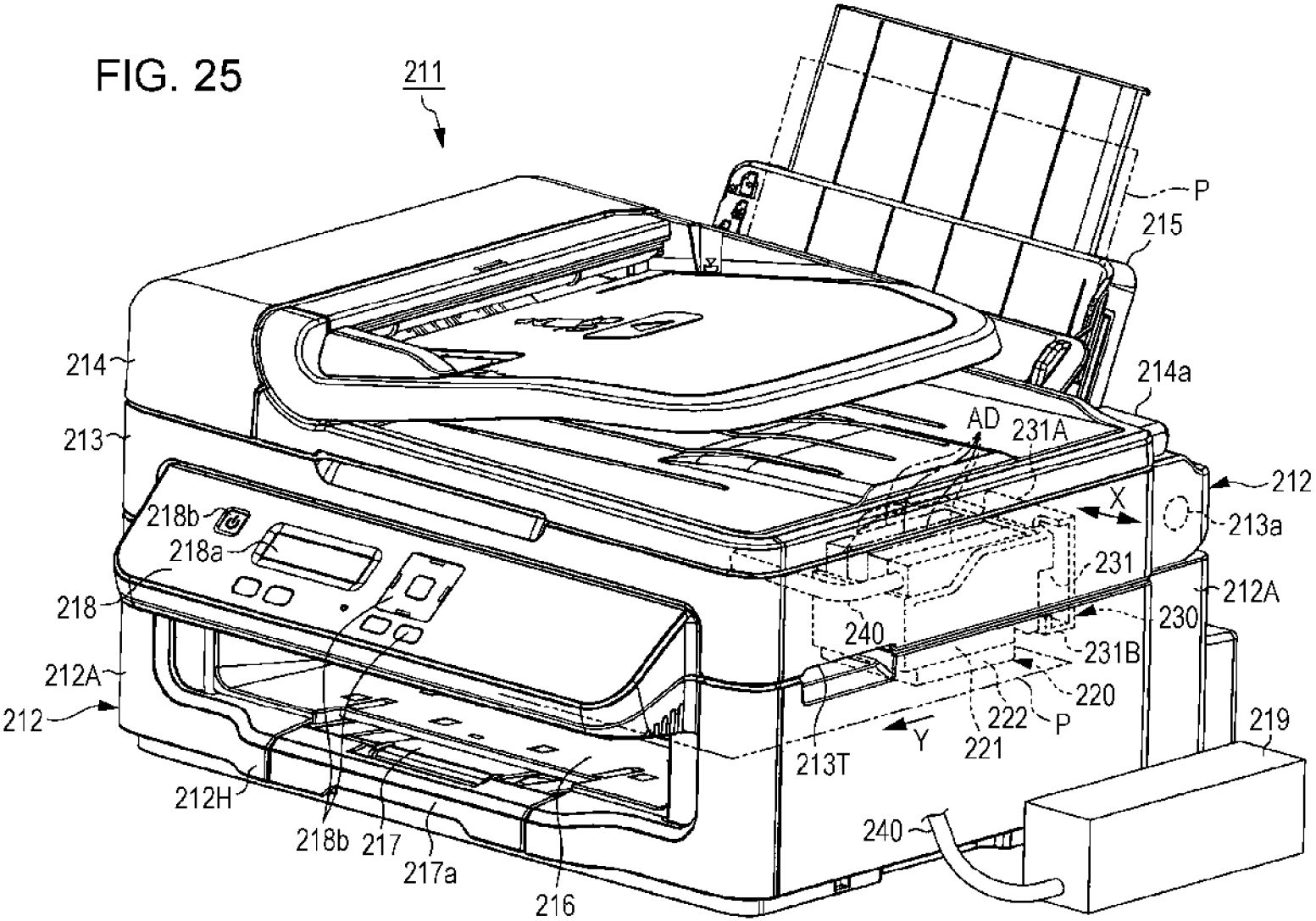
FIG. 25 is a perspective view showing a third printer in an eighth embodiment.

The overall configuration of a third printer in an eighth embodiment will be described. As shown in FIG. 25, a third printer 211 of this embodiment has an apparatus main body 212 exhibiting a substantially rectangular parallelepiped shape, and an ink tank 219 as an example of the liquid accommodation section, which is a separate body from the apparatus main body 212 and exhibits a substantially rectangular parallelepiped shape.

A print function section 212A as an example of the casing section having a printing section 220 built-in is disposed on the lower portion side in the gravity direction of the apparatus main body 212 that is the side where ink is supplied, and on the other hand, on the upper portion side that is the anti-gravity direction side of the apparatus main body 212, an image reading section 213 having an image reading mechanism such as a scanner reading a document (an image) built-in is disposed as an example of the cover member. The image reading section 213 has a configuration in which the image reading section 213 is turned (displaced) around a pivot 213*a* provided at one side end (the rear side) of the apparatus main body 212, whereby the side end side (the front side) on the opposite side to the pivot 213*a* in the apparatus main body 212 is lifted. That is, hand hooking portions 213T are recessed in the casing side surfaces (both the left and right side surfaces) of the image reading section 213, and thus it is possible for a user of the third printer 211 to lift the image reading section 213 with the hands put in the hand hooking portions 213T at the time of maintenance, for example. Due to the lifting, an opening portion 212K (refer to FIG. 26A) is exposed which is provided on the upper side of the printing section 220 and exposes at least a portion of the moving area for a carriage 221 disposed so as to be able to reciprocate in the print function section 212A.

In addition, an automatic document feeder 214 that automatically feeds a document to be read to the image reading section 213 is disposed above the image reading section 213. The automatic document feeder 214 has a configuration in which the automatic document feeder 214 is turned around a pivot 214*a* provided at one side end (the rear side) of the apparatus main body 212, whereby the side end side (the front side) on the opposite side to the pivot 214*a* in the apparatus main body 212 is lifted. Due to the lifting of the automatic document feeder 214, it becomes possible for a user to manually feed a document to be read to the image reading section 213.

Further, a placement stand 215 on which plural sheets of paper P can be placed in a stacked manner is provided on the rear side of the apparatus main body 212. The sheets of paper P placed on the placement stand 215 are transported one by one toward the front from the back to the printing section 220 provided in the print function section 212A and printing is performed on the paper P in the printing section 220. That is, the paper P is transported from the placement stand 215 to the printing section 220 by a transport mechanism (not shown) and ink is ejected from a liquid ejecting head 222 that reciprocates by a movement mechanism (not shown) along a direction (this is referred to as the main scanning direction X) crossing a transport direction (this is referred to as the sub-scanning direction Y) of the paper P in the printing section 220 onto the paper P, whereby an image is printed. The paper P with the image printed by the printing section 220 is transported further forward (in the sub-scanning direction Y) from the printing section 220 and discharged from a paper discharge port 216 provided in the front surface of the apparatus main body 212 (the print function section 212A).

On the lower side of the paper discharge port 216 in the apparatus main body 212 (the print function section 212A), a tray accommodation section 212H in which a stacker 217 as an example of the discharge tray taking the paper P which is discharged from the paper discharge port 216 is accommodated is configured by a casing portion formed to protrude in a discharge direction of the paper P (here, the sub-scanning direction Y). Due to the protrusion, the stacker 217 can be easily drawn out from the apparatus main body 212 by using a gripping portion 217*a*, thereby being drawn out from the apparatus main body 212 according to the length in the discharge direction (the transport direction) of the paper P which is discharged.

On the other hand, an operation panel section 218 for making a printing operation or the like in the printing section 220 be performed is disposed above the paper discharge port 216 in the apparatus main body 212 (the print function section 212A). The operation panel section 218 is configured by a casing portion exhibiting an inclined surface in which the lower side thereof protrudes further to the discharge direction side of the paper P than the upper side. In the inclined surface, a display section (for example, a liquid crystal display) 218*a* for displaying a menu screen or the like, manual operation buttons 218*b* such as a power button, or the like is provided as the operation member that is operated at the time of use such as execution of printing, and thus an operation by a user is facilitated.

Incidentally, the printing section 220 provided in the third printer 211 of this embodiment has the carriage 221 as an example of the moving body which reciprocates in the main scanning direction X, and the carriage 221 is provided with the liquid ejecting head 222 that ejects ink. The carriage 221 is disposed so as to be able to move (reciprocate) in the main scanning direction X while being guided by a guide frame 230 that is a plate member extending along the main scanning direction X. That is, the guide frame 230 has a rail section 231 in which an upper rail 231A and a lower rail 231B are provided by bending a plate member into a substantial U-shape at both upper and lower end portions of the plate member perpendicular to the main scanning direction X. The carriage 221 is supported by the upper rail 231A and the lower rail 231B at the rear end side thereof so as to be in a so-called cantilever state and reciprocates along the main scanning direction X on the rail section 231 while being guided by the upper rail 231A and the lower rail 231B. Then, ink supplied by the ink supply tube 240 is ejected from the liquid ejecting head 222 provided in the carriage 221 which reciprocates, whereby printing on the paper P is performed.

In the third printer 211 of this embodiment, a relay adaptor AD which relays ink that is supplied through the ink supply tube 240 to the liquid ejecting head 222 is mounted on the carriage 221, and ink is supplied from the relay adaptor AD mounted to the liquid ejecting head 222. Therefore, the ink supply tube 240 which supplies ink from the ink tank 219 in a state of accommodating ink is connected to the relay adaptor AD, whereby the ink supply tube 240 forms an ink flow path in which ink can flows between the ink tank 219 and the liquid ejecting head 222.

In addition, here, one type of ink (for example, black ink) is set to be supplied from the ink tank 219 and a single relay adaptor AD corresponding to one type of ink is set to be mounted on the carriage 221. Of course, with respect to the relay adaptor AD, in a case where a plurality of types of ink is supplied from the ink tank 219, a plurality of relay adaptors AD (in FIG. 25, up to four) corresponding to the number of types of ink is mounted.

Next, the eighth embodiment relating to the disposition of the ink supply tube 240 will be described with reference to FIGS. 26A, 26B, 26C, and 27. In the eighth embodiment, a spacer 241 as an example of the gap forming member, in which a recess portion in which the ink supply tube 240 can be inserted from a direction crossing the length direction thereof is formed as the contact portion, is provided between the print function section 212A and the image reading section 213. In addition, in FIG. 26A, illustration is made with some constituent members such as a transport mechanism for the paper P omitted.

Figure 26A:
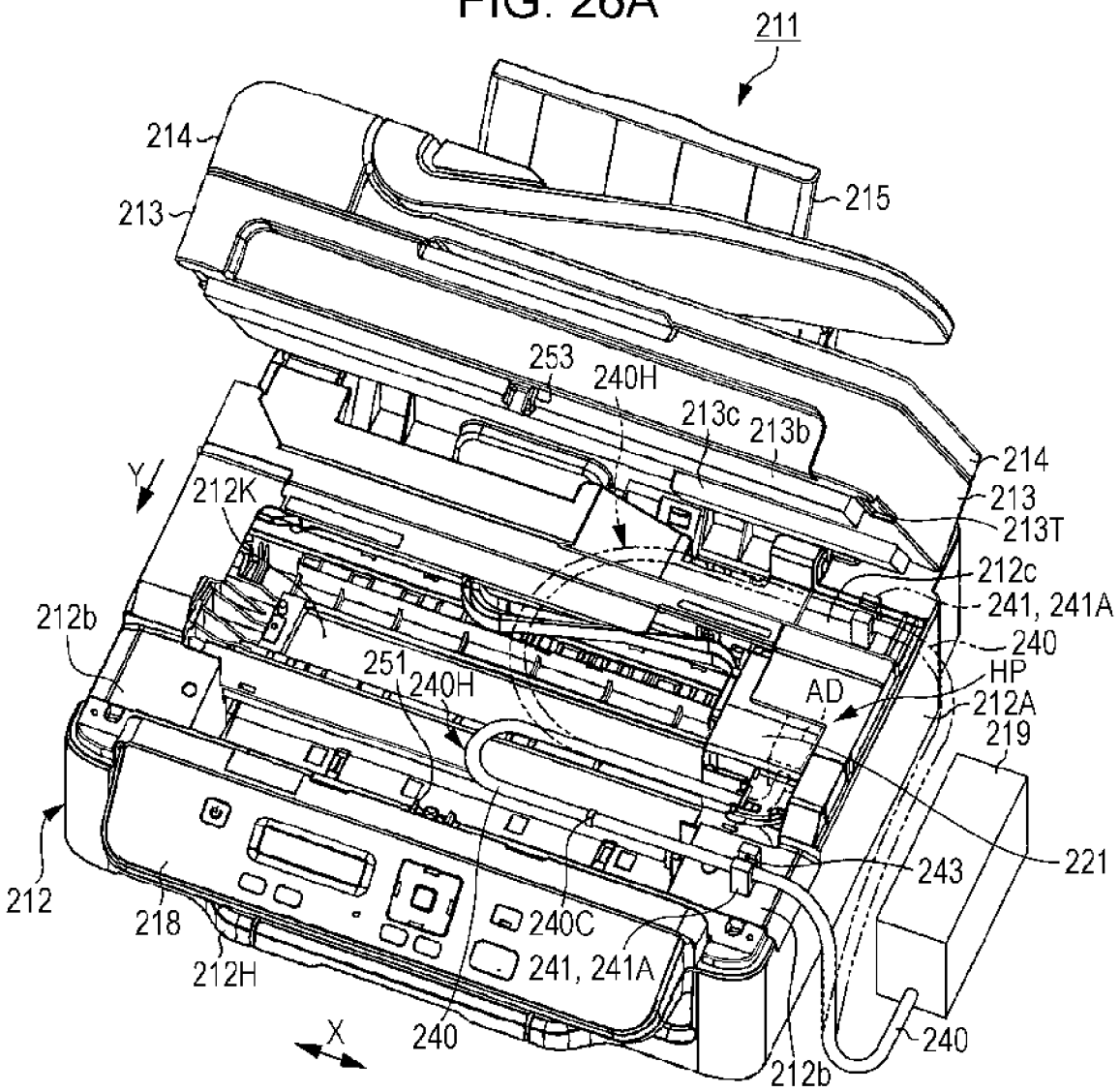
FIG. 26A is a perspective view showing a state where an image reading section is lifted in the third printer of the eighth embodiment relating to the disposition of the ink supply tube.
Figure 26B:
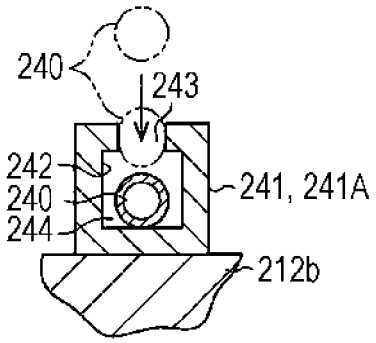
FIG. 26B is a schematic cross-sectional view of a gap forming member.

As shown in FIGS. 26A and 26B, the ink tank 219 which accommodates ink to be supplied to the carriage 221 (the relay adaptor AD) side is disposed outside the casing on the right side when viewed from the fore side in the sub-scanning direction Y with respect to the apparatus main body 212. That is, the ink tank 219 is disposed outside the moving area for the carriage 221 and at a position close to a home position HP in the main scanning direction X. Then, one end side of the ink supply tube 240 functioning as a flow path for ink accommodated in the ink tank 219 is connected to the ink tank 219. Further, the other end side of the ink supply tube 240 is inserted from the position close to the home position HP in the main scanning direction X of the carriage 221 into the moving area for the carriage 221 which is exposed through the opening portion 212K provided in the print function section 212A, and then connected to the relay adaptor AD mounted on the carriage 221.

Further, in the upper surface of the print function section 212A, a concave portion 212*b* is formed at a position corresponding to a protrusion portion 213*b* which is provided at the image reading section 213 and protrudes to the print function section 212A, further on the front side than the opening portion 212K in a case where the side supporting the image reading section 213 so as to be able to be turn is set to be the back side. The spacer 241 having a substantially rectangular tubular shape is fixed to the concave portion 212*b* in a state where a direction of a tube axis of the spacer 241 follows a moving direction of the carriage 221. That is, the spacer 241 is a tubular body 241A which is sandwiched between the concave portion 212*b* and the image reading section 213 (the protrusion portion 213*b*) in a case where the image reading section 213 is turned in a direction to close the opening portion 212K of the print function section 212A.

Then, due to the tubular body 241A, a configuration is made in which ink can flow without shut-off of an ink flow path in a tube portion of the ink supply tube 240 passing through the gap between the image reading section 213 and the print function section 212A. In other words, the spacer 241 is provided for forming a gap having a size that does not shut off an ink flow path in the ink supply tube 240, between the image reading section 213 and the print function section 212A, and also passing the ink supply tube 240 through the formed gap.

In addition, as shown by a two-dot chain line in FIG. 26A, in the upper surface of the print function section 212A, a concave portion 212*c* is formed at a position corresponding to a protrusion portion 213*c* which is provided at the image reading section 213 and protrudes to the print function section 212A, further on the back side than the opening portion 212K in a case where the side supporting the image reading section 213 so as to be able to be turned is set to be the back side. The spacer 241 having a substantially rectangular tubular shape may be fixed to the concave portion 212*c* in a state where an axial direction of the spacer 241 follows the length direction of the print function section 212A.

A slit 243 as an example of a rectangular passing portion that makes the inside and the outside of the tubular body 241A communicate with each other is formed in a portion of a peripheral wall of the tubular body 241A constituting the spacer 241, specifically, a wall portion (in FIGS. 26A and 26B, an upper wall portion) that does not come into contact with the concave portion 212*b*. The slit 243 is formed so as to extend over the entire area in the longitudinal direction of the spacer 241 (the axial direction of the tubular body 241A).

For this reason, as shown by a two-dot chain line in FIG. 26B, the ink supply tube 240 can be inserted into an internal space area 244 of the spacer 241 through the slit 243 while being accompanied by elastic deformation, by movement in a direction perpendicular to (crossing) the length direction of the ink supply tube 240. Then, if a state is created where the ink supply tube 240 is inserted into the internal space area 244 of the spacer 241, the outer surface of the ink supply tube 240 comes into contact with a recess portion 242 which is formed by the inner surface of the spacer 241 (the tubular body 241A), whereby the movement of the ink supply tube 240 in a direction crossing the length direction is restricted. That is, the recess portion 242 of the tubular body 241A becomes a contact portion and thus the spacer 241 functions as a contact section that restricts the movement of the ink supply tube 240. Further, the portion (in FIG. 26A, a curved portion having a substantial U-shape) between the spacer 241 and the relay adaptor AD in the length direction of the ink supply tube 240 functions as a deformation and movable portion 240H that is deformed to follow the movement of the carriage 221. Then, the tube length of the deformation and movable portion 240H is defined (regulated) according to the length of the ink supply tube 240 which is inserted through the spacer 241.

Figure 26C:
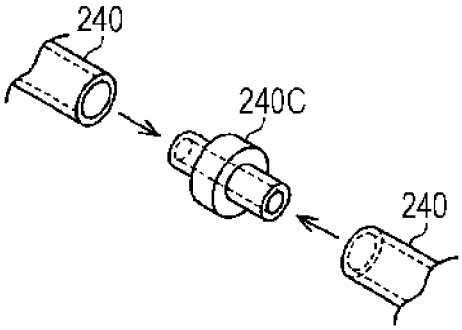
FIG. 26C is a perspective view showing a joint of an ink supply tube.

In addition, in this embodiment, as shown in FIG. 26A, the ink supply tube 240 may also have a configuration in which a plurality of tubes is connected through a joint 240C connecting the tubes in the length direction thereof. The joint 240C is provided at a plurality of places according to the number of tubes which are connected between the ink tank 219 and the carriage 221, and allows ink to flow between the connected tubes. Incidentally, in this embodiment, as shown in FIG. 26C as an example, two tubes are connected through the joint 240C having a through-hole and a structure in which tubular portions in which tubes are inserted are formed on both sides, and a seam connected in this way is formed at a single place in the deformation and movable portion 240H of the ink supply tube 240, as shown in FIG. 26A.

Figure 27:
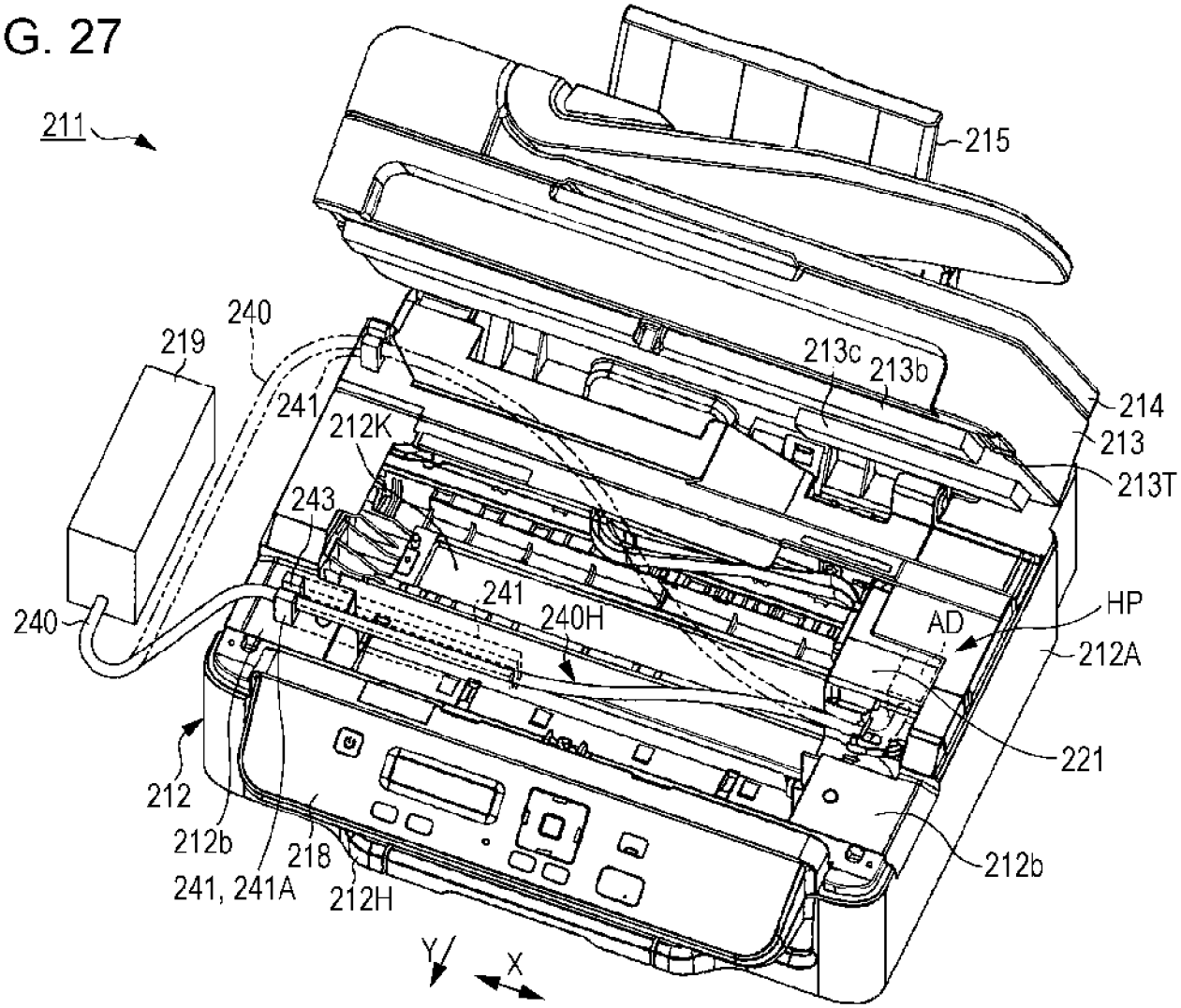
FIG. 27 is a perspective view of the third printer showing a state where the gap forming member is provided at a different position in the eighth embodiment.

Alternatively, as shown in FIG. 27, in this embodiment, the other end side of the ink supply tube 240 with one end side connected to the ink tank 219 may also be inserted from the outside of the casing on the left side when viewed from the fore side in the sub-scanning direction Y, that is, a position close to the opposite side to the home position HP in the main scanning direction X of the carriage 221 into the opening portion 212K. In addition, in FIG. 27, illustration is made with the joint 240C of the ink supply tube 240 omitted.

Also in the insertion of the ink supply tube 240 shown in FIG. 27, the other end of the ink supply tube 240 inserted is inserted into the moving area for the carriage 221 which is exposed through the opening portion 212K, and connected to the relay adaptor AD mounted on the carriage 221. Then, the portion (in FIG. 27, the portion extending to be curved gently) between the spacer 241 and the relay adaptor AD in the length direction of the ink supply tube 240 is defined as the deformation and movable portion 240H which is deformed to follow the movement of the carriage 221, by the spacer 241. Therefore, as shown by a dashed line in FIG. 27, a configuration is made such that the spacer 241 extends inward along the main scanning direction X, thereby being able to regulate the length portion of the deformation and movable portion 240H.

In addition, as shown by a two-dot chain line in FIG. 27, to a casing site which is located further to the back side than the opening portion 212K, that is the side where the image reading section 213 is supported so as to be able to be turned, in the upper surface on the left side when viewed from the fore side in the sub-scanning direction Y of the print function section 212A, the spacer 241 having a substantially rectangular tubular shape may also be fixed in a state where the axial direction thereof follows the longitudinal direction of the print function section 212A. Further, in order to shorten the length of the ink supply tube 240, it is preferable that the ink tank 219 be disposed outside the casing on the left side when viewed from the fore side in the sub-scanning direction Y with respect to the apparatus main body 212, that is, at a position close to the opposite side to the home position HP in the main scanning direction X of the carriage 221.

Next, the action of the third printer 211 in the eighth embodiment will be described.

In the third printer 211, in a case of dismounting the ink supply tube 240 from the spacer 241 in order to perform the maintenance of the ink supply tube 240, the following work is performed. That is, in a state where the spacer 241 is mounted on the concave portion 212*b* (the print function section 212A), the ink supply tube 240 is taken out of the internal space area 244 of the spacer 241 by moving the midway portion in the length direction of the ink supply tube 240 in a direction crossing the length direction to pass through the slit 243 while being accompanied by elastic deformation. At that time, it is not necessary to dismount an end portion on the side connected to the ink tank 219 in the ink supply tube 240 from the ink tank 219 or dismount an end portion on the side connected to the relay adaptor AD in the ink supply tube 240 from the relay adaptor AD in order to dismount the ink supply tube 240 from the spacer 241. Therefore, the ink supply tube 240 is dismounted from the spacer 241 without requiring complicated work.

On the other hand, in a case of mounting the ink supply tube 240 on the spacer 241, the following work is performed. That is, in a state where the spacer 241 is mounted on the print function section 212A, the ink supply tube 240 is inserted into the internal space area 244 of the spacer 241 by moving the midway portion in the length direction of the ink supply tube 240 in a direction crossing the length direction to pass through the slit 243 while being accompanied by elastic deformation (refer to FIG. 26B).

In addition, also in a case of mounting the ink supply tube 240 on the spacer 241 in this manner, it is not necessary to dismount an end portion on the side connected to the ink tank 219 in the ink supply tube 240 from the ink tank 219 or dismount an end portion on the side connected to the relay adaptor AD in the ink supply tube 240 from the relay adaptor AD. Therefore, the ink supply tube 240 is mounted on the spacer 241 without requiring complicated work.

Ninth Embodiment

Figure 28:
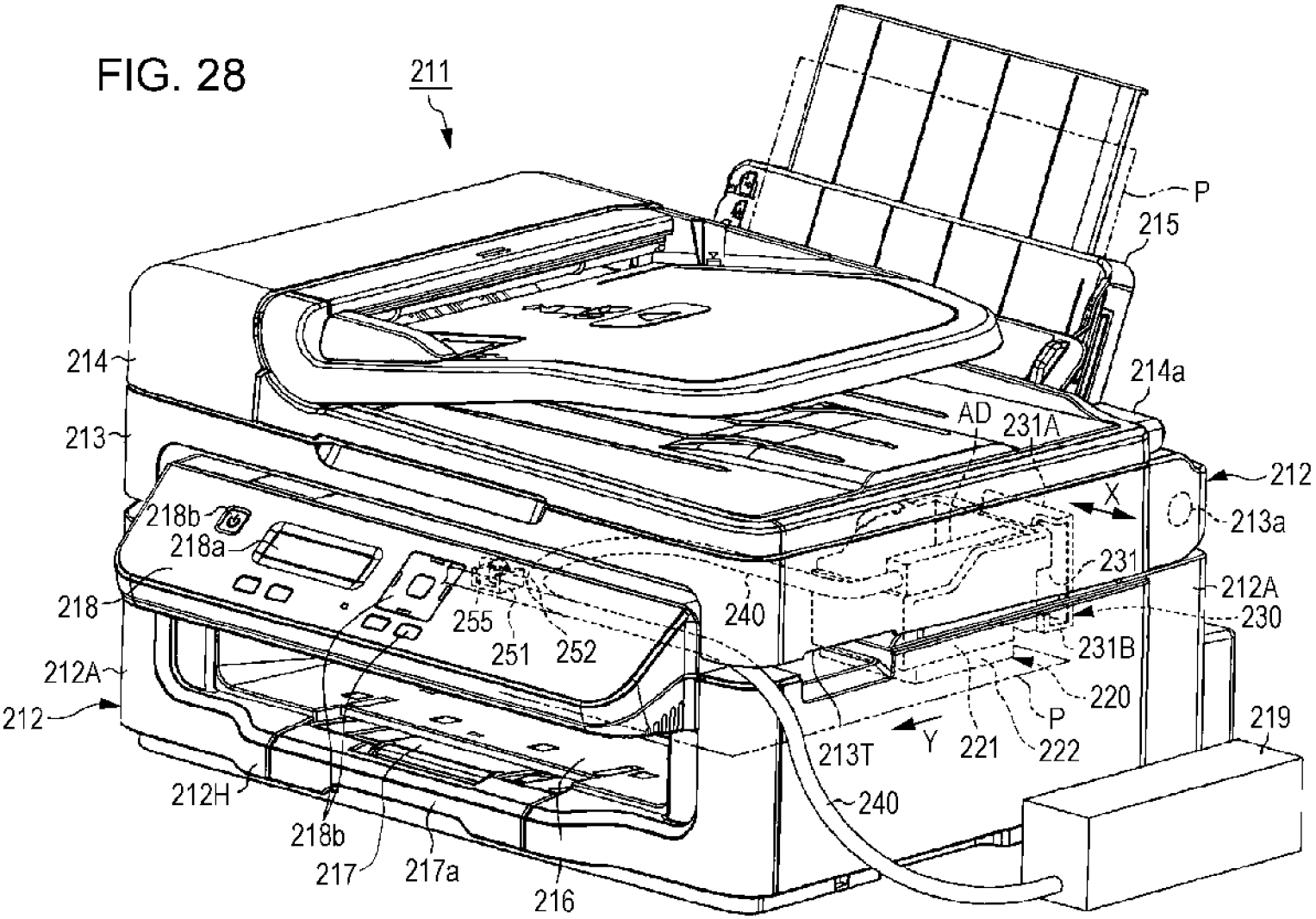
FIG. 28 is a perspective view of the third printer of a ninth embodiment relating to the disposition of the ink supply tube.
Figure 29:
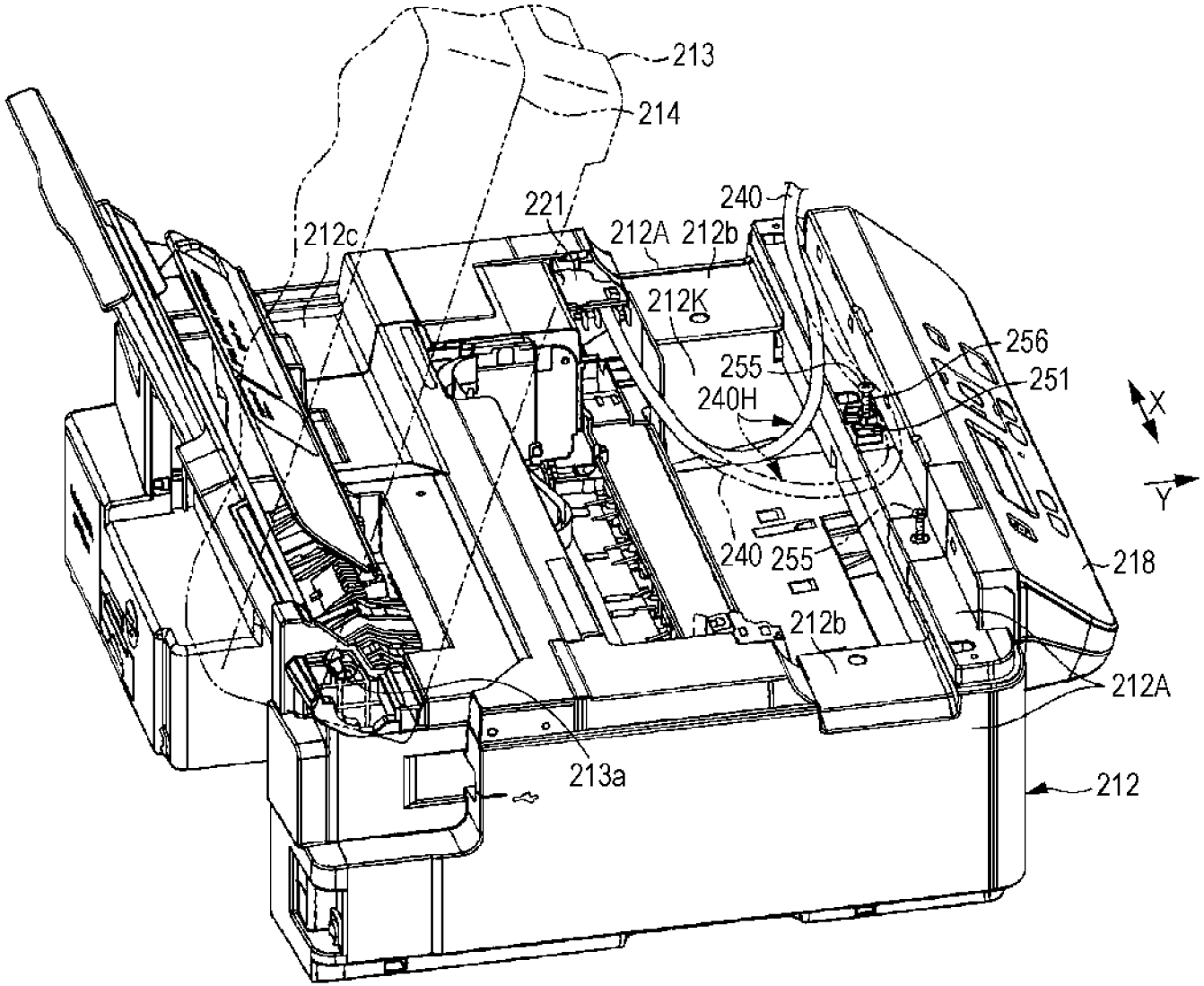
FIG. 29 is a perspective view showing the configuration of the gap forming member in the third printer of the ninth embodiment.

Next, a ninth embodiment relating to the disposition of the ink supply tube 240 will be described with reference to FIGS. 28 and 29. In the ninth embodiment, the gap forming member between the print function section 212A and the image reading section 213 is configured to include a fixing screw which is disposed to have a shaft portion which is partially screwed into a threaded hole formed in at least one of the print function section 212A and the image reading section 213. In addition, in the description of this embodiment, the same constituent members as those in the eighth embodiment described above are denoted by the same reference numerals as those in the eighth embodiment and the description thereof is omitted. Further, in FIGS. 28 and 29, illustration is made with the joint 240C of the ink supply tube 240 omitted. Further, in FIG. 29, illustration is made in a state where the image reading section 213 and the automatic document feeder 214 are dismounted.

As shown in FIG. 28, a threaded hole is formed in the upper surface of the print function section 212A substantially at the center in the main scanning direction X on the fore side (the front side) in the sub-scanning direction Y and the back side (the rear side) of the operation panel section 218, and a positioning member 251 which positions the image reading section 213 is fixed by a fixing screw 255. That is, an engagement site 253 (refer to FIG. 2) with the positioning member 251 is provided on the lower surface side of the front center of the image reading section 213, and when a state is created where the image reading section 213 is swung, thereby closing the opening portion 212K, a configuration is made in which the engagement site 253 is fitted into the substantially C-shaped positioning member 251 having side wall plates 252 on both sides. Due to the fitting, the image reading section 213 is positioned with respect to the print function section 212A and overlaps the print function section 212A almost without a gap, thereby closing the opening portion 212K.

Therefore, as shown in FIG. 29, in this embodiment, by fixing the fixing screw 255 so as to partially screw a shaft portion 256 thereof, the portion which is not screwed into the print function section 212A in the shaft portion 256 protrudes upward from the print function section 212A. In this way, a screw head of the fixing screw 255 comes into contact with a lower surface-side site of the image reading section 213, whereby a gap for passing the ink supply tube 240 is formed between the print function section 212A and the image reading section 213. That is, the gap forming member is configured by the fixing screw 255 and the lower surface-side site (the engagement site 253) of the image reading section 213.

In addition, it is preferable that the fixing screw 255 which fixes the positioning member 251 adopt a so-called stepped screw in which a thread is formed in only a leading end portion thereof. If doing so, it is possible to form a gap for passing the ink supply tube 240 between the print function section 212A and the image reading section 213 in a state where the positioning member 251 is fixed without being loosened.

The gap between the print function section 212A and the image reading section 213 formed in this manner becomes the largest on the front side where the operation panel section 218 is formed, because the image reading section 213 is turned (displaced) around the pivot 213*a* provided on the back side in the apparatus main body 212. Therefore, in this embodiment, as shown in FIG. 28, the ink supply tube 240 is inserted into the gap formed on the front side of the apparatus main body 212. In this way, it is possible to insert the ink supply tube 240 into the opening portion 212K while suppressing widening of the gap.

Next, the action of the third printer 211 in the ninth embodiment will be described.

In the third printer 211, in a case of dismounting the ink supply tube 240 from the print function section 212A in order to perform the maintenance of the ink supply tube 240, a user lifts the image reading section 213, whereby it is possible to easily dismount the ink supply tube 240 from the print function section 212A. That is, since the image reading section 213 is in a contact state with respect to the head portion of the fixing screw 255 due to the force of gravity, the gap between the image reading section 213 and the print function section 212A, through which the ink supply tube 240 passes, can be widened according to the amount of lifting of the image reading section 213.

Incidentally, in the ninth embodiment described above, the ink supply tube 240 passing through the gap is inserted into the opening portion 212K in a state where the movement in a direction crossing the longitudinal direction thereof is not restricted. Therefore, since the position of the portion passing through the gap in the ink supply tube 240 is not stable, the length of the deformation and movable portion 240H changes, and thus there is a concern that displacement associated with the movement of the carriage 221 may become unstable.

Therefore, in the ninth embodiment, although illustration is omitted, the ink supply tube 240 inserted into the gap may also be inserted from between a screw head portion of the fixing screw 255 and the side wall plate 252 of the positioning member 251 into a space area which is formed between the shaft portion 256 of the fixing screw 255 and the side wall plate 252 of the positioning member 251. In this case, it is preferable that the distance between the screw head portion of the fixing screw 255 and the side wall plate 252 of the positioning member 251 be set to a dimension in which the ink supply tube 240 can pass regardless of the presence or absence of elastic deformation. In this way, the ink supply tube 240 can be mounted on the print function section 212A or dismounted from the print function section 212A in a state where the movement in a direction (here, the main scanning direction X) crossing the longitudinal direction is restricted, without requiring complicated work. Therefore, in the case of such a configuration, the positioning member 251 also functions as a portion of the gap forming member.

Alternatively, in a case where it is difficult for the ink supply tube 240 to be inserted into the space area which is formed between the shaft portion 256 of the fixing screw 255 and the side wall plate 252 of the positioning member 251, of course, the fixing screw 255 other than the fixing screw 255 of the positioning member 251 may be used. That is, as shown by a two-dot chain line in FIG. 29, by fixing the fixing screw 255 of the casing portion of the adjacent print function section 212A so as to partially screw the shaft portion 256 thereof, the portion which is not screwed into the casing of the print function section 212A in the shaft portion 256 is made so as to protrude from the print function section 212A.

Due to this configuration, as shown by the two-dot chain line in FIG. 29, by inserting the ink supply tube 240 between two fixing screws 255, the ink supply tube 240 comes into contact with the respective shaft portions 256. As a result, it is possible to restrict the movement of the ink supply tube 240 without dismounting the ink supply tube 240 from the ink tank 219 or the relay adaptor AD.

Tenth Embodiment

Next, a tenth embodiment relating to the disposition of the ink supply tube 240 will be described with reference to FIGS. 30A and 30B. The tenth embodiment has a configuration in which the gap forming member is provided in the image reading section 213. In addition, in the description of this embodiment, the same constituent members as those in the eighth embodiment and the ninth embodiment described above are denoted by the same reference numerals as those in the eighth embodiment and the ninth embodiment and the description thereof is omitted. Further, in FIGS. 30A and 30B, illustration is made with the joint 240C of the ink supply tube 240 omitted.

Figure 30A:
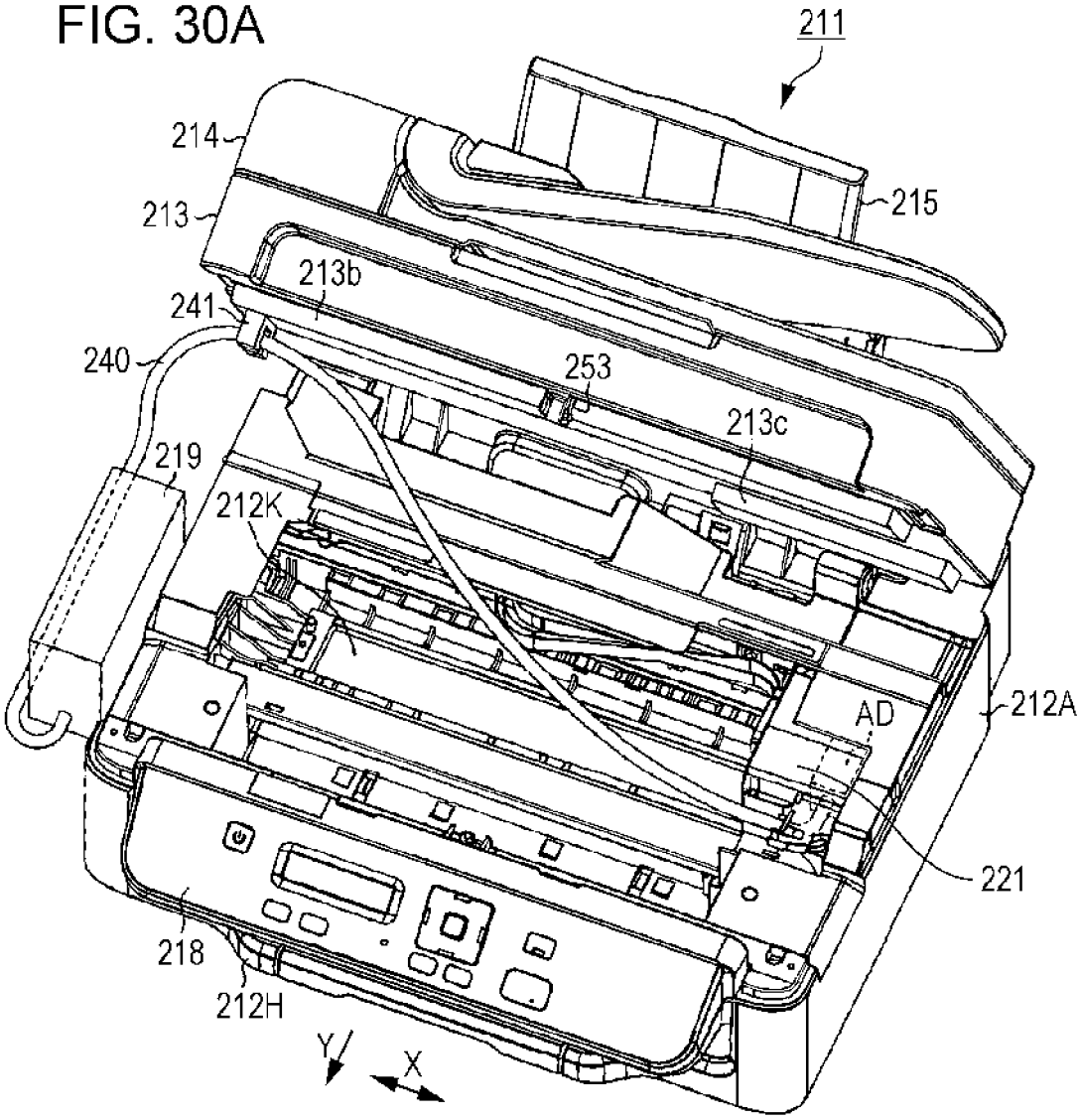
FIG. 30A is a perspective view showing a state where an image reading section is lifted in the third printer of a tenth embodiment relating to the disposition of the ink supply tube.

As shown in FIG. 30A, on the lower surface of the image reading section 213, the spacer 241 is provided at a position corresponding to the concave portion 212*b* of the print function section 212A at the fore side (the front side) in the sub-scanning direction Y on the opposite side to the pivot 213*a* side. In this embodiment, the spacer 241 is mounted on the image reading section 213 by being fixed by adhesion or a screw on the left side when viewed from the fore side in the sub-scanning direction Y. Of course, the spacer 241 may be mounted on the right side when viewed from the fore side in the sub-scanning direction Y in the image reading section 213, and the spacer 241 may also be provided on the back side (the rear side) in the sub-scanning direction Y, which is the pivot 213*a* side, and at a position corresponding to the concave portion 212*c* which is located further to the back side than the opening portion 212K of the print function section 212A, for example.

Figure 30B:
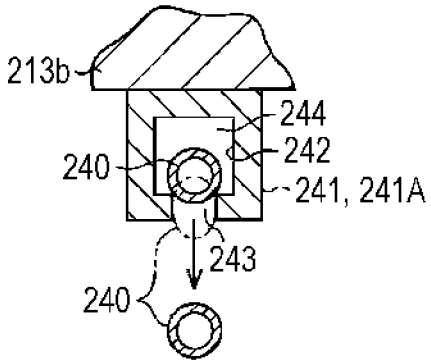
FIG. 30B is a schematic diagram showing a state where the ink supply tube is taken out of the spacer.

As shown in FIGS. 30A and 30B, in this embodiment, the spacer 241 is provided such that the slit 243 thereof faces the print function section 212A that is the gravity direction side. Therefore, the ink supply tube 240 is in a state where the ink supply tube 240 is inserted into the internal space area 244 of the spacer 241 by being pushed into the slit 243 from the lower side. In addition, the width dimension of the slit 243 of the spacer 241 is set to a dimension in which the ink supply tube 240 can be elastically deformed and then pass through the slit 243 by its own weight, as shown by a two-dot chain line in FIG. 30B, while the image reading section 213 moves (swings) to a position to expose the opening portion 212K of the print function section 212A.

Next, the action of the third printer 211 in the tenth embodiment will be described.

In the tenth embodiment, in a case of dismounting the ink supply tube 240 from the image reading section 213 in order to perform the maintenance of the ink supply tube 240, the image reading section 213 is lifted first.

Then, the ink supply tube 240 inserted into the space area 244 of the spacer 241 rises along with the image reading section 213 lifted, whereby the tube's own weight which is generated with the rise acts in a downward direction crossing the length direction of the tube. As a result, the ink supply tube 240 is taken out of the internal space area 244 of the spacer 241 through the slit 243, thereby being dismounted from the image reading section 213, as shown in FIG. 30B.

Further, although illustration and description are omitted here, in this embodiment, a configuration is also acceptable in which in a case where the image reading section 213 is displaced in a direction to open the opening portion 212K of the print function section 212A, the ink supply tube 240 is disengaged from the image reading section 213 along with the spacer 241.

In addition, in the third printer 211 described above, the gap forming member may have a configuration different from the configurations of the eighth to tenth embodiments described above. An example of this configuration will be described with reference to FIGS. 31A, 31B, and 31C.

Figure 31A:
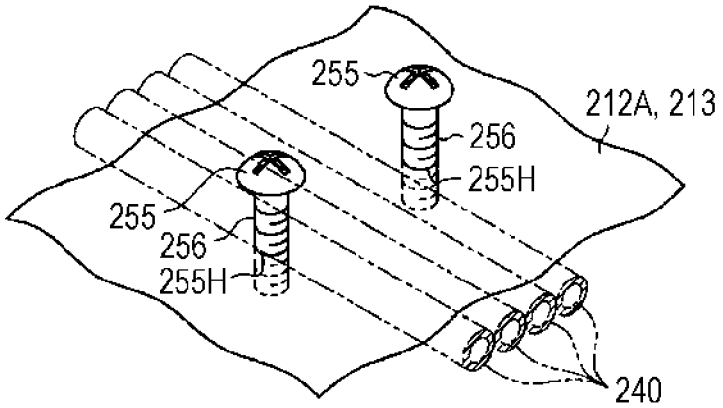
FIGS. 31A to 31C are schematic diagrams showing other examples of the configuration of the gap forming member.

As shown in FIG. 31A, the gap forming member may also have a configuration in which the shaft portions 256 of a pair of fixing screws 255 as an example of the regulating member are partially screwed into threaded holes 255H formed in at least one of the print function section 212A and the image reading section 213, at a distance in a horizontal direction perpendicular to the axial direction of the shaft portion 256. Of course, the distance between the pair of fixing screws 255 is set according to the number of ink supply tubes 240 which are inserted between the fixing screws 255. Incidentally, in FIG. 31A, a case where four ink supply tubes 240 are inserted in a parallel state is shown as an example. According to this configuration, by inserting the ink supply tubes 240 between the shaft portions 256 through the gap between the pair of adjacent fixing screws 255, thereby bringing the ink supply tubes 240 into contact with the shaft portions 256, it is possible to restrict the movement of the ink supply tubes 240 without dismounting end portions of the ink supply tubes 240.

Alternatively, the gap forming member may also be the spacer 241 having a configuration in which the ink supply tube 240 can be inserted into the internal space area 244 by passing the midway portion in the length direction of the ink supply tube 240 through the slit 243 without being accompanied by elastic deformation.

Figure 31B:
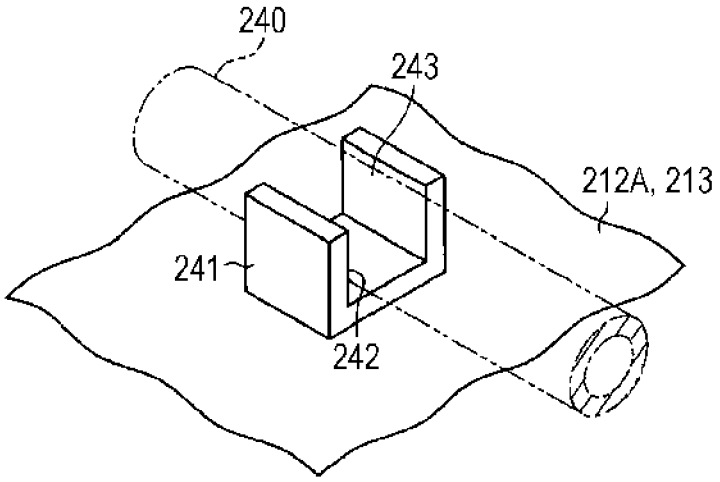

For example, as shown in FIG. 31B, a configuration may be made such that the width of the slit 243 of the spacer 241 and the width of the recess portion 242 are set to have the same width dimension and the width dimension is substantially the same as the outer diameter of the ink supply tube 240. Incidentally, in FIG. 31B, a case where the ink supply tube 240 is one piece is shown as an example. Of course, in a case where a plurality of ink supply tubes 240 is inserted into the recess portion 242 in a parallel state, the width dimension of the recess portion 242 is set to be substantially the same as a width dimension along a juxtaposition direction of the ink supply tubes 240. According to this configuration, by fitting the ink supply tube 240 into the recess portion 242 of the spacer 241 in a state where deformation is suppressed, it is possible to fix the ink supply tube 240 such that the ink supply tube 240 cannot move in a direction crossing the length direction thereof. Of course, a configuration may also be made such that the width dimension of the recess portion 242 of the spacer 241 is larger than the outer diameter of the ink supply tube 240.

Figure 31C:
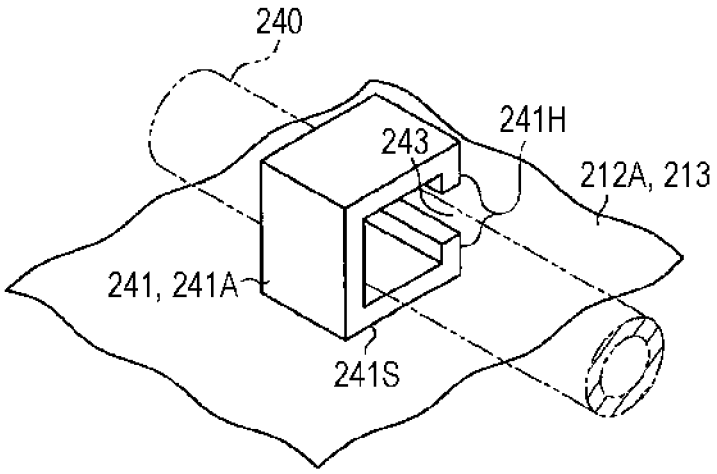

Alternatively, as shown in FIG. 31C, the gap forming member may also have a configuration in which the slit 243 is formed in a side wall portion 241H that is a surface adjacent to a contact surface 241S with a member on which a tubular body 241A constituting the spacer 241 is mounted, of a peripheral wall of the tubular body 241A. According to this configuration, it is possible to restrict the movement of the ink supply tube 240 inserted into the spacer 241 along the gravity direction in a use state of the third printer 211. Therefore, for example, by using the spacer 241 in the tenth embodiment described above, it is possible to prevent the ink supply tube 240 from carelessly slipping out in the gravity direction from a state where the ink supply tube 240 is mounted on the image reading section 213 side, in a state where the image reading section 213 is swung (displaced) so as to expose the opening portion 212K.

Eleventh Embodiment

Next, the overall configuration of a fourth printer 211A in which a functional configuration is different from that of the third printer 211 will be described with reference to FIGS. 32A and 32B. In addition, the same constituent members (constituent elements) as those in the third printer 211 among constituent members (constituent elements) of the fourth printer 211A are denoted by the same reference numerals as those in the third printer 211 and the description thereof is omitted.

Figure 32A:
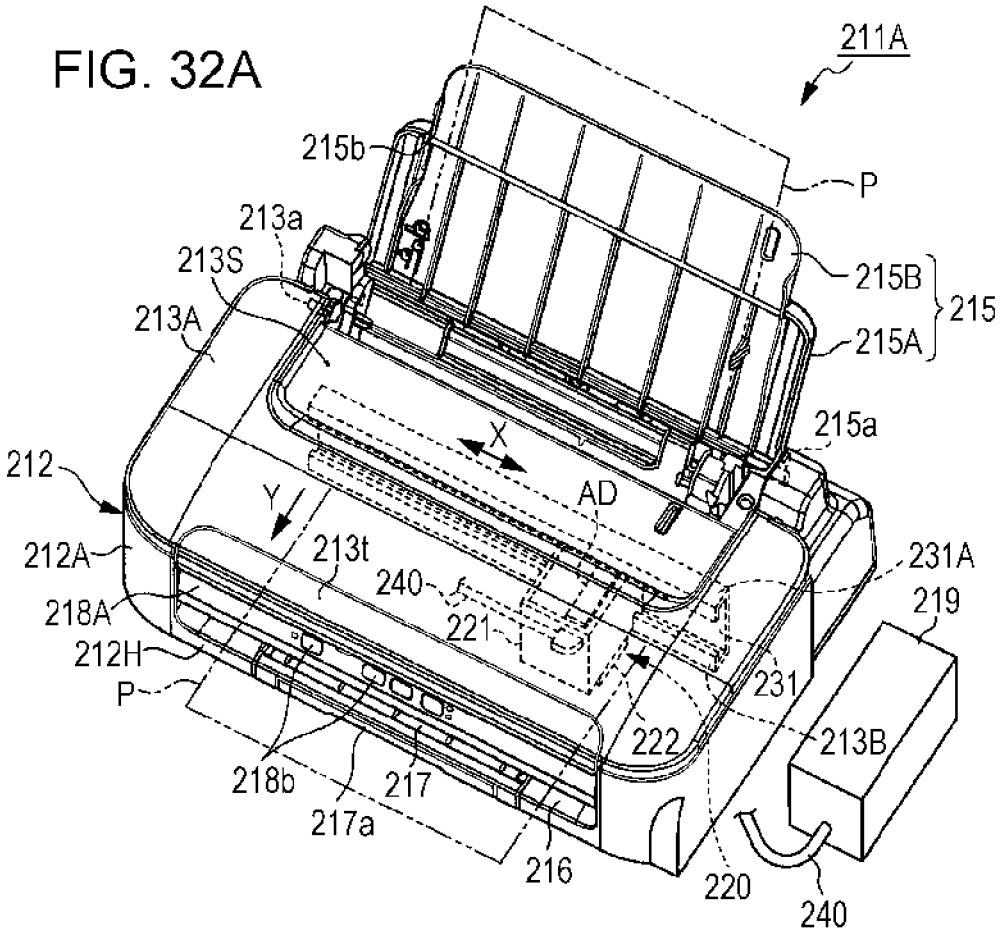
FIGS. 32A and 32B are perspective views showing the fourth printer of an eleventh embodiment.

As shown in FIG. 32A, the fourth printer 211A has the apparatus main body 212 exhibiting a substantially rectangular parallelepiped shape, and the ink tank 219 as an example of the liquid accommodation section, which is a separate body from the apparatus main body 212 and exhibits a substantially rectangular parallelepiped shape, similar to the third printer 211.

The print function section 212A as an example of the casing section having the printing section 220 built-in is disposed on the lower portion side in the gravity direction of the apparatus main body 212 that is the side where ink is supplied, and on the other hand, on the upper portion side that is the anti-gravity direction side of the apparatus main body 212, a cover section 213A displaceable with respect to the print function section 212A is disposed as an example of the cover member. The cover section 213A has a configuration in which the cover section 213A is turned (displaced) around the pivot 213*a* provided at one side end (the rear side) of the apparatus main body 212, whereby the side end side (the front side) on the opposite side to the pivot 213*a* in the apparatus main body 212 is lifted. That is, a handle 213*t* (refer to FIGS. 32A and 32B) pivotally supported so as to be able to rotate with respect to the cover section 213A is provided at a front side end of the cover section 213A, and a user of the fourth printer 211A lifts the handle 213*t* at the time of, for example, maintenance, whereby it becomes possible to lift the cover section 213A. Due to the lifting of the cover section 213A, the opening portion 212K (refer to FIG. 33A) is exposed which is provided on the upper side of the printing section 220 and exposes at least a portion of the moving area for the carriage 221 disposed so as to be able to reciprocate in the print function section 212A.

Further, the placement stand 215 on which plural sheets of paper P can be placed in a stacked manner is provided on the rear side of the apparatus main body 212. The placement stand 215 is configured by two bodies, a medium support section 215A which mainly supports the paper P and an extension section 215B which extends a support surface for the paper P. Then, in the placement stand 215, the medium support section 215A is made to be able to be turned around a pivot 215*a* pivotally supported on the print function section 212A, and the extension section 215B is made to be able to be turned around a pivot 215*b* pivotally supported on the medium support section 215A. Therefore, the medium support section 215A and the extension section 215B can be folded by being rotated respectively. On the other hand, an accommodation section 213S as an example of a placement stand accommodation section which can accommodate the placement stand 215 folded is recessed on the upper surface rear side of the cover section 213A.

Figure 32B:
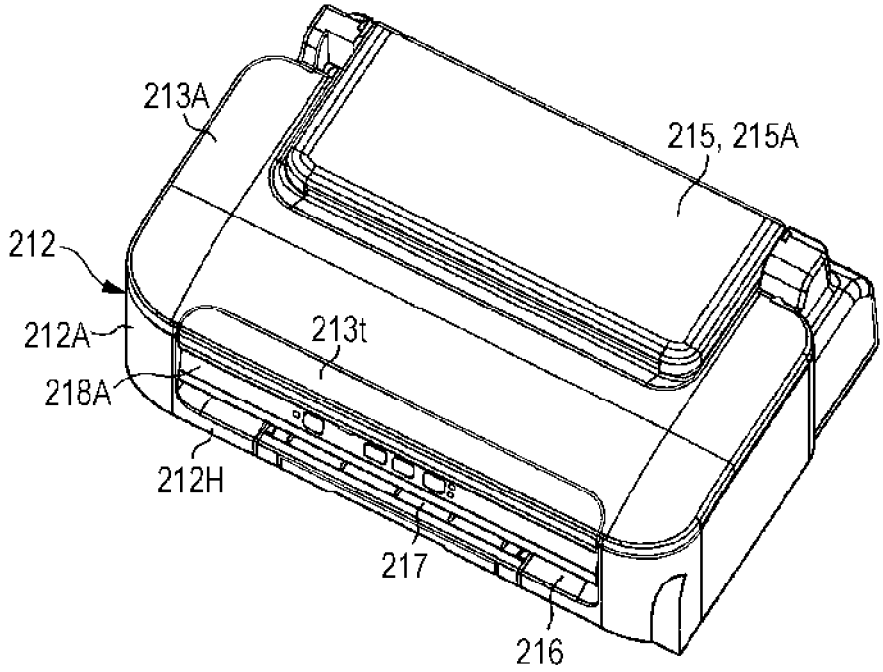

Therefore, as shown in FIG. 32B, a user first rotates forward the extension section 215B and then rotates forward the medium support section 215A, whereby the placement stand 215 can be accommodated to be folded to the rear of the upper surface of the cover section 213A. In this way, for example, in a case where printing is not performed in the fourth printer 211A, it becomes possible to close a transport pathway when the paper P is transported to the printing section 220 and also make the fourth printer 211A be in a compact state where a portion protruding from the apparatus main body 212 is reduced.

The sheets of paper P placed on the placement stand 215 are transported one by one toward the front from the back to the printing section 220 provided in the print function section 212A and printing is performed on the paper P in the printing section 220. That is, the paper P is transported from the placement stand 215 to the printing section 220 by a transport mechanism (not shown) and ink is ejected from the liquid ejecting head 222 that reciprocates by a movement mechanism (not shown) along a direction (this is referred to as the main scanning direction X) crossing the transport direction (this is referred to as the sub-scanning direction Y) of the paper P in the printing section 220 onto the paper P, whereby an image is printed. The paper P with the image printed by the printing section 220 is transported further forward (in the sub-scanning direction Y) from the printing section 220 and discharged from the paper discharge port 216 provided in the front surface of the apparatus main body 212 (the print function section 212A).

The apparatus main body 212 (the print function section 212A) has the tray accommodation section 212H in which the stacker 217 as an example of the discharge tray taking the paper P which is discharged from the paper discharge port 216 is accommodated, on the lower side of the paper discharge port 216. The stacker 217 can be easily drawn out from the apparatus main body 212 by using the gripping portion 217*a*, thereby being drawn out from the apparatus main body 212 according to the length in the discharge direction (the transport direction) of the paper P which is discharged.

On the other hand, the apparatus main body 212 (the print function section 212A) has the operation panel section 218A for making a printing operation or the like in the printing section 220 be performed, at a position above the tray accommodation section 212H. The operation panel section 218A is configured by a casing portion exhibiting an inclined surface in which the lower side thereof protrudes further to the discharge direction side of the paper P than the upper side. In the inclined surface, the manual operation buttons 218*b* such as a power button, or the like is provided as the operation member that is operated at the time of use such as execution of printing, and thus an operation by a user is facilitated.

Incidentally, the printing section 220 provided in the fourth printer 211A of this embodiment has the same configuration as that of the third printer 211 described above. That is, the printing section 220 has the carriage 221 as an example of the moving body which reciprocates in the main scanning direction X, and the carriage 221 is provided with the liquid ejecting head 222 that ejects ink. Then, the carriage 221 is disposed so as to be able to move (reciprocate) in the main scanning direction X while being guided by the guide frame 230 that is a plate member extending along the main scanning direction X. Then, ink supplied by the ink supply tube 240 is ejected from the liquid ejecting head 222 provided in the carriage 221 which reciprocates, whereby printing on the paper P is performed.

Further, also in the fourth printer 211A, the ink supply tube 240 which supplies ink from the ink tank 219 in a state of accommodating ink is connected to the relay adaptor AD mounted on the carriage 221. Accordingly, the ink supply tube 240 forms an ink flow path in which ink can flows between the ink tank 219 and the liquid ejecting head 222.

In addition, also in the fourth printer 211A, one type of ink (for example, black ink) is set to be supplied from the ink tank 219 and a single relay adaptor AD corresponding to one type of ink is set to be mounted on the carriage 221. Of course, with respect to the relay adaptor AD, in a case where a plurality of types of ink is supplied from the ink tank 219, a plurality of relay adaptors AD corresponding to the number of types of ink is mounted.

The eleventh embodiment is the same aspect as the eighth embodiment in the third printer 211. That is, the spacer 241 as the gap forming member is provided between the print function section 212A and the cover section 213A. Therefore, in the following description, description overlapping that of the eighth embodiment is appropriately omitted. In addition, in FIG. 33A, illustration is made in a state where the cover section 213A is dismounted from the apparatus main body 212.

Figure 33A:
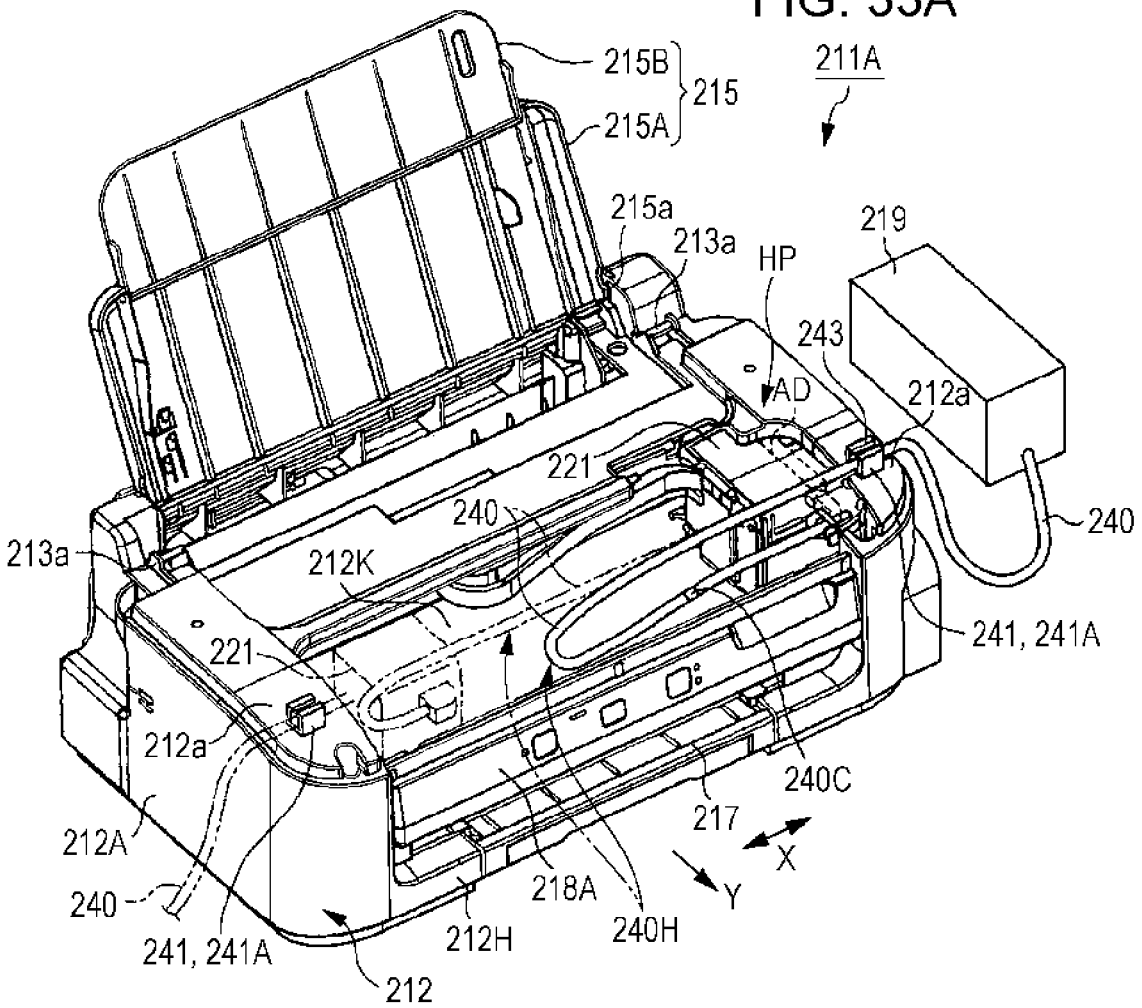
FIG. 33A is a perspective view showing a state where a cover section is dismounted in the fourth printer of the eleventh embodiment relating to the disposition of the ink supply tube.

As shown in FIG. 33A, the ink tank 219 which accommodates ink to be supplied to the carriage 221 (the relay adaptor AD) side is disposed outside the casing on the right side when viewed from the fore side in the sub-scanning direction Y with respect to the apparatus main body 212. That is, the ink tank 219 is disposed outside the moving area for the carriage 221 and at a position close to the home position HP in the main scanning direction X. Then, one end side of the ink supply tube 240 functioning as a flow path for ink accommodated in the ink tank 219 is connected to the ink tank 219. Further, the other end side of the ink supply tube 240 is inserted from a position close to the home position HP in the main scanning direction X of the carriage 221 into the moving area for the carriage 221 which is exposed through the opening portion 212K provided in the print function section 212A, and then connected to the relay adaptor AD mounted on the carriage 221.

On the upper side of the print function section 212A in which the opening portion 212K is provided, upper surfaces 212*a* formed to be slightly curved toward the front side in the sub-scanning direction Y are formed on both sides in the main scanning direction X with respect to the opening portion 212K. The spacer 241 having a substantially rectangular tubular shape is fixed to at least one of the upper surfaces 212*a* in a state where a direction of a tube axis follows the moving direction of the carriage 221.

In this embodiment, the spacer 241 is fixed on the upper surface 212*a* on the right side when viewed from the fore side in the sub-scanning direction Y and at a position corresponding to the front side in the sub-scanning direction Y in a space area of the opening portion 212K. Of course, the spacer 241 may be fixed at an arbitrary position in the upper surface 212*a*. In addition, the spacers 241 may also be fixed to both the upper surfaces 212*a* on the left and right sides when viewed from the fore side in the sub-scanning direction Y, as shown in FIG. 33A. If doing so, when the cover section 213A has been displaced in a state of closing the opening portion 212K, since the cover section 213A comes into contact with the spacers 241 on both sides in the main scanning direction X, occurrence of torsion in the cover section 213A can be suppressed.

The spacer 241 fixed is the tubular body 241A which is sandwiched between the upper surface 212*a* and the cover section 213A in a case where the cover section 213A is turned in a direction to close the opening portion 212K of the print function section 212A. Then, due to the tubular body 241A, a configuration is made in which ink can flow without shut-off of an ink flow path in the tube portion of the ink supply tube 240 which passes through the gap between the cover section 213A and the print function section 212A. In other words, the spacer 241 is provided for forming a gap having a size that does not shut off an ink flow path in the ink supply tube 240, between the image reading section 213 and the print function section 212A, and also passing the ink supply tube 240 through the formed gap.

Further, as shown in FIG. 33A, a curved portion having a substantial U-shape is formed in the portion between the spacer 241 and the relay adaptor AD in the length direction of the ink supply tube 240. The curved portion functions as the deformation and movable portion 240H that is deformed to follow the movement of the carriage 221 that moves in the moving area, as shown by a two-dot chain line in FIG. 33A. Then, the tube length of the deformation and movable portion 240H is defined (regulated) according to the length of the ink supply tube 240 which is inserted through the spacer 241.

Figure 33B:
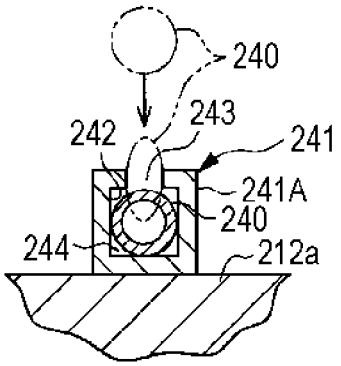
FIG. 33B is a schematic cross-sectional view of the gap forming member.

Further, as shown in FIG. 33B, the ink supply tube 240 can be inserted into the internal space area 244 of the spacer 241 through the slit 243 while being accompanied by elastic deformation, by movement in a direction perpendicular to (crossing) the length direction of the ink supply tube 240, similar to the eighth embodiment. Then, if a state is created where the ink supply tube 240 is inserted into the internal space area 244 of the spacer 241, the outer surface of the ink supply tube 240 comes into contact with the recess portion 242 which is formed by the inner surface of the spacer 241 (the tubular body 241A), whereby the movement of the ink supply tube 240 in a direction crossing the length direction is restricted.

In addition, in this embodiment, the other end side of the ink supply tube 240 with one end side connected to the ink tank 219 may also be inserted from the outside of the casing on the left side when viewed from the fore side in the sub-scanning direction Y, that is, a position close to the opposite side to the home position HP in the main scanning direction X of the carriage 221 into the opening portion 212K. That is, as shown by a two-dot chain line in FIG. 33A, the ink supply tube 240 may also be inserted into the opening portion 212K through the spacer 241 provided on the upper surface 212*a* on the left side of the print function section 212A.

Figure 33C:
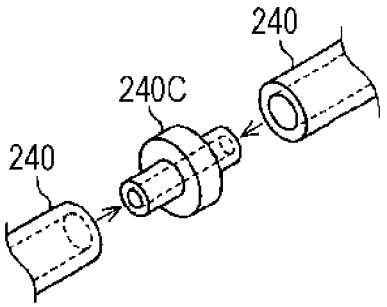
FIG. 33C is a perspective view showing a joint of the ink supply tube.

In addition, in a case where the ink supply tube 240 is inserted from a position close to the opposite side to the home position HP into the opening portion 212K, in order to shorten the length of the ink supply tube 240, it is preferable that the ink tank 219 be disposed outside the casing on the left side when viewed from the fore side in the sub-scanning direction Y with respect to the apparatus main body 212, Incidentally, similar to the third printer 211, also in the fourth printer 211A of this embodiment, the ink supply tube 240 may also have a configuration in which a plurality of tubes is connected through the joint 240C connecting the tubes in the length direction thereof. Then, the joint 240C is provided at a plurality of places according to the number of tubes which are connected between the ink tank 219 and the carriage 221, and allows ink to flow between the connected tubes. In addition, also in this embodiment, a seam in which two tubes are connected through the joint 240C having a through-hole and a structure in which tubular portions in which the tubes are inserted are formed on both sides, as shown in FIG. 33C as an example, is formed at one place in the deformation and movable portion 240H of the ink supply tube 240, as shown in FIG. 33A.

Next, the action of the fourth printer 211A in the eleventh embodiment will be described.

The fourth printer 211A has the same action as that of the third printer 211. That is, in a state where the spacer 241 is mounted on the upper surface 212*a* (the print function section 212A), it is possible to take the ink supply tube 240 out of the internal space area 244 of the spacer 241 by moving the midway portion in the length direction of the ink supply tube 240 in a direction crossing the length direction to pass through the slit 243 while being accompanied by elastic deformation. Therefore, the ink supply tube 240 is dismounted from the spacer 241 without requiring complicated work.

On the other hand, in a case of mounting the ink supply tube 240 on the spacer 241, in a state where the spacer 241 is mounted on the print function section 212A, the ink supply tube 240 is inserted into the internal space area 244 of the spacer 241 by moving the midway portion in the length direction of the ink supply tube 240 in a direction crossing the length direction to pass through the slit 243 while being accompanied by elastic deformation (refer to FIG. 33B). At this time, it is not necessary to perform work such as dismounting an end portion of the ink supply tube 240 on the side connected to the relay adaptor AD from the relay adaptor AD. Therefore, the ink supply tube 240 is mounted on the spacer 241 without requiring complicated work.

Twelfth Embodiment

Figure 34:
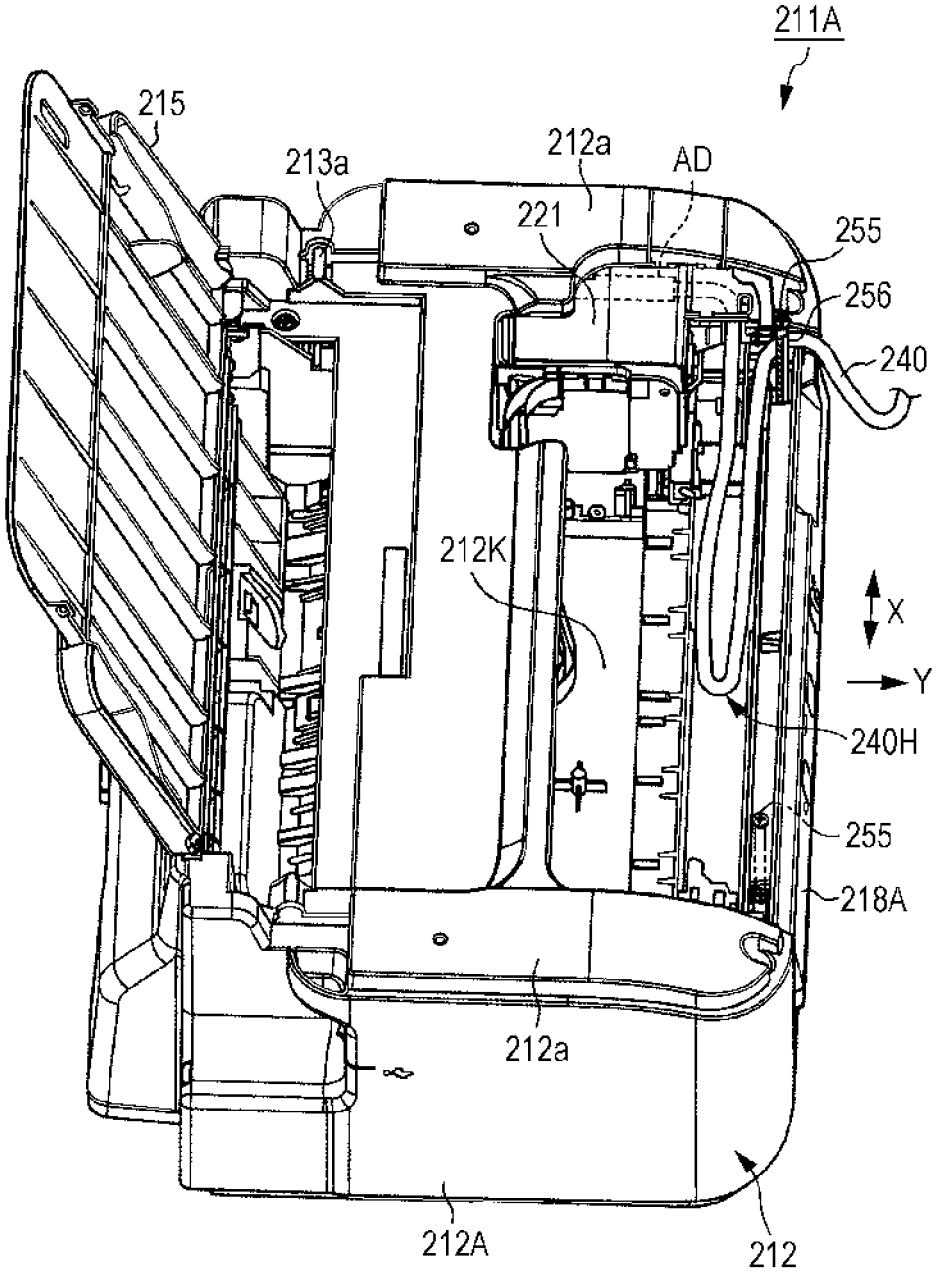
FIG. 34 is a perspective view of the fourth printer of a twelfth embodiment relating to the disposition of the ink supply tube.
Figure 35:
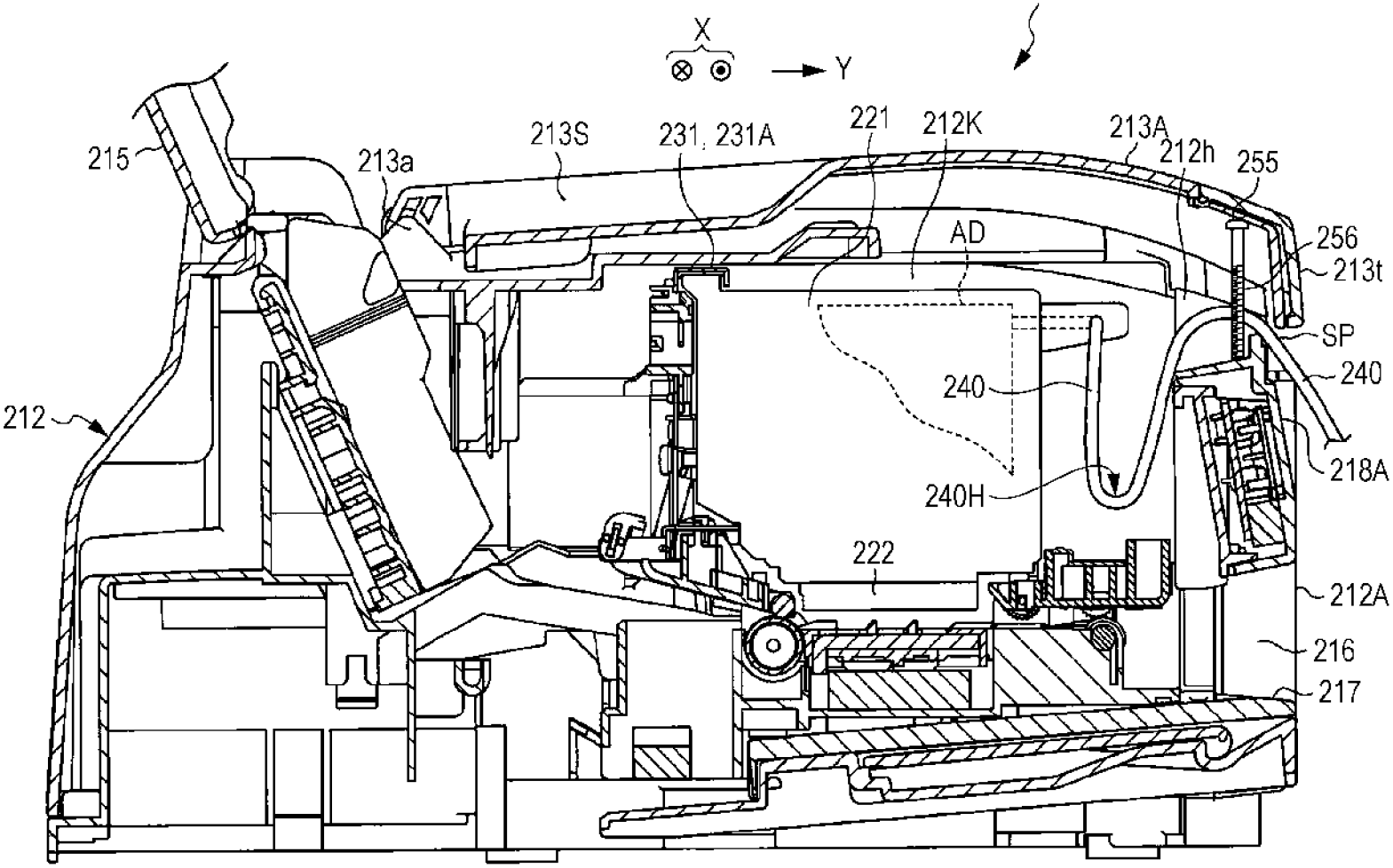
FIG. 35 is a cross-sectional view of the fourth printer showing a disposition state of the ink supply tube in the fourth printer of the twelfth embodiment.

Next, a twelfth embodiment relating to the disposition of the ink supply tube 240 will be described with reference to FIGS. 34 and 35. The twelfth embodiment is the same aspect as the ninth embodiment in the third printer 211. That is, the gap forming member is configured to include a fixing screw which is disposed to have a shaft portion which is partially screwed into a threaded hole formed in the print function section 212A. Therefore, in the description of this embodiment, the same constituent members as those in the ninth embodiment described above are denoted by the same reference numerals as those in the ninth embodiment and the description thereof is omitted. Further, in FIGS. 34 and 35, illustration is made with the joint 240C of the ink supply tube 240 and the ink tank 219 omitted. Further, in FIG. 34, illustration is made in a state where the cover section 213A is dismounted from the apparatus main body 212.

As shown in FIG. 34, on the front surface that is the fore side in the sub-scanning direction Y of the print function section 212A, an operation panel section 218A is fixed to the casing portion of the apparatus main body 212 (the print function section 212A) by the fixing screw 255. Therefore, in this embodiment, by fixing the fixing screw 255 so as to partially screw the shaft portion 256 thereof, the portion which is not screwed into a threaded hole (not shown) provided in the print function section 212A in the shaft portion 256 protrudes upward from the operation panel section 218A.

Further, in a case where the operation panel section 218A is fixed by a plurality of fixing screws 255, as shown by a two-dot chain line in FIG. 34, another fixing screw 255 separated in the main scanning direction X may also be fixed so as to partially screw the shaft portion 256 thereof. If doing so, when the cover section 213A has been displaced in a state of closing the opening portion 212K, since the cover section 213A comes into contact with the fixing screws 255 at two places separated from each other along the main scanning direction X, occurrence of torsion in the cover section 213A can be suppressed.

As a result, as shown in FIG. 35, the screw head of the fixing screw 255 comes into contact with a lower surface-side site of the cover section 213A, whereby a gap SP for passing the ink supply tube 240 is formed between the print function section 212A and the cover section 213A. That is, the gap forming member is configured by the fixing screw 255 and the lower surface-side site of the cover section 213A.

In addition, it is preferable that the fixing screw 255 which fixes the operation panel section 218A adopt a so-called stepped screw in which a thread is formed in only a leading end portion thereof. If doing so, it is possible to form the gap SP for passing the ink supply tube 240 between the print function section 212A and the cover section 213A in a state where the operation panel section 218A is fixed without being loosened.

The gap SP between the print function section 212A and the cover section 213A formed in this manner is formed in the largest dimension on the front side of the apparatus main body 212 and on the upper side of the operation panel section 218A fixed. Therefore, in this embodiment, as shown in FIGS. 34 and 35, the ink supply tube 240 is inserted into the gap SP formed on the front side of the apparatus main body 212. In this way, it is possible to insert the ink supply tube 240 into the opening portion 212K while suppressing widening of the gap SP more than necessary.

Next, the action of the fourth printer 211A in the twelfth embodiment will be described.

The fourth printer 211A acts in the same way as the third printer 211. That is, in the fourth printer 211A, since the cover section 213A is in a contact state with respect to the head portion of the fixing screw 255 by its own weight, the gap SP between the cover section 213A and the print function section 212A, through which the ink supply tube 240 passes, can be widened according to the amount of lifting of the cover section 213A. As a result, in a case of dismounting the ink supply tube 240 from the print function section 212A in order to perform the maintenance of the ink supply tube 240, a user lifts the cover section 213A, whereby it is possible to easily dismount the ink supply tube 240 from the print function section 212A.

In addition, in the twelfth embodiment, as shown in FIG. 35, the movement of the ink supply tubes 240 which passes through the gap SP between the cover section 213A and the operation panel section 218A, in a direction crossing the longitudinal direction thereof, is restricted. That is, in the print function section 212A, a wall surface 212*h* approximately perpendicular to the main scanning direction X is formed at an end portion in the main scanning direction X in the operation panel section 218A, and the ink supply tube 240 passes between the wall surface 212*h* and the shaft portion 256 of the fixing screw 255. As a result, the movement of the ink supply tube 240 in a direction crossing the longitudinal direction thereof is restricted.

Thirteenth Embodiment

Next, a thirteenth embodiment relating to the disposition of the ink supply tube 240 will be described with reference to FIGS. 36A and 36B. The thirteenth embodiment is the same aspect as the tenth embodiment in the third printer 211. That is, the thirteenth embodiment has a configuration in which the gap forming member is provided in the cover section 213A. In addition, in the description of this embodiment, the same constituent members as those in the tenth embodiment described above are denoted by the same reference numerals as those in the tenth embodiment and the description thereof is omitted. Further, in FIG. 36A, illustration is made with the joint 240C of the ink supply tube 240 omitted.

Figure 36A:
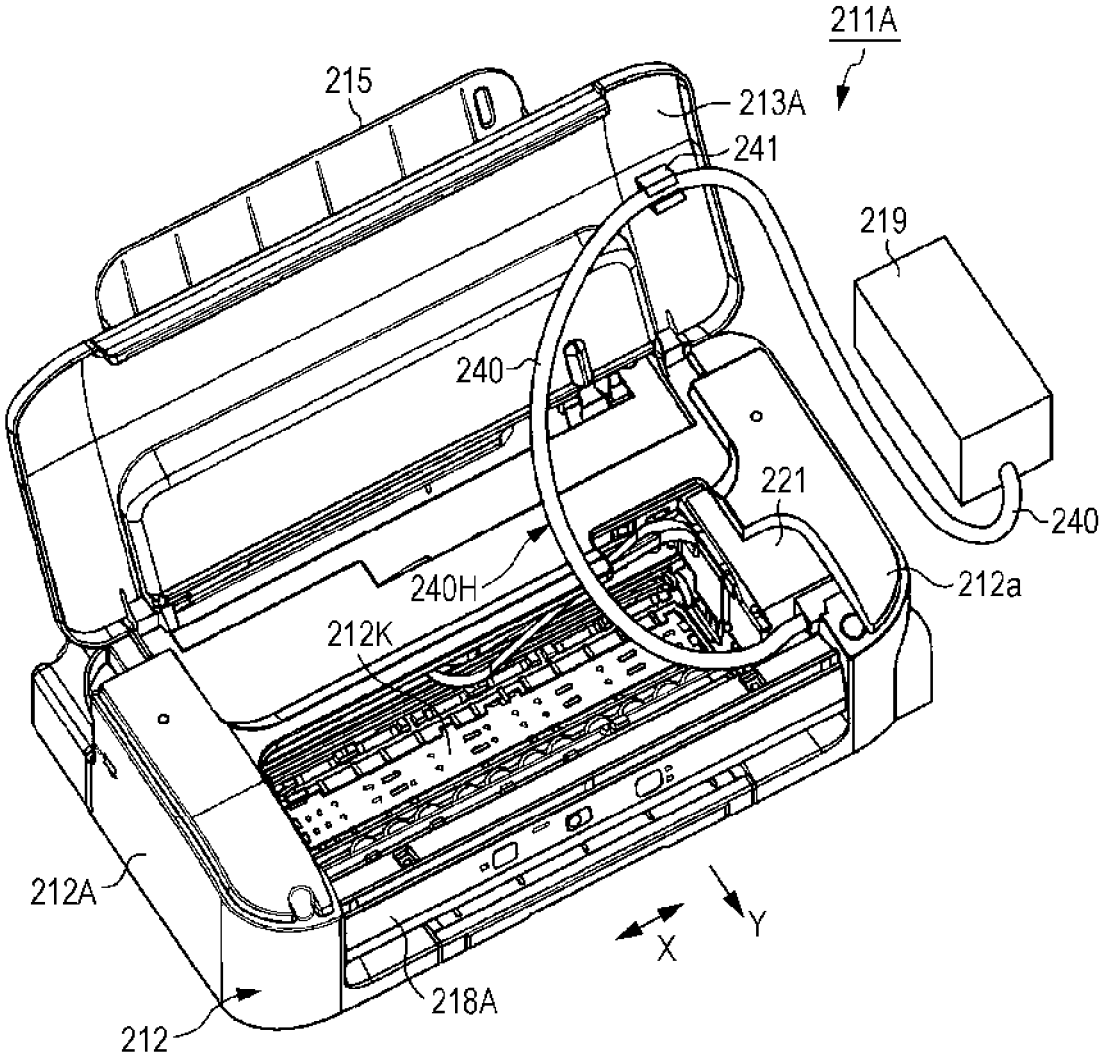
FIG. 36A is a perspective view showing a state where a cover section is lifted in the fourth printer of a thirteenth embodiment relating to the disposition of the ink supply tube.

As shown in FIG. 36A, on the lower surface of the cover section 213A, the spacer 241 is provided at a position that faces a casing constituting the opening portion 212K in a state where the cover section 213A closes the opening portion 212K. In this embodiment, the spacer 241 is mounted on the right side when viewed from the fore side in the sub-scanning direction Y in the cover section 213A by being fixed by adhesion or being fixed by a screw. Of course, the fixing position of the spacer 241 may be any position, provided that it is a position where the spacer 241 comes into contact with the upper surface 212*a* of the print function section 212A in the closed state of the cover section 213A.

Figure 36B:
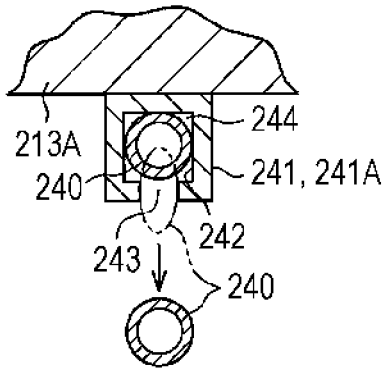
FIG. 36B is a schematic diagram showing a state where the ink supply tube is taken out of the spacer.

As shown in FIGS. 36A and 36B, in this embodiment, the spacer 241 is provided such that the slit 243 thereof faces the print function section 212A that is the gravity direction side. Further, the width dimension of the slit 243 is set to a dimension in which the ink supply tube 240 can be elastically deformed and then pass through the slit 243 by its own weight, as shown by a two-dot chain line in FIG. 36B, while the cover section 213A moves (swings) to a position to expose the opening portion 212K of the print function section 212A.

Next, the action of the fourth printer 211A in the thirteenth embodiment will be described.

In the thirteenth embodiment, in a case of dismounting the ink supply tube 240 from the cover section 213A in order to perform the maintenance of the ink supply tube 240, the cover section 213A is lifted first. Then, the ink supply tube 240 inserted into the space area 244 of the spacer 241 rises along with the cover section 213A lifted, whereby the tube's own weight that is generated with the rise acts in a downward direction crossing the length direction of the tube. As a result, the ink supply tube 240 is taken out of the internal space area 244 of the spacer 241 through the slit 243, thereby being dismounted from the cover section 213A, as shown in FIG. 36B.

Further, although illustration and description are omitted here, in this embodiment, a configuration is also acceptable in which in a case where the cover section 213A is displaced in a direction to open the opening portion 212K of the print function section 212A, the ink supply tube 240 is disengaged from the cover section 213A along with the spacer 241.

In addition, in the fourth printer 211A, the gap forming member which is used in the eleventh to thirteenth embodiments described above may also have another configuration. That is, the gap forming members having other configurations which are used in the third printer 211 shown in FIGS. 31A, 31B, and 31C can be likewise used in the fourth printer 211A. In addition, here, description thereof is omitted.

Further, in the fourth printer 211A, although in the eleventh to thirteenth embodiments described above, description has been performed as a case where the ink supply tube 240 is one piece, ink may be supplied from the plurality of ink supply tubes 240, similar to the third printer 211. That is, a configuration is also acceptable in which a plurality of ink tanks 219 is provided in the fourth printer 211A and ink is supplied from each ink tank 219 side through each ink supply tube 240 to the liquid ejecting head 222 side. As an example, a case where in the eleventh embodiment in which the spacer 241 is set to be the gap forming member, the plurality of ink supply tubes 240 is disposed will be described with reference to FIG. 37.

Figure 37:
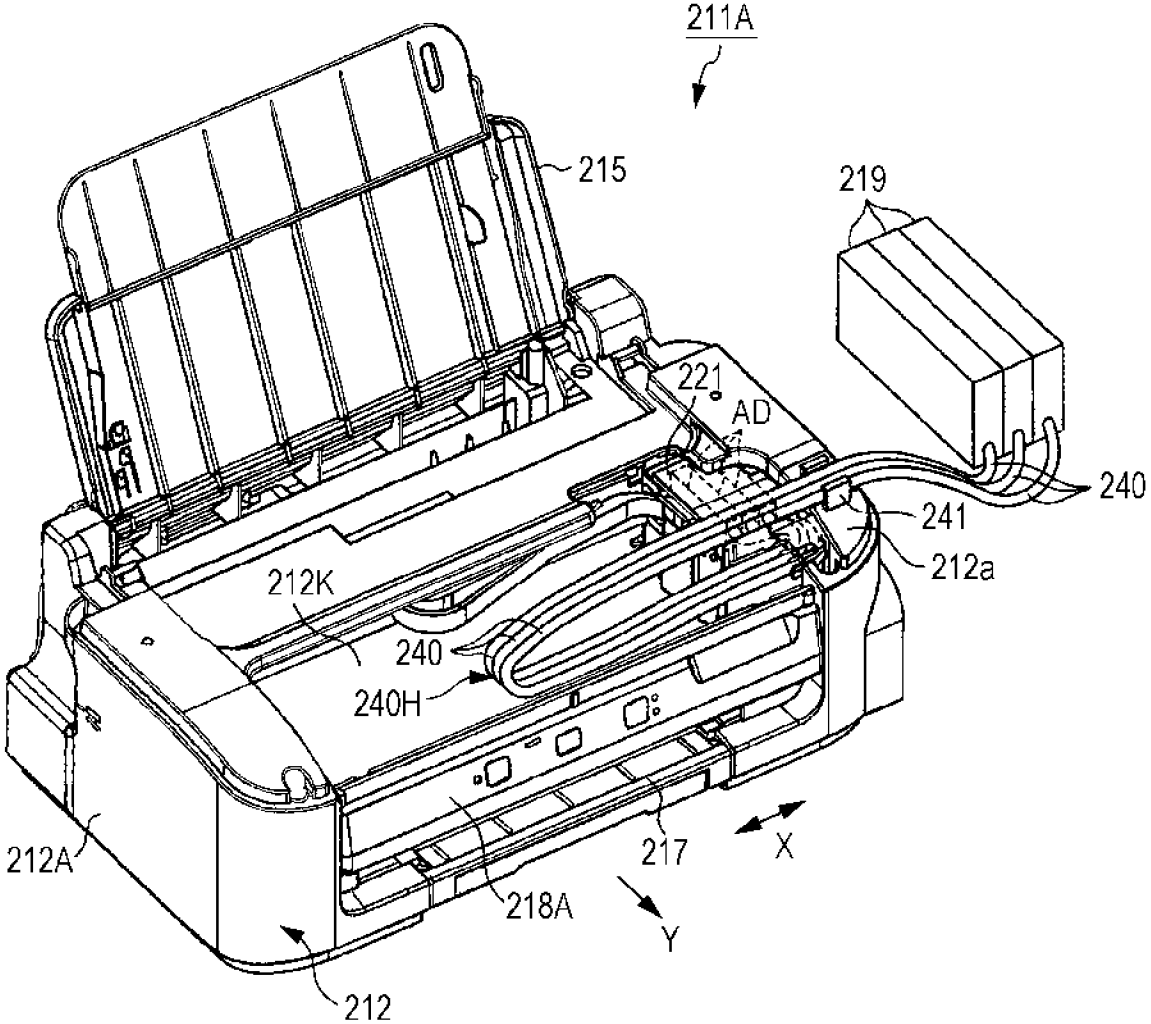
FIG. 37 is a perspective view of the fourth printer showing a state where a plurality of ink supply tubes is disposed, in the fourth printer of the eleventh embodiment.

As shown in FIG. 37, a plurality of (here, three) ink supply tubes 240 is fixed to the upper surface 212*a* of the print function section 212A by the spacer 241 in a parallel state along the sub-scanning direction Y. The ink supply tubes 240 are fixed in this manner, whereby the deformation and movable portion 240H has a shape in which it is easy to follow the movement of the carriage 221. In addition, each of the plurality of ink supply tubes 240 may be configured by tubes connected to each other in parallel and may also be configured by an individual tube separated individually.

According to this configuration, the ink supply tubes 240 are provided in the number corresponding to the number of ink tanks 219, whereby it is possible to supply ink from the respective ink tank 219 to the liquid ejecting head 222. Of course, it goes without say that leading-around of the plurality of ink supply tubes 240 in the fourth printer 211A shown in FIG. 37 can also be applied to the third printer 211 in the eighth embodiment.

In the embodiments described above, the printer may have a configuration of an off-carriage type in which an ink cartridge is not mounted on the carriage 21. Further, a configuration is also acceptable in which an ink tank is disposed in the inside of a printer main body. Further, a configuration is also acceptable in which only ink of a specific color is disposed outside a printer main body.

In the embodiments described above, the ink tank may be a so-called refill type in which ink can be injected and may also be a so-called pack replacement type in which an ink pack in which ink is accommodated in a pack (a bag) is replaced.

In the embodiments described above, the ink tank may be mounted on a printer main body and may also be disposed to be spaced from the printer main body.

In the first to thirteenth Embodiments described above, the target is not limited to paper and cloth, a resin film, a resin sheet, a metal sheet, or the like may also be adopted.

Each of the first printer 11, the second printer 11A, the third printer 211, and the fourth printer 211A of the embodiments described above may also be a liquid ejecting apparatus which ejects or discharges liquid other than ink. In addition, as a state of liquid that is discharged as a minutely small amount of droplet from the liquid ejecting apparatus, a granular shape, a tear shape, or a shape tailing into a line is set to be included. Further, it is acceptable if the liquid as referred to herein is a material that can be ejected from the liquid ejecting apparatus. For example, it is acceptable if the liquid is a substance in a state when it is in a liquid phase, and the liquid is set to include a liquid body with high or low viscosity, and a fluidal body such as sol, gel water, other inorganic solvents, an organic solvent, a solution, a liquid resin, or a liquid metal (metal melt). Further, the liquid is set to include not only liquid as one state of substance, but also a material in which particles of a functional material made of a solid material such as pigment or a metal particle are dissolved, dispersed, or mixed in a solvent, or the like. As representative examples of the liquid, ink as described in the above embodiments, liquid crystal, or the like can be given. Here, ink is set to include general water-based ink and oil-based ink, and various liquid compositions such as gel ink or hot-melt ink. As a specific example of the liquid ejecting apparatus, there is a liquid ejecting apparatus that ejects liquid which includes, in a dispersed or dissolved form, a material such as an electrode material or a color material, which is used for the manufacture or the like of, for example, a liquid crystal display, an EL (electroluminescence) display, a surface-emitting display, or a color filter. Further, a liquid ejecting apparatus that ejects biological organic matter which is used for the manufacturing of a biochip, a liquid ejecting apparatus that is used as a precision pipette and ejects liquid which is a sample, a cloth printing apparatus, a micro-dispenser, or the like is also acceptable. In addition, a liquid ejecting apparatus that ejects lubricating oil to a precision machine such as a clock or a camera by a pin point, or a liquid ejecting apparatus that ejects a transparent resin solution such as ultraviolet curing resin onto a substrate in order to form a hemispherical micro-lens (an optical lens) or the like which is used in an optical communication element or the like is also acceptable. Further, a liquid ejecting apparatus that ejects an etching solution such as acid or alkali in order to etch a substrate or the like is also acceptable.

The entire disclosure of Japanese Patent Application No. 2012-178150 filed on Aug. 10, 2012, and No. 2012-178153 filed on Aug. 10, 2012, are expressly incorporated by reference herein.

What is claimed is:

1. A liquid ejecting apparatus comprising:

a liquid ejecting head that ejects liquid onto a target;

a casing section in which a carriage provided with the liquid ejecting head is movably disposed and an opening portion that exposes at least a portion of a moving area for the carriage disposed therein is formed;

a cover member that is displaceable with respect to the casing section;

a liquid accommodation section that is located outside the casing section in a state of accommodating the liquid that the liquid ejecting head ejects;

a liquid supply tube that connects the liquid accommodation section and the liquid ejecting head such that the liquid can flow; and a gap forming member in the form of a spacer that is attached to one or the other of the casing section and the cover member, wherein a recess portion of the spacer removably receives a portion of the liquid supply tube and the spacer is configured such that the portion of the liquid supply tube positioned in the recess portion is removable from the recess portion without requiring dismounting of the liquid supply tube from the liquid accommodation section or the liquid ejecting head.

2. The liquid ejecting apparatus according to claim 1, wherein the gap forming member has a contact portion that comes into contact with the outer surface of the liquid supply tube, thereby restricting the movement of the liquid supply tube in a direction crossing a length direction thereof.

3. The liquid ejecting apparatus according to claim 1, wherein a slit for the passage of the liquid supply tube is formed in a top of the spacer, and the liquid supply tube is removable from within the recess portion by way of the slit.

4. The liquid ejecting apparatus according to claim 1, wherein the gap forming member is provided at the cover member, and the liquid supply tube is disengaged from the gap forming member in a case where the cover member is displaced in a direction to open the opening portion.

5. The liquid ejecting apparatus according to claim 1, wherein the liquid supply tube includes a plurality of tubes connected through a joint that connects the tubes.

6. The liquid ejecting apparatus according to claim 1, wherein the liquid supply tube is provided one piece or in plural pieces.

7. The liquid ejecting apparatus according to claim 1, wherein the liquid accommodation section that is located outside the casing section in a state of accommodating the liquid to be ejected from the liquid ejecting head accommodates black liquid.

8. The liquid ejecting apparatus according to claim 1, wherein the recess portion is formed at a substantially centered position of the front and upper area of the casing section and is adjacent to an operation panel.

9. A liquid ejecting apparatus comprising:

a liquid ejecting head that ejects liquid onto a target;

a casing section in which a carriage provided with the liquid ejecting head is movably disposed and an opening portion that exposes at least a portion of a moving area for the carriage disposed therein is formed;

a cover member that is displaceable with respect to the casing section;

a liquid accommodation section that is located outside the casing section in a state of accommodating the liquid that the liquid ejecting head ejects;

a liquid supply tube that connects the liquid accommodation section and the liquid ejecting head such that the liquid can flow;

a locking recess portion that locks the cover member;

a locking projection that engage the locking recess portion;

a screw that forms the locking recess portion; and wherein the screw forms a gap having a size that does not shut off at least a flow path for the liquid of the liquid supply tube and passes the liquid supply tube through the formed gap when the cover member has been displaced toward the casing section.

10. The liquid ejecting apparatus according to claim 9, wherein a locking member is fixed to the locking recess portion so as to engage the locking projection by the screw.

* * * * *